US011809100B2

(12) United States Patent
Landa et al.

(10) Patent No.: US 11,809,100 B2
(45) Date of Patent: *Nov. 7, 2023

(54) INTERMEDIATE TRANSFER MEMBERS FOR USE WITH INDIRECT PRINTING SYSTEMS AND PROTONATABLE INTERMEDIATE TRANSFER MEMBERS FOR USE WITH INDIRECT PRINTING SYSTEMS

(71) Applicant: LANDA CORPORATION LTD., Rehovot (IL)

(72) Inventors: Benzion Landa, Nes Ziona (IL); Sagi Abramovich, Ra'anana (IL); Meir Soria, Jerusalem (IL)

(73) Assignee: LANDA CORPORATION LTD., Rehovot (IL)

( * ) Notice: Subject to any disclaimer, the term of this patent is extended or adjusted under 35 U.S.C. 154(b) by 150 days.

This patent is subject to a terminal disclaimer.

(21) Appl. No.: 17/382,334

(22) Filed: Jul. 21, 2021

(65) Prior Publication Data

US 2022/0057732 A1 Feb. 24, 2022

Related U.S. Application Data

(63) Continuation of application No. 16/814,900, filed on Mar. 10, 2020, now Pat. No. 11,106,161, which is a continuation of application No. 15/379,625, filed on Dec. 15, 2016, now Pat. No. 10,642,198, which is a continuation-in-part of application No. 14/382,885, filed as application No. PCT/IB2013/051743 on Mar. 5, 2013, now abandoned, said application No. 15/379,625 is a continuation-in-part of application No. 14/382,917, filed as application No. PCT/IB2013/051751 on Mar. 5, 2013, now abandoned, said application No. 16/814,900 is a continuation-in-part of application No. 16/714,756, filed on Dec. 15, 2019, now Pat. No. 10,828,888, which is a continuation of application No. 16/219,582, filed on Dec. 13, 2018, now Pat. No. 10,569,533, which is a continuation of application No. 15/790,026, filed on Oct. 22, 2017, now Pat. No. 10,201,968, which is a continuation of application No. 15/345,238, filed on Nov. 7, 2016, now Pat. No. 9,849,667, which is a continuation of application No. 14/382,759, filed as application No. PCT/IB2013/051719 on Mar. 5, 2013, now Pat. No. 9,517,618.

(60) Provisional application No. 61/640,881, filed on May 1, 2012, provisional application No. 61/640,893, filed on May 1, 2012, provisional application No. 61/640,493, filed on Apr. 30, 2012, provisional application No. 61/635,180, filed on Apr. 18, 2012, provisional application No. 61/611,564, filed on Mar. 15, 2012, provisional application No. 61/611,552, filed on Mar. 15, 2012, provisional application No. 61/611,497, filed on Mar. 15, 2012, provisional application No. 61/611,566, filed on Mar. 15, 2012, provisional application No. 61/606,913, filed on Mar. 5, 2012, provisional application No. 61/641,258, filed on May 1, 2012, provisional application No. 61/611,557, filed on Mar. 15, 2012, provisional application No. 61/607,537, filed on Mar. 6, 2012, provisional application No. 61/611,505, filed on Mar. 15, 2012.

(51) Int. Cl.
*G03G 15/16* (2006.01)

(52) U.S. Cl.
CPC ..... *G03G 15/162* (2013.01)

(58) Field of Classification Search
CPC ..... C03G 15/162; B41F 21/08; B41D 7/00
See application file for complete search history.

(56) References Cited

U.S. PATENT DOCUMENTS 3,235,772 A 2/1966 Emanuel
3,837,878 A 9/1974 Beers
(Continued)

FOREIGN PATENT DOCUMENTS

CN 1305895 A 8/2001
CN 1543404 A 11/2004
(Continued)

OTHER PUBLICATIONS

CN101096455A Machine Translation (EPO, PlatPat and Google) published on Jan. 2, 2008 Fujifilm Corp.
(Continued)

*Primary Examiner* — K. Boyle
(74) *Attorney, Agent, or Firm* — Momentum IP; Marc Van Dyke

(57) ABSTRACT

Disclosed are curable polymer compositions, elastomers thereof and release layers useful in the art of printing made of the disclosed elastomers. Disclosed are also intermediate transfer members having a release layer useful in the art of printing. Disclosed are anisotropic intermediate transfer members. Disclosed are curable adhesive compositions, that in some embodiments are useful in preparing intermediate transfer members useful in printing. Also disclosed are intermediate transfer members useful in the art of printing having a release layer with an image transfer surface having protonatable functional groups apparent thereupon. Also disclosed are methods of making such intermediate transfer members.

18 Claims, 11 Drawing Sheets

(56) References Cited

U.S. PATENT DOCUMENTS 3,935,055 A 1/1976 Carmien
4,093,764 A * 6/1978 Duckett ..... B32B 5/10 428/113
4,204,471 A 5/1980 Becker
4,520,048 A 5/1985 Ranger
4,586,807 A 5/1986 Yuasa
4,792,473 A 12/1988 Vitale
4,867,830 A 9/1989 Chung
5,278,199 A 1/1994 Ohkawa et al.
5,320,214 A 6/1994 Kordis
5,352,507 A * 10/1994 Bresson ..... B41N 10/04 442/373
5,683,841 A 11/1997 Kato
5,757,390 A 5/1998 Gragg et al.
5,780,412 A 7/1998 Scarborough et al.
5,865,299 A 2/1999 Williams
6,318,853 B1 11/2001 Asano et al.
6,335,046 B1 1/2002 Mackey
6,405,006 B1 6/2002 Tabuchi
6,633,735 B2 10/2003 Kellie et al.
6,704,535 B2 * 3/2004 Kobayashi ..... G03G 15/162 399/302
7,419,257 B2 9/2008 Mouri et al.
8,041,275 B2 * 10/2011 Soria ..... G03G 15/1605 399/302
8,119,315 B1 2/2012 Heuft et al.
8,303,071 B2 11/2012 Eun
8,632,147 B2 1/2014 Onishi
9,044,932 B2 6/2015 Ohnishi et al.
9,207,585 B2 12/2015 Hatano et al.
9,227,429 B1 1/2016 LeStrange et al.
9,327,519 B1 5/2016 Larson et al.
9,969,182 B2 5/2018 Torisaka et al.
10,052,865 B2 8/2018 Goto
10,336,060 B2 7/2019 Liu
10,703,093 B2 7/2020 Karlinski et al.
10,703,094 B2 7/2020 Shmaiser et al.
11,106,161 B2 8/2021 Landa et al.
2001/0033688 A1 10/2001 Taylor
2002/0061451 A1 5/2002 Kita et al.
2003/0007055 A1 1/2003 Ogawa
2003/0041777 A1 3/2003 Karl et al.
2003/0103128 A1 6/2003 Missell et al.
2004/0036758 A1 2/2004 Sasaki et al.
2004/0105971 A1 6/2004 Parrinello et al.
2004/0145643 A1 7/2004 Nakamura
2004/0177779 A1 9/2004 Steffen et al.
2004/0221943 A1 11/2004 Yu et al.
2004/0249327 A1 12/2004 Sendijarevic et al.
2004/0265016 A1 12/2004 Kitani et al.
2005/0103437 A1 5/2005 Carroll
2005/0117859 A1 6/2005 Suzuki et al.
2006/0066704 A1 3/2006 Nishida
2006/0120740 A1 6/2006 Yamada et al.
2006/0175559 A1 8/2006 Fischer et al.
2007/0025740 A1 2/2007 Katoh et al.
2007/0077520 A1 4/2007 Maemoto
2008/0066277 A1 3/2008 Colson et al.
2008/0101895 A1 5/2008 Holcomb et al.
2008/0124158 A1 5/2008 Folkins
2008/0232867 A1 9/2008 Minbu et al.
2008/0247780 A1 10/2008 Hara
2008/0295724 A1 12/2008 Lohweg et al.
2009/0073222 A1 3/2009 Hori
2009/0185204 A1 7/2009 Wu et al.
2010/0035501 A1 2/2010 Prudhomme et al.
2010/0123752 A1 5/2010 Eun et al.
2010/0245511 A1 9/2010 Ageishi
2010/0247171 A1 9/2010 Ono et al.
2010/0284705 A1 11/2010 Aoki et al.
2010/0300604 A1 12/2010 Goss et al.
2011/0058859 A1 3/2011 Nakamatsu et al.
2011/0069110 A1 3/2011 Matsumoto et al.
2011/0069117 A1 3/2011 Ohzeki et al.
2011/0069129 A1 3/2011 Shimizu
2011/0149002 A1 6/2011 Kessler
2011/0242181 A1 10/2011 Otobe
2011/0298884 A1 12/2011 Furuta
2012/0014726 A1 1/2012 Sekihara et al.
2012/0183756 A1 7/2012 Higuchi
2012/0236100 A1 9/2012 Toya
2012/0249630 A1 10/2012 Bugner et al.
2012/0280447 A1 11/2012 Kayanuma
2012/0314013 A1 12/2012 Takemoto et al.
2013/0011158 A1 1/2013 Meguro et al.
2013/0016156 A1 1/2013 Ooishi et al.
2013/0095254 A1 4/2013 Ageishi
2013/0096871 A1 4/2013 Takahama
2013/0182045 A1 7/2013 Ohzeki et al.
2013/0229457 A1 9/2013 Yu
2013/0235139 A1 9/2013 Schnabel et al.
2013/0302065 A1 11/2013 Mori et al.
2014/0153956 A1 6/2014 Yonemoto
2014/0168313 A1 6/2014 Ramesh et al.
2014/0176641 A1 6/2014 Hawryschuk et al.
2014/0198162 A1 7/2014 DiRubio et al.
2014/0334855 A1 11/2014 Onishi et al.
2015/0022605 A1 1/2015 Mantell et al.
2015/0085038 A1 3/2015 Liu
2015/0097906 A1 4/2015 Beier et al.
2015/0165758 A1 6/2015 Sambhy et al.
2015/0273835 A1 10/2015 Arimizu et al.
2015/0315403 A1 11/2015 Song et al.
2015/0343797 A1 12/2015 Song et al.
2015/0375474 A1 12/2015 DeGolier et al.
2015/0375543 A1 12/2015 Barnett et al.
2016/0067974 A1 3/2016 Williams
2016/0083609 A1 3/2016 Sisler et al.
2016/0250879 A1 9/2016 Chen et al.
2016/0274519 A1 9/2016 Lim et al.
2016/0378036 A1 12/2016 Onishi et al.
2017/0282599 A1 10/2017 Ido
2017/0329261 A1 11/2017 Salalha et al.
2018/0149998 A1 5/2018 Furukawa
2018/0281382 A1 10/2018 Umezawa et al.
2018/0348672 A1 12/2018 Yoshida
2018/0348675 A1 12/2018 Nakamura et al.
2019/0016114 A1 1/2019 Sugiyama et al.
2019/0094727 A1 3/2019 Landa et al.
2019/0232638 A1 8/2019 Ziegenbalg et al.
2020/0073301 A1 3/2020 Sakai et al.
2020/0361715 A1 11/2020 Meier
2020/0376860 A1 12/2020 Paker et al.
2020/0376878 A1 12/2020 Landa et al.
2020/0384758 A1 12/2020 Shmaiser et al.
2021/0001622 A1 1/2021 Landa et al.
2021/0053341 A1 2/2021 Landa et al.
2021/0055666 A1 2/2021 Landa et al.
2021/0062021 A1 3/2021 Landa et al.
2021/0070083 A1 3/2021 Levanon et al.
2021/0095145 A1 4/2021 Landa et al.
2021/0146697 A1 5/2021 Landa et al.
2021/0182001 A1 6/2021 Levant
2021/0245528 A1 8/2021 Landa et al.
2021/0252876 A1 8/2021 Landa et al.
2021/0260869 A1 8/2021 Landa et al.
2021/0268793 A1 9/2021 Burkatovsky
2021/0283899 A1 9/2021 Landa et al.
2021/0309020 A1 10/2021 Siman Tov et al.
2022/0111633 A1 4/2022 Shmaiser et al.
2022/0153015 A1 5/2022 Landa et al.
2022/0153048 A1 5/2022 Landa et al.
2022/0176693 A1 6/2022 Landa et al.
2022/0188050 A1 6/2022 Boris
2022/0250376 A1 8/2022 Pomerantz et al.
2022/0274394 A1 9/2022 Chechik et al.
2022/0274411 A1 9/2022 Chechik et al.
2022/0288947 A1 9/2022 Landa et al.

FOREIGN PATENT DOCUMENTS

CN 1555422 A 12/2004
CN 1680506 A 10/2005
CN 1703326 A 11/2005

(56) References Cited

FOREIGN PATENT DOCUMENTS

| | | | | |
|---|---|---|---|---|
| CN | 1961015 | A | 5/2007 | |
| CN | 101096455 | A | 1/2008 | |
| CN | 101248146 | A | 8/2008 | |
| CN | 101433074 | A | 5/2009 | |
| CN | 101592896 | A | 12/2009 | |
| CN | 101820241 | A | 9/2010 | |
| CN | 102229294 | A | 11/2011 | |
| CN | 102300932 | A | 12/2011 | |
| CN | 102341249 | A | 2/2012 | |
| CN | 102529257 | A | 7/2012 | |
| CN | 102566343 | A | 7/2012 | |
| CN | 102648095 | A * | 8/2012 | ..... B41J 3/4073 |
| CN | 102673209 | A | 9/2012 | |
| CN | 103568483 | A | 2/2014 | |
| CN | 103627337 | A | 3/2014 | |
| CN | 104015415 | A | 9/2014 | |
| CN | 105844621 | A | 8/2016 | |
| CN | 107111267 | A | 8/2017 | |
| CN | 107879147 | A | 4/2018 | |
| DE | 102012011783 | A1 | 12/2013 | |
| EP | 0676300 | A2 | 10/1995 | |
| EP | 0953450 | A1 | 11/1999 | |
| EP | 1271263 | A1 | 1/2003 | |
| EP | 0923007 | B1 | 3/2004 | |
| EP | 3260486 | A1 | 12/2017 | |
| JP | 48043941 | | 12/1973 | |
| JP | S63274572 | A | 11/1988 | |
| JP | H05249870 | A | 9/1993 | |
| JP | H08272224 | A | 10/1996 | |
| JP | H09174646 | A | 7/1997 | |
| JP | H09300678 | A | 11/1997 | |
| JP | H10130597 | A | 5/1998 | |
| JP | H11138740 | A | 5/1999 | |
| JP | 2000094660 | A | 4/2000 | |
| JP | 2000141883 | A | 5/2000 | |
| JP | 2000190468 | A | 7/2000 | |
| JP | 2000337464 | A | 12/2000 | |
| JP | 2000343025 | A | 12/2000 | |
| JP | 2002049211 | A | 2/2002 | |
| JP | 2003076159 | A | 3/2003 | |
| JP | 2003094795 | A | 4/2003 | |
| JP | 2003107819 | A | 4/2003 | |
| JP | 2003227549 | A | 8/2003 | |
| JP | 2004011263 | A | 1/2004 | |
| JP | 2004117118 | A | 4/2004 | |
| JP | 2004167902 | A | 6/2004 | |
| JP | 2004340983 | A | 12/2004 | |
| JP | 2005224737 | A | 8/2005 | |
| JP | 3712547 | B2 | 11/2005 | |
| JP | 2006256087 | A | 9/2006 | |
| JP | 2007079159 | A | 3/2007 | |
| JP | 2008082820 | A | 4/2008 | |
| JP | 2008137146 | A | 6/2008 | |
| JP | 2009154377 | A | 7/2009 | |
| JP | 2009532240 | A | 9/2009 | |
| JP | 2009226805 | A | 10/2009 | |
| JP | 2009226890 | A | 10/2009 | |
| JP | 2009227909 | A | 10/2009 | |
| JP | 2009240925 | A | 10/2009 | |
| JP | 2009258587 | A | 11/2009 | |
| JP | 2009271422 | A | 11/2009 | |
| JP | 2009279808 | A | 12/2009 | |
| JP | 2010030300 | A | 2/2010 | |
| JP | 2010076214 | A | 4/2010 | |
| JP | 4562388 | B2 | 10/2010 | |
| JP | 2010240897 | A | 10/2010 | |
| JP | 2011031619 | A | 2/2011 | |
| JP | 2011064850 | A | 3/2011 | |
| JP | 2011168024 | A | 9/2011 | |
| JP | 2012081770 | A | 4/2012 | |
| JP | 2013104044 | A | 5/2013 | |
| JP | 2014008609 | A | 1/2014 | |
| JP | 2014073675 | A | 4/2014 | |
| JP | 2014131843 | A | 7/2014 | |
| JP | 2015202616 | A | 11/2015 | |
| JP | 2016074206 | A | 5/2016 | |
| JP | 2016093999 | A | 5/2016 | |
| JP | 2016179678 | A | 10/2016 | |
| JP | 2017093178 | A | 5/2017 | |
| JP | 2018017429 | A | 2/2018 | |
| JP | 2020014350 | A | 1/2020 | |
| WO | 2015026864 | A1 | 2/2015 | |
| WO | 2015036865 | A1 | 3/2015 | |
| WO | 2017208152 | A1 | 12/2017 | |
| WO | 2018100541 | A1 | 6/2018 | |
| WO | 2019012456 | A1 | 1/2019 | |
| WO | 2019111223 | A1 | 6/2019 | |
| WO | 2020003088 | A1 | 1/2020 | |
| WO | 2020136517 | A1 | 7/2020 | |
| WO | 2020141465 | A1 | 7/2020 | |
| WO | 2021105806 | A1 | 6/2021 | |
| WO | 2021137063 | A1 | 7/2021 | |

OTHER PUBLICATIONS

CN101248146A Machine Translation (EPO, PlatPat and Google) published on Aug. 20, 2008 Ricoh KK.

CN101592896A Machine Translation (by EPO and Google)—published Dec. 2, 2009; Canon KK.

CN101820241A Machine Translation (by EPO and Google)—published Sep. 1, 2010; Canon KK.

CN102341249A Machine Translation (EPO, PlatPat and Google) published on Feb. 1, 2012 Eastman Kodak Co.

CN102529257A Machine Translation (by EPO and Google)—published Jul. 4, 2012; Nippon Synthetic Chem Ind.

CN102673209A Machine Translation (by EPO and Google)—published Sep. 19, 2012; Wistron Corp.

CN104015415A Machine Translation (by EPO and Google)—published Sep. 3, 2014; Avery Dennison Corp.

CN1305895A Machine Translation (by EPO and Google)—published Aug. 1, 2001; Imaje SA [FR].

CN1543404A Machine Translation (by EPO and Google)—published Nov. 3, 2004; 3M Innovative Properties Co [US].

CN1703326A Machine Translation (by EPO and Google)—published Nov. 30, 2005; Nissha Printing [JP].

CN1961015A Machine Translation (EPO, PlatPat and Google) published on May 9, 2007 Dainippon Ink & Chemicals.

Co-pending U.S. Appl. No. 17/676,398, filed Mar. 21, 2022.

Co-pending U.S. Appl. No. 17/773,609, inventors Benzion; Landa et al., filed May 1, 2022.

Co-pending U.S. Appl. No. 17/788,335, inventors Benzion; Landa et al., filed Jun. 23, 2022.

Co-pending U.S. Appl. No. 17/842,860, filed Jun. 17, 2022.

JP2000141883A Machine Translation (EPO, PlatPat and Google) published on May 23, 2000 Ricoh KK.

JP2000190468A Machine Translation (EPO, PlatPat and Google) published on Jul. 11, 2000 Brother Ind Ltd.

JP2003076159A Machine Translation (by EPO and Google)—published Mar. 14, 2003, Ricoh KK.

JP2005224737A Machine Translation (by EPO and Google)—published Aug. 25, 2005; Mitsubishi Paper Mills Ltd.

JP2008082820A Machine Translation (by EPO and Google)—published Apr. 10, 2008; Ricoh KK.

JP2009154377A Machine Translation (by EPO and Google)—published Jul. 16, 2009; Fujifilm Corp.

JP2009227909A Machine Translation (EPO, PlatPat and Google) published on Oct. 8, 2009 Fujifilm Corp.

JP2009240925A Machine Translation (by EPO and Google)—published Oct. 22, 2009; Fujifilm Corp.

JP2009271422A Machine Translation (by EPO and Google)—published Nov. 19, 2009; Ricoh KK.

JP2009279808A Machine Translation (by EPO and Google)—published Dec. 3, 2009; Fuji Xerox Co Ltd.

JP2009532240A Machine Translation (by EPO and Google)—published Sep. 10, 2009; Aisapack Holding SA.

JP2011168024A Machine Translation (EPO, PlatPat and Google) published on Sep. 1, 2011 Ricoh Co Ltd.

(56) References Cited

OTHER PUBLICATIONS

JP2013104044A Machine Translation (by EPO and Google)—published May 30, 2013; Three M Innovative Properties.
JP2014008609A Machine Translation (EPO, PlatPat and Google) published on Jan. 20, 2014 Seiko Epson Corp.
JP2014073675A Machine Translation (EPO and Google) published on Apr. 24, 2014 Ricoh Co Ltd.
JP2015202616A Machine Translation (EPO, PlatPat and Google) published on Nov. 16, 2015 Canon Kk.
JP2016074206A Machine Translation (EPO and Google) published on May 12, 2016 Xerox Corp.
JP2016179678A Machine Translation (EPO, PlatPat and Google) published on Oct. 13, 2016 Xerox Corp.
JP2017093178A Machine Translation (EPO and Google) published on May 25, 2017 Samsung Electronics Co Ltd.
JP48043941 Machine Translation (by EPO and Google)—published Dec. 21, 1973.
JPH10130597A Machine Translation (by EPO and Google)—published May 19, 1998; Sekisui Chemical Co Ltd.
JPS63274572A Machine Translation (by EPO and Google)—published Nov. 11, 1988; Canon KK.
CN102229294A Machine Translation (by EPO and Google)—published Nov. 2, 2011; Guangzhou Changcheng Ceramics Co Ltd.
CN102300932A Machine Translation (by EPO and Google)—published Dec. 28, 2011; Yoshida Hiroaki et al.
CN103568483A Machine Translation (by EPO and Google)—published Feb. 12, 2014; Anhui Printing Mechanical & Electrical Co Ltd.
CN103627337A Machine Translation (by EPO and Google)—published Mar. 12, 2014; Suzhou Banlid New Material Co Ltd.
CN107111267A Machine Translation (by EPO and Google)—published Aug. 29, 2017; Hewlett Packard Indigo BV.
CN1555422A Machine Translation (by EPO and Google)—published Dec. 15, 2004; Noranda Inc.
CN1680506A Machine Translation (by EPO and Google)—published Oct. 12, 2005; Shinetsu Chemical Co [JP].
Co-pending U.S. Appl. No. 17/155,121, filed Jan. 22, 2021.
Co-pending U.S. Appl. No. 17/279,539, inventors Helena; Chechik et al., filed Mar. 24, 2021.
Co-pending U.S. Appl. No. 17/312,394, inventors Benzion; Landa et al., filed Jun. 10, 2021.
Co-pending U.S. Appl. No. 17/382,285, filed Jul. 21, 2021.
Co-pending U.S. Appl. No. 17/414,087, filed Jun. 15, 2021.
IP.com search (Year: 2021).
JP2000343025A Machine Translation (by EPO and Google)—published Dec. 12, 2000; Kyocera Corp.
JP2002049211A Machine Translation (by EPO and Google)—published Feb. 15, 2002; Pfu Ltd.
JP2003094795A Machine Translation (by EPO and Google)—published Apr. 3, 2003; Ricoh KK.
JP2004011263A Machine Translation (by EPO and Google)—published Jan. 15, 2004; Sumitomo Denko Steel Wire KK.
JP2004167902A Machine Translation (by EPO and Google)—published Jun. 17, 2004; Nippon New Chrome KK.
JP2004340983A Machine Translation (by EPO and Google)—published Dec. 2, 2004; Ricoh KK.
JP2007079159A Machine Translation (by EPO and Google)—published Mar. 29, 2007; Ricoh KK.
JP2008137146A Machine Translation (by EPO and Google)—published Jun. 19, 2008; CBG ACCIAI SRL.
JP2009226805A Machine Translation (by EPO and Google)—published Oct. 8, 2009; Fuji Xerox Co Ltd.
JP2009226890A Machine Translation (by EPO and Google)—published Oct. 8, 2009; Fuji Xerox Co Ltd.
JP2010030300A Machine Translation (by EPO and Google)—published Feb. 12, 2010; Xerox Corp.
JP2010240897A Machine Translation (by EPO and Google)—published Oct. 28, 2010; Toppan Printing Co .Td.
JP2011031619A Machine Translation (by EPO and Google)—published Feb. 17, 2011; Xerox Corp.
JP2011064850A Machine Translation (by EPO and Google)—published Mar. 31, 2011; Seiko Epson Corp.
JP2014131843A Machine Translation (by EPO and Google)—published Jul. 17, 2014; Ricoh Co Ltd.
JP2016093999A Machine Translation (by EPO and Google)—published May 26, 2016; Canon KK.
JP4562388B2 Machine Translation (by EPO and Google)—published Oct. 13, 2010; SK Kaken Co Ltd.
JPH09300678A Machine Translation (by EPO and Google)—published Nov. 25, 1997; Mitsubishi Electric Corp.
JPH11138740A Machine Translation (by EPO and Google)—published May 25, 1999; Nikka KK.
Larostat 264 A Quaternary Ammonium Compound, Technical Bulletin, BASF Corporation, Dec. 2002, p. 1.
Xiameter™ "OFS-0777 Siliconate Technical Data Sheet," Dec. 31, 2017, 5 pages. [Retrieved from the internet on Oct. 13, 2021]: https://www.dow.com/en-us/document-viewer.html?ramdomVar=6236427586842315077&docPath=/content/dam/dcc/documents/en-us/productdatasheet/95/95-4/95-435-01-xiameter-ofs-0777-siliconate.pdf.
CN101433074A Machine Translation (by EPO and Google)—published May 13, 2009; Kyocera Mita Corp [JP].
CN102566343A Machine Translation (by EPO and Google)—published Jul. 11, 2012; Canon KK.
CN105844621A Machine Translation (by EPO and Google)—published Aug. 10, 2016; Fuyang Feiyang Printing Co Ltd.
CN107879147A Machine Translation (by EPO and Google)—published Apr. 6, 2018; Brother Ind Ltd.
Co-pending U.S. Appl. No. 18/116,668, filed Mar. 2, 2023.
DE102012011783A1 Machine Translation (by EPO, PlatPat and Google)—published Dec. 19, 2013; Heidelberger Druckmasch AG.
IP.com search (Year: 2022).
JP2000094660A Machine Translation (by EPO and Google)—published Apr. 4, 2000; Brother Ind Ltd.
JP2000337464A Machine Translation (by EPO and Google)—published Dec. 5, 2000; Fuji Xerox Co Ltd.
JP2003107819A Machine Translation (by EPO and Google)—published Apr. 9, 2003; Kanegafuchi Chemical Ind.
JP2003227549A Machine Translation (by EPO, PlatPat and Google)—published Aug. 15, 2003; Xerox Corp.
JP2004117118A Machine Translation (by EPO and Google)—published Apr. 15, 2004; Nidec Copal Corp.
JP2006256087 Machine Translation (by EPO and Google)—published Sep. 28, 2006; Ricoh Printing Sys Ltd.
JP2009258587A Machine Translation (by EPO and Google)—published Nov. 5, 2009; Fuji Xerox Co Ltd.
JP2010076214A Machine Translation (EPO, PlatPat and Google) published on Apr. 8, 2010 Fuji Xerox Co Ltd.
JP2012081770A Machine Translation (EPO, PlatPat and Google) published on Apr. 26, 2012 Komori Printing Mach.
JP2018017429A Machine Translation (by EPO and Google)—published Feb. 1, 2018; Rinnai KK.
JP2020014350A Machine Translation (by EPO and Google)—published Jan. 23, 2020; Toshiba Mitsubishi Elec Ind.
JP3712547B2 Machine Translation (EPO, PlatPat and Google) published on Nov. 2, 2005 Sasaya Shunji.
JPH05249870A Machine Translation (by EPO, PlatPat and Google)—published Sep. 28, 1993; Matsushita Electric Ind Co Ltd.
JPH08272224A Machine Translation (by EPO, PlatPat and Google)—published Oct. 18, 1996; Ricoh KK.

* cited by examiner

INTERMEDIATE TRANSFER MEMBERS FOR USE WITH INDIRECT PRINTING SYSTEMS AND PROTONATABLE INTERMEDIATE TRANSFER MEMBERS FOR USE WITH INDIRECT PRINTING SYSTEMS

RELATED APPLICATIONS

The present application is a continuation of U.S. patent application Ser. No. 16/814,900 filed Mar. 10, 2020 which is incorporated herein by reference in its entirety. U.S. patent application Ser. No. 16/814,900 is a continuation of U.S. patent application Ser. No. 15/379,625, filed Dec. 15, 2016 which is incorporated herein by reference in its entirety. U.S. patent application Ser. No. 15/379,625 is a continuation in part of U.S. patent application Ser. No. 14/382,885 filed 5 Mar. 2013, which is the US national stage of PCT/IB2013/051743, filed Mar. 5, 2013, which claims priority from U.S. Provisional Patent Application Nos. 61/611,557 filed 15 Mar. 2012; 61/611,552 filed 15 Mar. 2012; 61/611,564 filed 15 Mar. 2012; 61/611,566 filed 15 Mar. 2012; 61/640,893 filed 1 May 2012; 61/607,537 filed 6 Mar. 2012; 61/641,258 filed 1 May 2012; 61/606,913 filed 5 Mar. 2012; 61/611,497 filed 15 Mar. 2012; and 61/635,180 filed 18 Apr. 2012, all of which are included by reference as if fully set forth herein. U.S. patent application Ser. No. 15/379,625 is also a continuation in part of U.S. patent application Ser. No. 14/382,917 filed 5 Mar. 2013, which is the US national stage of PCT/IB2013/051751, which claims priority from U.S. Provisional Patent Application Nos. 61/606,913 filed 5 Mar. 2012; 61/611,497 filed 15 Mar. 2012; 61/611,552 filed 15 Mar. 2012; 61/611,564 filed 15 Mar. 2012; 61/611,566 filed 15 Mar. 2012; 61/635,180 filed 18 Apr. 2012; 61/640,493 filed 30 Apr. 2012; 61/640,881 filed 1 May 2012; and 61/640,893 filed 1 May 2012, all which are included by reference as if fully set forth herein.

FIELD AND BACKGROUND OF THE INVENTION

A. Intermediate Transfer Members for use with Indirect Printing Systems

The invention, in some embodiments thereof, relates to the field of printing and to intermediate transfer members of printing systems. The invention, in some embodiments thereof, relates to the field of polymers and, to adhesives for such polymers, to curable polymer compositions and cured elastomers thereof, useful for the preparation of an intermediate transfer member of a printing system and of a release layer thereof.

In the art of indirect printing it is known, during a printing cycle when a specific image is printed on a specific substrate, to:

a. apply at (e.g., an image forming station) one or more inks, (each ink comprising a coloring agent in a liquid carrier) as a plurality of ink droplets to form an ink image on the image transfer surface of a release layer of an intermediate transfer member;
b. while the ink image is being transported by the intermediate transfer member, evaporate the carrier to leave an ink residue film including the coloring agents on the image transfer surface; and
c. transfer (e.g., at an impression station) the residue film from the image transfer surface to the substrate (e.g., paper, cardboard, cloth), thereby printing the desired image on the substrate.

Typically, the inks are in an oil-based (e.g., in liquid electrographic printing (LEP)) or water-based carrier. Such liquid inks may be applied to the image transfer surface of the intermediate transfer member of such printing systems by ink jetting of ink droplets, typically in a drop on demand mode.

For better printing results, an additional step to the previously described process may be needed. For instance, in LEP technology it is known to use an energy generated physical conditioning of the intermediate transfer member prior to the application of the ink. This physical conditioning causes the formation of electrophoretic attraction between charged coloring agent particles in the ink and the laser exposed image forms on the surface of a transfer surface, thereby fixing the coloring agent particles to the release layer.

Chemical conditioning methods are also known, which generally include the application of a chemical agent to the surface of the intermediate transfer member prior to the application of the inks. Such agents usually interact chemically with molecules of the inks and therefore typically need to be present in significant amount (e.g., thick coating, high concentration, prolonged presence during the process, etc.)

An intermediate transfer member is typically a laminated drum or looped blanket, also called a belt, the outermost layer of which, (i.e., the layer that defines the image transfer surface to which the inks are applied and from which the residue film is released to print the image on the substrate) is called the release layer.

Any given release layer has a specific set of physical and chemical properties to allow printing of a desired quality. Such release layer properties, the importance of which may vary from a printing process to another, include for example:

- an image transfer surface (to which the ink droplets are applied) having properties such as affinity and wettability to the inks so that applied ink droplets remain localized where applied without excess spreading or beading, and allowing the ink image to be neatly transferred to the substrate without leaving substantial residue on the image transfer surface;
- sufficiently adhesive to other layers of the intermediate transfer member;
- sufficiently compressible to conform to the surface of the substrate during transfer, while preventing any distortion of the residue film during transfer to the substrate;
- sufficiently resistant to the method used to fix the ink image, including for instance the heat applied to evaporate the ink carrier, or inert to the conditioning method, if needed; and
- sufficiently abrasion resistant and smooth to have a reasonably long life-time.

B. Protonatable Intermediate Transfer Members for Use with Indirect Printing Systems The invention, in some embodiments thereof, relates to the field of printing and, more particularly, to intermediate transfer members of printing systems. The invention, in some embodiments thereof, relates to the field of polymers and, more particularly, to novel elastomers.

In the art of indirect printing it is known, during a printing cycle when a specific image is printed on a specific substrate, to:

a. apply one or more inks, (each ink comprising a coloring agent in a liquid carrier) as a plurality of ink droplets to form an ink image on the image transfer surface of a release layer of an intermediate transfer member;
b. while the ink image is being transported by the intermediate transfer member, evaporate the carrier to leave an ink residue film including the coloring agents on the image transfer surfaces; and c. transfer the residue film from the image transfer surface to the substrate (e.g., paper, cardboard, cloth), thereby printing the desired image on the substrate.

Typically, the inks are applied by to the image transfer surface by ink jetting, typically at a printing or image forming station of a printing system, although other methods of applying ink may also be used.

Typically, the residue film is transferred from the image transfer surface to the substrate at an impression station of a printing system, by engaging the intermediate transfer member with an impression cylinder.

An intermediate transfer member is typically a laminated drum or looped blanket (also referred to as a belt) the outermost layer of which, (i.e., the layer that defines the image transfer surface to which the inks are applied and from which the residue film is released to print the image on the substrate) is called the release layer.

For various reasons, it is desirable to use ink compositions including a water-based rather than organic carrier. Known image transfer surfaces of known release layers are unsuitable for printing with such ink compositions.

SUMMARY OF THE INVENTION

A. Intermediate Transfer Members for Use with Indirect Printing Systems

The invention, in some embodiments thereof, relates to intermediate transfer members suitable for use with indirect printing systems having substantially greater lateral elasticity than longitudinal elasticity.

The invention, in some embodiments thereof, relates to curable polymer compositions and elastomers resulting from the curing of such compositions, which elastomers can be used to make a release layer suitable for printing inks including an aqueous liquid carrier.

The invention, in some embodiments thereof, relates to articles of manufacture, and particularly release layers for intermediate transfer members used in printing, made from such elastomers.

As is discussed in greater detail hereinbelow, belt-type intermediate transfer members formed from a continuous flexible blanket loop may stretch to a substantial extent during use, especially when exceptionally long and/or when operated at relatively high temperatures under tensile stress. When substantial such stretching occurs, an intermediate transfer member provides insufficient printing performance and must be replaced. Applicant hereby discloses an intermediate transfer member that, in some embodiments, suffers such stretching to a reduced extent.

According to an aspect of some embodiments of the invention, there is provided an intermediate transfer member for use with a printing system, comprising:

a longitudinal direction and a lateral direction;

a release layer having an image transfer surface; and the release layer attached to a body supporting the release layer wherein the body is configured so that the intermediate transfer member has a substantially greater elasticity in the lateral direction than in the longitudinal direction. In some embodiments, the intermediate transfer member is a blanket-type intermediate transfer member, e.g., a flexible blanket or a flexible continuous belt.

In some embodiments, the intermediate transfer member is substantially inelastic in the longitudinal direction.

In some embodiments, the intermediate transfer member, when maintained at a temperature of about 150° C., is configured to stretch in the longitudinal direction by not more than about 1.5% under normal operating conditions.

In some embodiments, the intermediate transfer member is substantially elastic in the lateral direction.

In some embodiments, the intermediate transfer member, when maintained at a temperature of about 150° C., is configured to elastically stretch in the lateral direction by not less than about 5%.

In some embodiments, when the intermediate transfer member is mounted for use in a suitable printing system, the longitudinal direction is the direction parallel to the motion vector of the intermediate transfer member between an image forming station and an image transfer station of the printing system.

In some embodiments, the ratio of the longitudinal dimension to the lateral dimension of the intermediate transfer member is at least about 1.1:1.

In some embodiments, the body includes a plurality of primary fibers oriented substantially parallel to the longitudinal direction. In some embodiments, the primary fibers are substantially inelastic.

In some embodiments, the primary fibers comprise a material selected from the group consisting of organic polymer fibers, meta-aramid, para-aramid, polyamide, nylon fibers, polyester fibers, natural fibers, cotton fibers, inorganic fibers, glass fibers, carbon fibers, ceramic fibers, metal fibers and combinations thereof. In some embodiments, the primary fibers consist of glass fibers.

In some embodiments, the body further comprising at least one supporting component.

In some embodiments, the supporting component comprises a non-fibrous elastomer.

In some embodiments, the elastomer comprising a material selected from the group consisting of silicone rubber, neoprene rubber, hydrogenated nitrile butadiene rubber (HNBR), nitrile butadiene rubber (NBR), alkyl acrylate copolymer (ACM), ethylene propylene diene monomer (EPDM) and combinations thereof.

In some embodiments, the primary fibers are impregnated with the elastomer.

In some embodiments, the primary fibers are embedded within the elastomer.

In some embodiments, the supporting component is substantially a distinct sheet of the elastomer. In some embodiments, the primary fibers are in direct physical contact with the sheet of the elastomer. In some embodiments, the primary fibers are associated with the sheet by at least one of stitching, bonding and stapling.

In some embodiments, the supporting component comprises secondary fibers, distinct from the primary fibers. In some embodiments, the secondary fibers have physical properties substantially different from the primary fibers.

In some embodiments, the secondary fibers are oriented substantially not-parallel to the primary fibers. In some embodiments, the secondary fibers are oriented to diverge by at least about 30° from parallel to the primary fibers. In some embodiments, the secondary fibers are oriented substantially parallel to the lateral direction.

In some embodiments, the secondary fibers are substantially elastic.

In some embodiments, the primary and secondary fibers are each independently selected from the group of fibers consisting of single monofilaments, aggregated monofilaments and threads.

In some embodiments, the secondary fibers comprise a material selected from the group consisting of: cotton, polyester, polyamide, elastane, and combinations thereof.

In some embodiments, the body comprises a single fiber ply in which substantially all fibers are located. In some embodiments, the thickness of the single fiber ply is from about 100 μm to about 600 μm.

In some embodiments, the body comprises at least two distinct fiber plies, each fiber ply including at least one of the primary fibers and the secondary fibers. In some embodiments, the thickness of each one of the at least two fiber plies is from about 100 μm to about 600 μm.

In some embodiments, at least some fibers of a first fiber ply are in direct physical contact with at least some fibers of an adjacent second fiber ply.

In some embodiments, a first fiber ply and an adjacent second fiber ply are physically separated by an intervening sublayer of material substantially devoid of fibers.

In some embodiments, at least one fiber ply is a woven fabric.

In some embodiments, at least one fiber ply is a non-woven fabric.

In some embodiments, a supporting component comprises primary and secondary fibers aggregated together to constitute a single ply of fabric. In some such embodiments, the fabric is a non-woven fabric. In some such embodiments, the primary fibers and the secondary fibers are aggregated together by weaving, thereby together constituting a woven fabric. In some such embodiments, the primary fibers constitute the warp and the secondary fibers constituted the weft of the woven fabric.

In some embodiments, at least some of the primary fibers are located in a distinct ply of primary fibers substantially devoid of the secondary fibers.

In some embodiments, at least some of the secondary fibers are located in a distinct ply of secondary fibers substantially devoid of the primary fibers.

In some embodiments, at least one distinct ply of secondary fibers comprising secondary fibers aggregated to constitute a fabric.

In some embodiments, at least one distinct ply of secondary fibers comprising secondary fibers aggregated to constitute a non-woven fabric.

In some embodiments, at least one distinct ply of secondary fibers comprising secondary fibers aggregated to constitute a woven fabric.

In some embodiments, at least one distinct ply of secondary fibers, wherein substantially all secondary fibers of the distinct ply are arranged substantially parallel one to the other.

In some embodiments, the body comprises in addition to the supporting component one or more layers selected from the group consisting of a conformational layer, a compressible layer, a thermally-insulating layer, a thermally-conductive layer, an electrically-conductive layer, a low-friction layer, a high-friction layer, and a connective layer.

In some embodiments, the body is substantially devoid of a compressible layer.

In some embodiments, the intermediate transfer member is a blanket-type intermediate transfer member and further comprises: lateral projections from sides thereof, the projections configured to engage guiding components of a suitable printing system.

In some embodiments, the intermediate transfer member is a blanket-type intermediate transfer member and further comprises: releasable fasteners at ends thereof, allowing the intermediate transfer member to be formed into a continuous flexible belt by engaging the fasteners at a first end with the fasteners at a second end of the blanket, the engaged fasteners forming a seam.

In some embodiments, the intermediate transfer member is a blanket-type intermediate transfer member (flexible blanket), the ends thereof being permanently secured to one another by any securing method selected from the group comprising soldering, welding, adhering, and taping, the securing method allowing the intermediate transfer member to be formed into a continuous flexible belt, the secured ends forming a seam.

In some embodiments, the intermediate transfer member is a continuous seamless flexible belt.

In some embodiments, the intermediate transfer member further comprises:

markings detectable by a detector of a suitable printing system, allowing registration of the relative positioning of the intermediate transfer member when mounted on such a suitable printing system.

In some embodiments, the intermediate transfer member further comprises a component allowing:

a) monitoring of data relating to the intermediate transfer member, the data entry selected from the group consisting of a catalogue number, a manufacturing date, a manufacturing batch number, a manufacturing plant identifier, a technical datasheet identifier, a regulatory datasheet identifier, and an online or remote support identifier; and/or b) recording data a suitable printing system relating to the use of the intermediate transfer member in operation, the recorded data relating to any of, the duration of use of the transfer member since installation, the number of sheets of substrate and the length of web printed using the intermediate transfer member.

As is discussed in greater detail hereinbelow, an important but difficult to achieve feature of release layers of intermediate transfer members is abrasion resistance. Applicant hereby discloses intermediate transfer members that in some embodiments are relatively abrasion resistant.

Thus, according to an aspect of some embodiments of the invention, there is provided an intermediate transfer member for use with a printing system, comprising:

a body having a first surface; and a release layer, having an image transfer surface, attached to the body through the first surface;

wherein the release layer is of a condensation-cured elastomer comprising a cross-linked silanol-terminated polymer and/or silane-terminated polymers;

wherein the elastomer includes at least 80% by weight of the silanol-terminated polymer and/or silane-terminated polymer selected from the group consisting of:

silanol or silane terminated polydialkylsiloxanes, silanol and/or silane terminated polyalkylarylsiloxanes, silanol and/or silane terminated polydiarylsiloxanes and combinations thereof; and wherein the elastomer is substantially devoid of at least one of carbon black and paraffin.

In some embodiments, the intermediate transfer member is configured as described herein, with any single or any combination of other intermediate transfer member features described herein.

As noted above, in some embodiments, an elastomer according to the teachings herein is devoid of carbon black. In some embodiments, the elastomer is substantially devoid of a particulate filler that is to say, comprises not more than 0.5%, preferably not more than 0.3% and more preferably not more than 0.1% by weight particulate filler of the silicone polymer. In some embodiments, the elastomer is substantially devoid of a carbon black, that is to say, comprises not more than 0.5%, preferably not more than 0.3% and more preferably not more than 0.1% by weight particulate filler of the silicone polymer.

Particulate fillers, especially carbon black (depending on the grade, having average particles sizes of between 10 to 200 nm) are added to elastomer compositions such as rubber to make an elastomer having improved tensile strength and resistance to abrasion, tear, fatigue and electrical-conductive properties (e.g., carbon particles). As reported herein, curable compositions devoid of particulate filler (such as carbon black) were used to form release layers (between about 5 and about 20 micrometers thick) and unexpectedly exhibited sufficient and even superior abrasion resistance and showed no signs of tearing and fatigue after many printing cycles.

In some embodiments, the elastomer is made of a curable polymer composition having as a raw ingredient prior to cross-linking: the silanol-terminated polymer, a cross-linker; a fast-curing heat activated condensation-cure catalyst and substantially devoid of at least one of carbon black and paraffin.

In some such embodiments, the curable polymer composition includes catalyst at between about 0.5% and about 2% by weight of the silanol-terminated polymer. In some such embodiments, the catalyst is a tin catalyst. In some such embodiments, the curable polymer composition includes tin catalyst at between about 0.5% and 2% by weight of the silanol-terminated polymer. As known to persons skilled in the art of polymer curing, fast curing typically results in uneven cross linking expected to form elastomers having poor mechanical properties and in particular low abrasion resistance. As reported herein, the inventors have found that surprisingly the use of a fast curing catalyst according to the teachings herein allowed the preparation of a release layer having good abrasion resistance.

In some such embodiments, the curable polymer composition includes cross-linker at between about 5% and about 26%, between about 7% and about 15% and even between about 8% and about 12% by weight of the silanol-terminated polymer. In some such embodiments, the cross-linker comprises a cross-linker selected from the group consisting of ethylsilicate (tetraethoxysilane, CAS Nr. 78-10-4), polyethylsilicate and combinations thereof. In some such embodiments, the cross-linker consists of, or even consists essentially of, a cross-linker selected from the group consisting of ethylsilicate, polyethylsilicate and combinations thereof, in some embodiments between about 5% and about 26%, between about 7% and about 15% and even between about 8% and about 12% by weight of the silanol-terminated polymer of the selected cross-linker or combination of cross-linkers.

As noted above, in some embodiments, an elastomer according to the teachings herein is devoid of paraffin. Herein are disclosed elastomers devoid of paraffin that exhibit sufficient and even superior abrasion resistance and showed no signs of tearing and fatigue after many printing cycles. A person having ordinary skill in the art expects an opposite effect: paraffins (e.g., paraffinic fluids such as synthetic isoparaffins) are expected to act as both a lubricant and as a shock-absorber, improving one or more of shock absorbance, toughness, and resistance to abrasion, tearing and fatigue of an elastomer comprising them. It would be expected that an elastomer devoid of paraffin would exhibit inferior abrasion resistance, the opposite of what was actually observed by the Applicant.

Accordingly, in some embodiments, the elastomer is substantially devoid of a non-volatile organic solvent, in some embodiments, paraffin. By "non-volatile" is meant an organic solvent that does not substantially evaporate at the operating temperatures of the intermediate transfer member.

In some embodiments, the curable polymer composition is devoid of a non-volatile organic solvent, in some embodiments, paraffin. By "non-volatile" is meant an organic solvent that does not substantially evaporate during curing of the polymer composition at the operating temperatures of the intermediate transfer member.

In some embodiments, the curable polymer composition consists essentially of, or even consists of, the silanol-terminated polymer, the cross-linker and the catalyst. In some embodiments, the curable polymer composition consists of the silanol-terminated polymer, the cross-linker and the catalyst.

In some embodiments, the curable polymer composition further comprises a curing inhibitor (e.g., carboxylic acid such as oleic acid), at between about 1% and about 5% by weight of the silanol-terminated polymer. In some embodiments, the curable polymer composition consists essentially of the polymer, the cross-linker, the catalyst and the curing inhibitor. In some embodiments, the curable polymer composition consists of the silanol-terminated polymer, the cross-linker, the catalyst and the curing inhibitor.

Applicant has also found that embodiments of the release layer as described above have a relatively high Isopar™ L bulk swelling capacity, typically above 145%, reflecting the ability of the release layer to absorb Isopar™ L, a fluid characterized as a synthetic isoparaffinic hydrocarbon solvent available from ExxonMobil Corporation (Irving, Tex., USA). To determine Isopar™ L bulk swelling capacity, a curable polymer composition as described above is fashioned into a film having a thickness between 1 mm and 3 mm A piece of the film is initially weighed to determine a dry weight of the film. The film is then immersed in Isopar™ L in a sealed container and maintained at 100° C. After 20 hours of immersion, the film is allowed to cool, removed from the Isopar™ L, and blotted with a clean dry cloth to remove excess Isopar™ L. The film this-swollen with Isopar™ L is weighed to determined a swollen weight of the film. The Isopar™ L bulk swelling capacity is defined by the following formula: (swollen weight−dry weight)/(dry weight)*100%. In contrast, in some embodiments of the release layers according to the teachings herein have a relatively low water bulk swelling capacity, typically not more than about 150%, or not more than about 140%, or not more than 130%, or not more than 120%, or not more than 110%, or not more than 105%.

According to an aspect of some embodiments of the invention, there is also provided a method of preparing a release layer of an intermediate transfer member for use with a printing system, comprising:

a) forming a layer of a curable polymer composition at a thickness of not more than about 200 micrometers (as an incipient release layer); and b) curing the layer of curable polymer composition, thereby preparing a release layer wherein the curable polymer composition includes:

at least 80% by weight of a silanol-terminated polymer and/or silane-terminated polymer selected from the group consisting of:

silanol and/or silane terminated polydialkylsiloxanes, silanol and/or silane terminated polyalkylarylsiloxanes, silanol and/or silane terminated polydiarylsiloxanes and combinations thereof a cross-linker;

a fast-curing heat activated condensation-cure catalyst; and substantially devoid of at least one of carbon black and paraffin.

According to an aspect of some embodiments of the invention, there is also provided a a release layer as described herein, prepared according to the above method.

As discussed in greater detail hereinbelow, a challenge in the art is adhering elastomers including silanol-terminated silicones to at least partially cured, and especially completely cured, rubbers. Some adhesives that may be suitable have been described in the art, see for example, U.S. Pat. Nos. 3,697,551; 4,401,500; US 2002/0197481; and US 2008/0138546 and PCT Patent Publications WO 2002/094912 and WO 2010/042784. That said, Applicant has found an adhesive including an organic peroxide that generates free radicals on thermal activation that in some embodiments has advantages compared to other adhesives.

Thus, according to an aspect of some embodiments of the invention, there is also provided a method for bonding an elastomer layer comprising at least one cross-linked silicone-related polymer to an at least partially cured rubber surface to form a laminated product comprising:

providing a body having a surface of at least partially cured rubber;

on the surface of at least partially cured rubber, applying a layer of a curable adhesive composition including:

an organosilane; and an organic peroxide that generates free radicals on thermal activation;

on the applied layer of adhesive composition, applying a layer of a fluid curable composition comprising at least one silicone-related polymer, to form an incipient laminated product; and curing the fluid curable composition and the curable adhesive composition thereby forming a laminated product.

In the context of the teachings herein, in some embodiments, the laminated product is an intermediate transfer member of a printing system; the elastomer layer constitutes a release layer of the intermediate transfer member; the rubber surface is a surface of a body of the intermediate transfer member; and the incipient laminated product is an incipient intermediate transfer member of a printing system. In some such embodiments, the laminated product is an intermediate transfer member according to the teachings herein; the elastomer layer constitutes a release layer of the intermediate transfer member according to the teachings herein; the rubber surface is a surface of a body of the intermediate transfer member; and the incipient laminated product is an incipient intermediate transfer member of a printing system.

In some embodiments, the organic peroxide comprises an organic peroxide selected from the group consisting of benzoyl peroxide and 2,4-dichlorobenzoyl acid.

In some embodiments, the organic peroxide is present in the curable adhesive composition in an amount of between 2% and about 20% by weight percent of organosilane, for example, in an amount of about 5% weight percent of the organosilane.

The organosilane is any suitable organosilane. In some embodiments, the organosilane is the organosilane described hereinbelow having the formula Si(-Q)(-OR1)(-OR2)(-OR3). In some embodiments, the organosilane comprises a single type of organosilane. In some embodiments, theorganosilane comprises a combination of at least two different types of organosilane.

In some embodiments, the organosilane comprises glycidoxypropyl trimethoxysilane and/or methacryloxypropyl trimethoxysilane.

In some embodiments, the organosilane comprises at least one aminosilane. In some embodiments, the at least one aminosilane is selected from the group consisting of 3-amino-propyltriethoxysilane and 3-aminopropyltrimethoxysilane or mixture thereof. In some embodiments, the at least one aminosilane comprises 3-aminopropyltriethoxysilane and 3-aminopropyltrimethoxysilane.

In some embodiments, the adhesive composition further comprises a condensation-cure catalyst. In some embodiments, the condensation cure catalyst is selected from the group consisting of an organo tin carboxylate and a titanate catalyst, especially a titanate catalyst. In some embodiments, the titanate catalyst comprises titanium diisopropoxy (bis-2,4-pentanedionate), titanium diisopropoxide bis(ethylacteoacetate), titanium di-n-butoxide (bis-2,4-pentanedionate), tetrabutyl titanate and tetraoctyl titanate. In some embodiments, the condensation cure catalyst is present in an amount of between about 1% and about 10% of weight organosilane.

In some embodiments, the adhesive composition further comprising a diluent, such as an organic solvent, for example, isopropanol, xylene and toluene, and combinations thereof. That said, in some embodiments, the adhesive composition is substantially devoid of a diluent.

In some embodiments, the at least partially cured rubber is a rubber which is stable at temperatures of greater than about 100° C.

In some embodiments, the rubber is selected from the group consisting of silicone rubbers (e.g., room temperature vulcanization RTV and RTV2, liquid silicone LSR, Vinyl Methyl Silicone (VMQ), Phenyl Silicone Rubber (PMQ, PVMQ), fluorosilicone rubber (FMQ, FMVQ)), alkyl acrylate copolymer rubbers (ACM), ethylene propylene diene monomer rubber (EPDM), fluoroelastomer polymers (FKM), nitrile butadiene rubber (NBR), ethylene acrylic elastomer (EAM), and hydrogenated nitrile butadiene rubber (HNBR).

In some embodiments, the curable adhesive composition is applied on the at least partially cured rubber surface as a layer of thickness in the range of from about 0.1 to about 10 micrometer.

In some embodiments, the fluid curable composition is applied on the layer of adhesive composition as a layer of thickness in the range of from about 1 to about 200 micrometer.

In some embodiments, the curing comprises application of heat to the layer of adhesive composition. In some embodiments, the application of heat comprises heating the layer of adhesive composition to a temperature of at least about 100° C.

In some embodiments, the curing of the curable adhesive composition is at least partially performed prior to applying the layer of fluid curable composition.

In some embodiments, the curing of the curable adhesive composition is performed subsequent to applying the layer of fluid curable composition.

According to an aspect of some embodiments of the present invention, there is also provided a curable adhesive composition comprising: an aminosilane (preferably as described herein); and an azido silane and/or an organic peroxide that generates free radicals on heating (e.g., benzoyl peroxide and/or 2,4-dichlorobenzoyl acid), so that the adhesive composition is a thermally-curable adhesive composition. In some preferred embodiments, the adhesive includes both the azidosilane and the organic peroxide. In some such embodiments, the azido silane comprises azidosulfonyl-hexyltriethyoxysilane. In some such embodiments, the aminosilane is selected from the group consisting of 3-aminopropyltriethoxysilane and 3-aminopropyltrimethoxysilane. In some such embodiments, the aminosilane is present at a concentration of about 95 weight percent of the curable adhesive composition.

According to an aspect of some embodiments of the present invention, there is also provided a curable adhesive composition comprising:

an organosilane (preferably as described herein, preferably an epoxysilane and/or methacryloxypropyltrimethoxysilane);

an organic peroxide that generates free radicals on heating (e.g., benzoyl peroxide and/or 2,4-dichlorobenzoyl acid); and a condensation-cure catalyst. In some embodiments, the condensation-cure catalyst comprises a titanate catalyst (e.g., as described above, especially titanium diisopropoxy (bis-2,4-pentanedionate)).

According to an aspect of some embodiments of the present invention, there is also provided a curable adhesive composition comprising: an organosilane (e.g., as described herein, especially an epoxysilane and/or methacryloxypropyltrimethoxysilane); an azidosilane (e.g., as described herein, especially azidosulfonylhexyltriethoxysilane); and a condensation-cure catalyst. In some embodiments, the condensation-cure catalyst comprises a titanate catalyst (e.g., as described herein, especially titanium diisopropoxy (bis-2,4-pentanedionate)). It has been found that such an adhesive is particularly effective in adhering materials to cured rubber surfaces (especially but not exclusively cured ACM rubber), including materials such as metals, fabrics and silicone elastomers.

In some embodiments, the organosilane comprises a combination of epoxysilane and methacryloxypropyltrimethoxysilane.

In some embodiments, the adhesive composition further comprises an aminosilane (e.g., as described herein). In some such embodiments, the amino silane functions as both a coupling agent and as a condensation cure catalyst.

In some embodiments, the adhesive composition consists essentially of, and even consists of, a combination of:

an epoxysilane;

a methacryloxypropyltrimethoxysilane;

azidosulfonylhexyltriethoxysilane; and titanium diisopropoxy (bis-2,4-pentanedionate.

According to an aspect of some embodiments of the invention, there is also provided a method for bonding an elastomer layer comprising at least one cross-linked silicone-related polymer to an at least partially cured rubber surface to form a laminated product comprising:

providing a body having a surface of at least partially cured rubber;

on the surface of at least partially cured rubber, applying a layer of a curable adhesive composition including an organosilane, an azidosilane and a condensation-cure catalyst as described above;

on the applied layer of adhesive composition, applying a layer of a fluid curable composition comprising at least one silicone-related polymer, to form an incipient laminated product; and curing the fluid curable composition and the curable adhesive composition thereby forming a laminated product. Other features and aspects of such a method are as described above, mutatis mutandi, using the adhesive including at least one organosilane and an organic peroxide that generates free radicals on thermal activation.

B. Protonatable Intermediate Transfer Members for use with Indirect Printing Systems The invention, in some embodiments thereof, relates to intermediate transfer members suitable for use with indirect printing systems having a release layer with an image transfer surface having protonatable functional groups apparent thereupon. Also disclosed are methods of making such intermediate transfer members. Also disclosed are novel elastomers, some useful for making intermediate transfer members.

According to an aspect of some embodiments of the invention, there is provided an intermediate transfer member for use with a printing system, comprising:

a release layer having an image transfer surface; and the release layer attached to a body supporting the release layer, wherein apparent on the image transfer surface are protonatable functional groups having a pKb of not more than about 6.

In some embodiments, the protonatable functional groups are bonded to the image transfer surface. In some embodiments, the protonatable functional groups are covalently bonded to the image transfer surface. In some embodiments, the protonatable functional groups are functional groups of components that make up the release layer, for example functional groups of polymers that are components of an elastomer that makes up the release layer.

In some embodiments, the intermediate transfer member is a blanket-type intermediate transfer member (flexible blanket or a continuous flexible belt) and further comprises: lateral projections from sides thereof, the projections configured to engage guiding components of a suitable printing system.

In some embodiments, the intermediate transfer member is a blanket-type intermediate transfer member and further comprises: releasable fasteners at ends thereof, allowing the intermediate transfer member to be formed into a continuous flexible belt by engaging the fasteners at a first end with the fasteners at a second end of the blanket, the engaged fasteners forming a seam.

In some embodiments, the intermediate transfer member is a blanket-type intermediate transfer member, being a flexible blanket, the ends thereof being permanently secured to one another by any securing method selected from the group comprising soldering, welding, adhering, and taping, the securing method allowing the intermediate transfer member to be formed into a continuous flexible belt, the secured ends forming a seam.

In some embodiments, the intermediate transfer member is a blanket-type intermediate transfer member, being a continuous seamless flexible belt.

In some embodiments, the intermediate transfer member is a blanket-type intermediate transfer member, further comprising: markings detectable by a detector of a suitable printing system, allowing registration of the relative positioning of the intermediate transfer member when mounted on such a suitable printing system.

In some embodiments, the intermediate transfer member is a blanket-type intermediate transfer member, further comprising a component allowing: a) monitoring of data relating to the intermediate transfer member, the data entry selected from the group consisting of a catalogue number, a manufacturing date, a manufacturing batch number, a manufacturing plant identifier, a technical datasheet identifier, a regulatory datasheet identifier, and an online or remote support identifier; and/or b) recording data a suitable printing system relating to the use of the intermediate transfer member in operation, the recorded data relating to any of, the duration of use of the transfer member since installation, the number of sheets of substrate and the length of web printed using the intermediate transfer member.

According to an aspect of some embodiments of the invention, there is provided a method of preparing a release layer of an intermediate transfer member for use with a printing system, comprising:

a) forming a layer of a curable polymer composition at a thickness of between about 0.1 μm and about 120 μm, as an incipient release layer; and b) curing the layer of curable polymer composition, thereby preparing a release layer of an intermediate transfer member, wherein the curable polymer composition includes:

at least one silicone polymer bearing protonatable functional groups having a pKb of not more than about 6.

According to an aspect of some embodiments of the invention, there is provided an elastomer made of a cross-linked curable polymer composition comprising, as a raw ingredient prior to crosslinking: at least one silicone polymer bearing protonatable functional groups having a pKb of not more than about 6.

Definitions

Unless otherwise defined, all technical and scientific terms used herein have the same meaning as commonly understood by one of ordinary skill in the art to which the invention pertains. In case of conflict, the specification, including definitions, will take precedence.

As used herein, the terms "comprising", "including", "having" and grammatical variants thereof are to be taken as specifying the stated features, integers, steps or components but do not preclude the addition of one or more additional features, integers, steps, components or groups thereof.

As used herein, the indefinite articles "a" and "an" mean "at least one" or "one or more" unless the context clearly dictates otherwise.

As used herein, when a numerical value is preceded by the term "about", the term "about" is intended to indicate +/−10%.

As used herein, curing refers to the increase in viscosity of a curable polymer composition by cross-linking of polymer chains. Although in some instances, curing is an inherent property of a suitable curable polymer composition that occurs spontaneously, in some instances curing is initiated or accelerated by the application of chemical additives, ultraviolet radiation, an electron beam or heat.

In some instances, for example in one or more of the priority documents, the terms "intermediate transfer components" or "image transfer member" or "transfer member" are used as a synonym for "intermediate transfer member".

In some instances, for example in one or more of the priority documents, the term "belt" is used as a synonym for a blanket intermediate transfer member.

In some instances, for example in one or more of the priority documents, the "body" component of an intermediate transfer member is termed "body portion".

Materials and chemicals were purchased from various manufacturers, that will be herein further referred to by abbreviation:

Gelest Gelest Inc, Morrisville, PA, USA
Colcoat Colcoat Company, Ltd., Tokyo, Japan
Momentive Momentive, Columbus OH, USA
Evonik Evonik Industries AG, Essen, Germany
Genesee Genesee Polymers Corporation, Burton, MI, USA
Ciba/BASF BASF Schweiz AG, Basel, Switzerland
Shin-Etsu Shin-Etsu Chemical Co. Ltd., Tokyo, Japan
Bluestar Bluestar Silicones, East Brunswick, NJ, USA
Trelleborg Trelleborg AB, Trelleborg, Sweden.
DuPont E. I. Du Pont de Nemours and Co, Wilmington, Delaware, USA.
TIB TIB Chemicals AG, Mannheim, Germany
Sigma-Aldrich Sigma-Aldrich Corporation, St. Louis MO, USA
ACROS Thermo Fisher Scientific Inc., Waltham, MA, USA
JT Baker Avantor Performance Materials, Center Valley, PA, USA
Hanse Chemie Evonik Industries AG, Essen, Germany
BYK BYK-Chemie GmbH, Wesel, Germany
Bayer Bayer MaterialScience AG, Leverkusen, Germany

BRIEF DESCRIPTION OF THE FIGURES

Some embodiments of the invention are described herein with reference to the accompanying figures. The description, together with the figures, makes apparent to a person having ordinary skill in the art how some embodiments of the invention may be practiced. The figures are for the purpose of illustrative discussion and no attempt is made to show structural details of an embodiment in more detail than is necessary for a fundamental understanding of the invention. For the sake of clarity, some objects depicted in the figures are not to scale.

In the Figures.

DESCRIPTION OF SOME EMBODIMENTS OF THE INVENTION

Figure 1A:
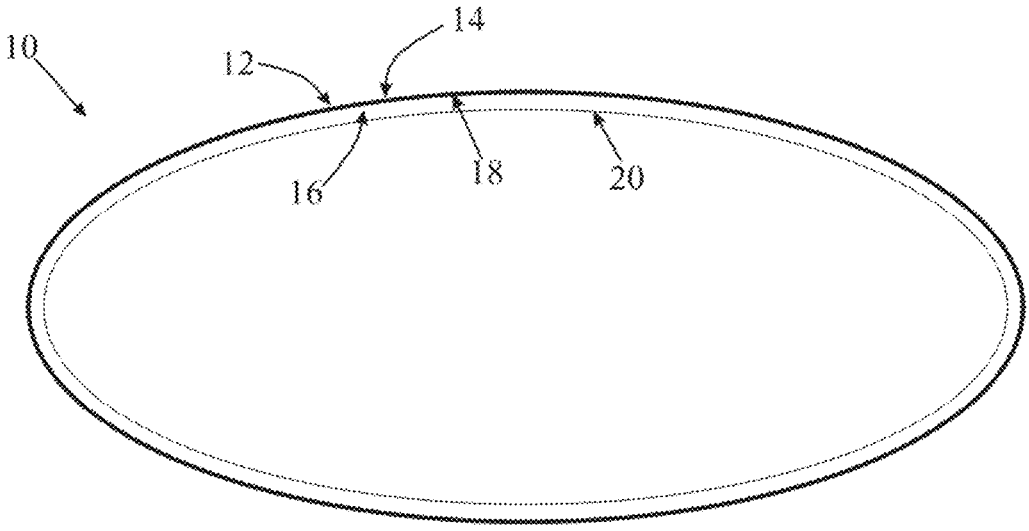
FIG. 1A is a schematic cross-sectional view of an embodiment of an intermediate transfer member, having a release layer directly attached to a surface of the body of the intermediate transfer member.

A. Intermediate Transfer Members for use with Indirect Printing Systems

The invention, in some embodiments thereof, relates to curable polymer compositions and elastomers resulting from the curing of such compositions, which elastomers can be used to make a release layer suitable for printing inks including an aqueous liquid carrier. The invention, in some embodiments thereof, relates to articles of manufacture, and particularly release layers for intermediate transfer members used in printing, made from such elastomers. The invention, in some embodiments thereof, relates to adhesives. The invention, in some embodiments thereof, relates to intermediate transfer members having anisotropic stretching properties.

The principles, uses and implementations of the teachings herein may be better understood with reference to the accompanying description and figures. Upon perusal of the description and figures present herein, one skilled in the art is able to implement the invention without undue effort or experimentation. In the figures, like reference numerals refer to like parts throughout.

Before explaining at least one embodiment in detail, it is to be understood that the invention is not necessarily limited in its application to the details of construction and the arrangement of the components and/or methods set forth herein. The invention is capable of other embodiments or of being practiced or carried out in various ways. The phraseology and terminology employed herein are for descriptive purpose and should not be regarded as limiting.

Additional objects, features and advantages of the invention will be set forth in the detailed description which follows, and in part will be readily apparent to those skilled in the art from the description or recognized by practicing the invention as described in the written description and claims hereof, as well as the appended drawings. Various features and sub-combinations of embodiments of the invention may be employed without reference to other features and sub-combinations.

It is to be understood that both the foregoing general description and the following detailed description, including the materials, methods and examples, are merely exemplary of the invention, and are intended to provide an overview or framework to understanding the nature and character of the invention as it is claimed, and are not intended to be necessarily limiting.

A number of problems are associated with release layers of known intermediate transfer members and the preparation thereof.

One such problem is the susceptibility of the release layer to abrasive wear, defined by the American Society for Testing and Materials as the loss of material due to hard particles or hard protuberances that are forced against and move along a solid surface. Abrasive wear can be measured as loss of mass by the Taber Abrasion Test. Alternatively, abrasion resistance of a surface can be measured by moving a test piece across the surface of an abrasive film mounted to a revolving drum and expressing the loss of gloss of the surface in percent, as described in further detail below. Low resistance to abrasive wear (also referred to herein as low abrasion resistance) reduces the useful lifetime of the intermediate transfer component.

An additional problem associated with known release layers is contamination of the image transfer surface of the release layer during manufacture of an intermediate transfer member. Typically, release layers are fashioned by application of a layer of a curable fluid polymer composition to an incipient intermediate transfer member, followed by curing that leads to solidification of the curable composition to form the release layer and adhesion to the intermediate transfer member. In the art, an image transfer surface of a release layer is often contaminated by dirt that settles on the surface of the curable polymer layer during the curing process, prior to complete curing. It is known that faster curing compositions having shorter curing times are less prone to such contamination. However, as fast curing is known to yield heterogeneous cross linking, such method is avoided when elastomers having good and uniform mechanical properties are sought. As reported herein, the inventors have found that surprisingly the use of a fast curing catalyst according to the teachings herein allowed the preparation of a release layer having good abrasion resistance.

Curable Compositions, Elastomers and Release Layers

Herein are disclosed, inter alia, curable polymer compositions and elastomers resulting from the curing of such compositions, which elastomers can be used to make a release layer of an intermediate transfer member suitable for printing inks including an aqueous liquid carrier. The invention, in some embodiments thereof, relates to articles of manufacture, and particularly release layers for intermediate transfer members used in printing, made from such elastomers.

Some embodiments of the curable polymer compositions are comparatively fast-curing and have relatively shorter curing time. In some such embodiments, image transfer surfaces of intermediate transfer member release layers fashioned from the corresponding elastomers apparently having lower-levels of contamination by dirt.

Some embodiments of the elastomers demonstrate superior abrasion resistance as well as other characteristics, rendering the elastomers useful for making intermediate transfer members of printing systems.

Curable Compositions

Thus according to an aspect of some embodiments of the teachings herein, there is provided a curable polymer composition, comprising at least one silicone-related polymer selected from the group consisting of:

- a silanol and/or silane functional polydialkylsiloxane,
- a silanol and/or silane functional polyalkylarylsiloxane,
- a silanol and/or silane functional polydiarylsiloxane and combinations thereof
- a cross-linker; and
- a fast-curing heat activated condensation-cure catalyst.

In some embodiments, at least one silanol-functional polymer is a silanol-terminated polymer. In some embodiments, at least one silane-functional polymer is a silane-terminated polymer.

The viscosity of the curable composition is any suitable viscosity, and is in part a function of the molecular weight of the component silicone-related polymer. In some embodiments, the curable composition has a viscosity of up to 20,000 cp, up to 30,000 cp, up to 40,000 cp, and even up to 50,000 cp. As noted above, in some preferred embodiments, a curable composition is devoid of isoparaffins (and even other non-volatile solvents) that are typically used to reduce viscosity when needed. In some embodiments, a curable composition includes one or more volatile solvents (that substantially evaporate away during curing or by heating to temperatures at which the elastomer is typically used) to adjust viscosity as needed. Typical such volatile solvents include xylene and toluene.

Silicone-Related Polymer

In some embodiments, the silicone-related polymer has a molecular weight of between about 13,000 and about 140,000 g/mole, in some embodiments between about 14,000 and about 50,000 g/mole, and in some embodiments even between about 16,000 and about 23,000 g/mole.

Silanol-Terminated Silicone-Related Polymers

In some embodiments, the at least one silicone-related polymer of the curable composition is a silanol-terminated polymer. In some embodiments, substantially all of the silicone-related polymers of the curable composition are silanol-terminated polymers.

In some embodiments, a silanol-terminated polymer is a polymer having at least one functional group —Si(Ra)(Rb)(OH), where Ra and Rb are independently selected from the group consisting of H and alkyl (e.g., methyl).

In some embodiments, the at least one silicone-related polymer of the curable composition is a silanol-terminated polydialkylsiloxane and/or silanol-terminated polyalkylarylsiloxane and/or silanol-terminated polydiarkylsiloxane. In some embodiments, substantially all of the silicone-related polymers of the curable composition are silanol-terminated polydialkylsiloxanes and/or silanol-terminated polyalkylarylsiloxane and/or silanol-terminated polydiarkylsiloxane.

In some embodiments, the silanol-terminated polydialkylsiloxane is of the formula:

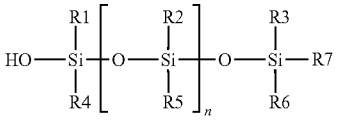

where R1 to R6 are each independently a $C_1$ to $C_6$ alkyl group (linear and/or branched), R7 is selected from the group consisting of OH, H or a $C_1$ to $C_6$ alkyl group (linear and/or branched); and, n is an integer from 50 to 1900. In some embodiments, n is an integer between 200 and 675. In some embodiments, R1 to R6 are all $CH_3$ and R7=OH, so that the silanol-terminated polydialkylsiloxane is a silanol-terminated polydimethylsiloxane. In some such embodiments the silanol-terminated polydimethylsiloxane has an average molecular weight of between about 13,000 and about 140,000 g/mole, between about 14,000 and about 50,000 g/mole, between about 13,000 and about 26,000 g/mole, between about 15,000 and about 26,000 g/mole and even of between about 16,000 and about 23,000 g/mole.

In some embodiments, the silanol-terminated polyalkylarylsiloxane is of the above formula, wherein: R1, R2 and R3 are each independently a $C_1$ to $C_6$ alkyl group (linear and/or branched), R4, R5 and R6 are each independently an aromatic group, R7 is selected from the group consisting of OH, H or a $C_1$ to $C_6$ alkyl group (linear and/or branched); and, n is an integer from 50 to 1900. In some embodiments, n is an integer between 200 and 675. In some embodiments, R1, R2 and R3 are all $CH_3$; R4, R5 and R6 are all $C_6H_6$; and R7=OH, so that the silanol-terminated polyalkylarylsiloxane are a silanol-terminated polymethylphenylsiloxane. In some such embodiments the silanol-terminated polymethylphenylsiloxane has an average molecular weight of between about 13,000 and about 140,000 g/mole, between about 14,000 and about 50,000 g/mole, between about 13,000 and about 26,000 g/mole, between about 15,000 and about 26,000 g/mole and even of between about 16,000 and about 23,000 g/mole.

In some embodiments, the silanol-terminated polydilarylsiloxane is of the above formula, where R1 to R6 are each independently an aromatic group, R7 is selected from the group consisting of OH, H or an aromatic group; and, n is an integer from 50 to 1900. In some embodiments, n is an integer between 200 and 675. In some embodiments, R1 to R6 are all $C_6H_6$, so that the silanol-terminated polydiarylsiloxane is a silanol-terminated polydiphenylsiloxane. In some such embodiments the silanol-terminated polydiphenylsiloxane has an average molecular weight of between about 13,000 and about 140,000 g/mole, between about 14,000 and about 50,000 g/mole, between about 13,000 and about 26,000 g/mole, between about 15,000 and about 26,000 g/mole and even of between about 16,000 and about 23,000 g/mole.

Silane-Terminated Silicone-Related Polymers

In some embodiments, the at least one silicone-related polymer of the curable composition is a silane-terminated polymer. In some embodiments, substantially all of the silicone-related polymers of the curable composition are silane-terminated polymers. In some embodiments, substantially all of the silicone-related polymers of the curable composition are either silane-terminated polymers or silanol-terminated polymers.

In some embodiments, a silane-terminated polymer is a polymer having at least one functional group —Si(Rd)(Re)(Rf), where at least one of Rd, Re and Rf is an O-alkyl group, the alkyl group preferably having not more than four carbon atoms, for example, at least one of Rd, Re and Rf is $OCH_3$, $OC_2H_5$, $OC_3H_7$ or $OC_4H_9$.

In some embodiments, the at least one silicone-related polymer of the curable composition is a silane-terminated polydialkylsiloxane. In some embodiments, substantially all of the silicone-related polymers of the curable composition are silane-terminated polydialkylsiloxanes. In some embodiments, the silane-terminated polydialkylsiloxane is substantially of the formula:

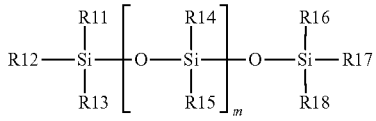

wherein:

R14 and R15 are each independently selected from the group consisting of $C_1$ to $C_6$ alkyl group (linear and/or branched) and an aromatic group;

R11, R12 and R13 are each independently selected from the group consisting of (O-alkyl) and (alkyl), the alkyl groups each independently a $C_1$ to $C_4$ alkyl group (linear and/or branched), with at least one of R11, R12, and R13 being (O-alkyl);

R16, R17 and R18 are each independently selected from the group consisting of (O-alkyl) and (alkyl), the alkyl groups each independently a $C_1$ to $C_4$ alkyl group (linear and/or branched), with at least one of R16, R17, and R18 being (O-alkyl); and m is an integer from 50 to 1900.

In some embodiments, m is an integer between 200 and 675.

In some embodiments one of R11, R12, and R13 is (O-alkyl). In some embodiments two of R11, R12, and R13 are (O-alkyl). In some embodiments all three of R11, R12, and R13 are (O-alkyl).

In some embodiments one of R16, R17, and R17 is (O-alkyl). In some embodiments two of R16, R17, and R18 are (O-alkyl). In some embodiments all three of R16, R17, and R18 are (O-alkyl).

In some such embodiments the silane-terminated polymer has an average molecular weight of between about 13,000 and about 140,000 g/mole, between about 14,000 and about 50,000 g/mole, between about 13,000 and about 26,000 g/mole, between about 15,000 and about 26,000 g/mole and even of between about 16,000 and about 23,000 g/mole.

In some embodiments, R14 and R15 are each independently a $C_1$ to $C_6$ alkyl group (linear and/or branched) so that the silane-terminated silicone-related polymer is a silane-terminated polydialkylsiloxane. In some such embodiments, R14 and R15 are all $CH_3$, so that the silane-terminated polydialkylsiloxane is a silane-terminated polydimethylsiloxane.

In some embodiments, R14 is a $C_1$ to $C_6$ alkyl group (linear and/or branched) and R15 is an aromatic group so that the silane-terminated silicone-related polymer is a silane-terminated polyalkylarylsiloxane. In some such embodiments, R14 is $CH_3$ and R15 is $C_6H_6$, so that the silane-terminated polyalkylarylsiloxane is a silane-terminated polymethylphenylsiloxane.

In some embodiments, R14 and R15 are each independently an aromatic group so that the silane-terminated silicone-related polymer is a silane-terminated polydiarylsiloxane. In some such embodiments, R14 and R15 are all $C_6H_6$, so that the silane-terminated polydiarylsiloxane is a silane-terminated polydiphenylsiloxane.

In some embodiments, the curable composition is a low to high viscosity RTV silicone polymer composition, wherein the at least one (and in some embodiments, substantially all) silicone-related polymer includes a silanol-terminated polydimethyl siloxane; the fast-curing catalyst comprising a condensation-cure catalyst; and the curable composition is substantially devoid of a filler such as carbon black. In some embodiments, the silanol-terminated polydimethyl siloxane has an average molecular weight of between about 3,000 and about 140,000 g/mole and a viscosity of between about 65 to about 150000 mPas.

In some embodiments, the curable composition is a low to high viscosity RTV silicone polymer composition, wherein the at least one (and in some embodiments, substantially all) silicone-related polymer is selected from the group consisting of: a silanol-terminated polydiphenylsiloxane; a silanol-terminated copolymer of dimethyl diphenyl siloxane; a silanol-terminated polymethylphenylsiloxane; a silanol-terminated copolymer of dimethyl methylphenyl siloxane; and combinations thereof.

In some embodiments, the curable composition is a low to high viscosity RTV silicone polymer composition, wherein the at least one (and in some embodiments, substantially all) silicone-related polymer is selected from the group consisting of a silanol-terminated polytrifluoropropyl methyl siloxane and a silanol-terminated copolymer of dimethyl trifluoropropyl methyl siloxane and combinations thereof.

Cross-Linker

Any suitable cross-linker may be used in implementing a curable polymer composition according to the teachings herein. The amount of cross-linker in the composition is any suitable amount. In some embodiments, the cross-linker is present in the composition at between about 3% and about 26%; between about 5% and about 17%; and even between about 6% and about 17% of the weight of the silicone-related polymer.

In some embodiments, the cross-linker comprises (and in some embodiments, substantially all the cross-linker is) a cross-linker selected from the group consisting of ethylsilicate (tetraethoxysilane, CAS Nr. 78-10-4), polyethylsilicate and combinations thereof, collectively called ethylsilicates. By "polyethylsilicate" is meant oligomers of ethylsilicate (TEOS monomer), having the formula $(C_2H_5O)_3Si[O—Si(OC_2H_5)2]_m—OC_2H_5$, where m is an integer between 3 and 15, preferably m is an integer between 3 and 12.

Suitable such crosslinkers that are commercially available include PSI021 and/or PSI023 (Gelest Inc, Morrisville, Pa., USA) and Ethylsilicate 48 (Colcoat Company, Ltd., Tokyo, Japan).

In some embodiments, the ethylsilicates are present in the curable composition at not less than about 3%, not less than about 5% and even not less than about 6% of the weight of the silicone-related polymer.

In some embodiments, the ethylsilicates are present in the curable composition at not more than about 26%, not more than about 17% and even not more than about 12% of the weight of the silicone-related polymer.

In some embodiments, the ethylsilicates are present in the composition at between about 3% and about 26%; between about 5% and about 26%; between about 6% and about 26%; between about 6% and about 17%; and even between about 9% and about 12% of the weight of the silicone-related polymer.

It has been found that the elastomer resulting from curing a curable polymer composition comprising such a cross-linker together with the above-described silicone-related polymers cures relatively quickly, reducing the amount of contamination entrapped in the elastomer, especially on the image transfer surface thereof. It has also been found that such an elastomer is particularly compatible with inks having an aqueous carrier.

Fast-Curing Catalyst

Any suitable fast-curing catalyst may be used in implementing a curable polymer composition according to the teachings herein, in any suitable amount.

As used herein the term "fast-curing catalyst" refers to a catalyst (in terms of type and amount) that when added to a curable polymer composition, results in sufficient curing within 2 minutes at 100° C. so that the composition is no longer tacky.

Condensation-Cure Catalyst

In some embodiments, the fast-curing catalyst is a condensation-cure catalyst. Any suitable amount of condensation-cure catalyst may be used. In some embodiments, the amount of condensation-cure catalyst is between about 0.1% and about 3%, between about 0.1% and about 2%, between about 0.1% and about 1.8%, between about 0.5% and about 1.8% and even between about 0.8% and about 1.2% of the weight of the silicone-related polymer.

In some embodiments, the condensation-cure catalyst is a tin catalyst. In some embodiments, the condensation-cure tin catalyst is selected from the group consisting of dibutyltin bis (acetylacetonate), dioctyl tin stannoxane, stannous octoate, and dioctyl tin bis (acetylacetonate), and combinations thereof. In a preferred embodiment, the tin catalyst is dioctyl tin bis (acetylacetonate).

In a preferred embodiment, the condensation-cure tin catalyst is dioctyl tin bis(acetylacetonate) present at 0.8 to 1.2% of weight of the silicone related polymer.

In a preferred embodiment, the polymerizable composition consists essentially of silanol-terminated polydimethylsiloxane, polyethylsilicate, and dioctyl tin bis (acetylacetonate).

Elastomer

According to an aspect of some embodiments of the teachings herein, there is provided an elastomer, resulting from curing of a curable polymer composition according to the teachings herein.

Intermediate Transfer Member Including Elastomer Release Layer

According to an aspect of some embodiments of the teachings herein, there is provided an intermediate transfer member for use with a printing system, comprising a release layer having an image transfer surface; and the release layer attached to a body supporting the release layer, wherein the release layer is of an elastomer according to the teachings herein.

The Inventors have experimentally demonstrated that elastomers resulting from the curing of a curable polymer composition according to the teachings herein where the silicone-related polymer is one of silyl-terminated polyethers, silyl-terminated polyacrylates, silane-terminated polyurethanes and silane-terminated polypropyleneglycols are unsuitable for use as a release layer for an intermediate transfer member. Specifically, such elastomers have been found to be one or more of: not thermally-stable under printing conditions, insufficiently abrasion resistant, insufficiently adherent to an intermediate transfer member body, or providing insufficient transfer of an ink image to a substrate.

In some embodiments, the release layer is attached to the body with an adhesive layer.

In some embodiments, the release layer is directly attached to the body, without an adhesive.

As discussed in greater detail hereinbelow, in some embodiments, the body includes at least one layer selected from the group consisting of a conformational layer, a compressible layer, a thermally-insulating layer, a thermally-conductive layer, an electrically-conductive layer, a low-friction layer, a high-friction layer, a reinforcement layer and a connective layer.

Intermediate Transfer Member Structure

As noted above, an intermediate transfer member is typically a laminated drum or blanket. A laminated drum may be a rigid drum upon which a blanket according to the teachings herein is mounted. By blanket is meant a flexible intermediate transfer member configured to be mounted on a support structure within a printing system to form a continuous loop or belt, so that the belt can travel around the support structure. In some embodiments, the ends of an elongated blanket strip can be secured to one another releasably or permanently to form the seam of a continuous belt. In some embodiments, the belt is seamless.

The outermost layer of an intermediate transfer member is the release layer to which outer surface, the image transfer surface, the ink droplets are applied, on which the ink residue film is formed and from which the residue film is transferred to the substrate to print a desired image on the substrate. As noted above, in some embodiments the release layer is formed from an elastomer according to the teachings herein.

The release layer is attached to and supported by the body (also called "body portion") of the intermediate transfer member. The body of the intermediate transfer member is a laminated structure including at least one, in some embodiments more than one, distinct layers. Typically, each of the layers of the body serves one or more purposes that allow a given intermediate transfer member to provide sufficient printing performance.

An elastomer according to the teachings herein may be used for making a release layer attached to any suitable body, including suitable bodies known in the art, to make an intermediate transfer member. That said, in some embodiments, it is preferred that an elastomer according to the teachings herein is used for making a release layer attached to a body according to the teachings herein to make an intermediate transfer member. Importantly, although in typical embodiments it is preferred that an elastomer according to the teachings herein is used for making a release layer attached to a body according to the teachings herein, in some embodiments other release layers made of other suitable materials are attached to a body according to the teachings herein to make an intermediate transfer member.

An intermediate transfer member is a laminated structure comprising a body having one or more layers and a surface (of the last one of the one or more layers) and a release layer attached to the surface, in some embodiments through an adhesive layer. In some embodiments, the body of the intermediate transfer member comprises one or more of a conformational layer, a compressible layer, a thermally-insulating layer, a thermally-conductive layer, an electrically-conductive layer, a low-friction layer, a high-friction layer, a reinforcement layer and a connective layer.

Thus according to an aspect of some embodiments of the teachings herein, there is provided an intermediate transfer member for use with a printing system, comprising: a release layer having an image transfer surface; the release layer attached to a body supporting the release layer. In preferred embodiments, the release layer is of an elastomer as described herein. Although aspects of the teachings herein are applicable to any intermediate transfer member, in preferred embodiments, the intermediate transfer member is a flexible blanket or continuous belt.

In some embodiments, the body comprises one or more layers selected from the group consisting of a conformational layer, a compressible layer, a thermally-insulating layer, a thermally-conductive layer, an electrically-conductive layer, a low-friction layer, a high-friction layer, a reinforcement layer and a connective layer.

Release Layer

As noted above, a release layer of an intermediate transfer member according to the teachings herein may be any suitable release layer attached to and supported by the body. In some embodiments, the release layer is directly bonded to, and thereby attached to, the body, see for example hereinbelow. In some embodiments, the release layer is bonded to, and thereby attached to, the body with an adhesive layer, see for example hereinbelow.

In preferred embodiments, the release layer is of an elastomer according to the teachings herein. That said, in some embodiments the release layer is any suitable release layer made of any suitable material, for example, as known in the art.

In some embodiments, the image transfer surface of the release layer is hydrophobic. In some such embodiments, the release layer is configured so that when droplets of aqueous ink are applied to the image transfer surface, each droplet spreads on impact covering an area of the image transfer surface dependent on the mass of the droplet. In some embodiments, the image transfer surface of the release layer is treatable to (at least temporarily) counteract the tendency of the spread-out ink droplets to subsequently contract and form a globule on the image transfer surface but without causing the droplet to spread by wetting the image transfer surface of the intermediate transfer member, and at the same time, the image transfer surface of the release layer is configured to transfer the residue film (formed by evaporation of the ink carrier) to a suitable substrate upon contact therewith. In some embodiments, the image transfer surface of the release layer is treatable to (at least temporarily) counteract the tendency of the applied aqueous ink droplets to contract by application of a chemical agent to the image transfer surface, for example polyethylenemine (PEI) or epoxylated PEI. Further details on chemical agents suitable to treat release layers according to the teachings herein are disclosed in the co-pending PCT application No. PCT/IB2013/000757 (Agent's reference LIP 12/001 PCT).

In some embodiments, wherein release layers of the art, which may be compatible either with oil-based or water-based inks, are attached to an embodiment of a body according to the teachings herein or using an adhesive layers according to the teachings herein to form intermediate transfer members, the image transfer surface of such release layers can be treated to counteract the tendency of the applied ink droplets to contract by application of a layer of electrical charge or by a corona discharge to the image transfer surface. In some embodiments, the image transfer surface of the release layer is treatable to counteract the tendency of the applied ink droplets to contract by heating of the image transfer surface.

Preferably, the material from which the release layer is made (e.g., an elastomer according to the teachings herein) renders the release layer non-absorbent to the ink compositions used. In some embodiments, the material from which the release layer is made is selected so that the intermediate transfer member does not substantially swell by the carrier liquid of the ink or of any other fluid that may be applied to the release layer during the intended use. In a preferred embodiment, an intermediate transfer member according to the teachings herein is to be used with an aqueous ink, and it is preferred that the release layer be substantially non-absorbent and does not substantially swell in contact with an aqueous ink composition. A release layer is said to be substantially non-absorbent or non-swelling if it gains 1.5% or less of its weight in a swelling experiment exposing the release layer to the ink carrier for 20 hours at 100° C.

In some embodiments, a material from which a release layer is made has a low thermal conductivity, for example in the range of between about 0.001 and about 10 W/(m K), or between about 0.01 and about 5 W/(m K) or between about 0.1 and about 2.5 W/(m K). Such low thermal conductivity allows the release layer to cool upon application of ink droplets, and to gradually heat, allowing evaporation of the (aqueous) ink carrier from the applied ink drop without substantial boiling or bubbling.

In some embodiments, the image transfer surface of a release layer is highly smooth, for example has a gloss of at least 85%, thereby improving image quality, inter alia, by reducing the variation in distance between the print head that applies the ink and the image transfer surface, allowing to decrease it so as to reduce the negative effect of droplets deflecting across larger gaps on image quality.

In some embodiments, the image transfer surface of the release layer has a high gloss value. Gloss of a release layer may be tested by a BYK Gardner Micro-Gloss® 4554 meter at an incident angle of 75°. In some embodiments, the gloss of the release layer is greater than 85%.

In some embodiments, a release layer has an average roughness Ra of less than 1 micrometer, according to American Standard ASME B46.1-2002, Surface Texture, and International Standards ISO 4287 and ISO 4288. In some embodiments, Ra roughness is less than 0.5 μm, or less than 0.2 μm, or less than 0.1 μm. In some embodiments, a release layer has a mean roughness depth Ra of less than 3 micrometer, or of less than 2 μm, or of less than 1 μm.

A release layer is of any suitable thickness. In some embodiments, a release layer has a thickness of no greater than about 200 micrometer, and in some embodiments no greater than about 100 μm. In some embodiments, the release layer has a thickness of between about 0.1 μm and about 100 μm and between about 1 and about 50 μm. In some embodiments, not less than about 1 μm and not more than about 30 μm. In some embodiments, between about 1 μm and about 30 μm, between about 1 μm and about 20 μm, between about 5 μm and about 20 μm, and even between about 5 μm and about 15 μm.

When attached to an intermediate transfer member body with the help of an adhesive, any suitable adhesive thickness is used. In some embodiments, an adhesive layer is between about 0.1 micrometer to about 10 μm thick, in some embodiments between about 1 μm to about 5 μm thick, more typically between about 1 μm and about 3 μm thick.

Conformational Layer

In some embodiments, a body of an intermediate transfer member according to the teachings herein comprises a conformational layer.

A conformational layer is configured to enable an image transfer surface of a release layer of an intermediate transfer member to conform and adapt to the topography of a substrate surface and increases the area of the intermediate transfer member that can be in close proximity to a substrate during impression (the transfer of the residue film to the substrate), thereby improving ink film residue transfer.

A conformational layer is made of any suitable (typically compliant) material or combination of materials, having mechanical properties suitable for the operability of the intermediate transfer member. In some embodiments, a conformational layer is of a material selected from the group consisting of silicone rubber, acrylic rubber (ACM), cured acrylic rubber, hydrogenated nitrile butadiene rubber (HNBR), or combinations thereof.

In some embodiments, a conformational layer has a hardness in the range of from 20 to 65 Shore A.

In some embodiments, a conformational layer comprises a soft layer, in some embodiments having a hardness in the range of from 20 to 40 Shore A. In some embodiments, the thickness of a soft conformational layer ranges from about 50 μm to about 1000 μm. In some preferred embodiments, the thickness of a soft conformational layer is about 150 μm.

In some embodiments, a conformational layer comprises a hard layer, in some embodiments having a hardness in the range of from 40 to 65 Shore A. In some embodiments, the thickness of a hard conformational layer ranges from about 5 μm to about 100 μm, from about 10 μm to about 50 μm, and even from about 5 μm to about 30 μm, In some embodiments, a conformational layer comprises more than one sublayer, each sub-layer optionally having a different hardness. In some such embodiments, a conformational layer comprises both a soft conformational sublayer (substantially as described above for a soft conformational layer) and a hard conformational sublayer (substantially as described above for a hard conformational layer).

In some embodiments, a conformational layer has a glossy surface finish.

In some embodiments, a conformational layer also functions as an electrically-conductive layer as described below. In some such embodiments, the conformational layer has a resistivity that ranges between about 5 Ω/cm and about 1000 Ω/cm, and in some embodiments a resistivity of about 500 Ω/cm.

Compressible Layer

In some embodiments, a body of an intermediate transfer member according to the teachings herein comprises a compressible layer. In alternative embodiments, the compressible layer can be the outer compressible surface of a pressure cylinder at an impression station of a printing system.

A compressible layer provides for at least part of the desired compressibility of an intermediate transfer member which improves transfer of an ink residue film from the image transfer surface of the release layer to the substrate. A compressible layer may improve the contact between the release layer and the substrate by adapting the image transfer surface of the release layer of the intermediate transfer member to inherent geometrical variations of the substrate.

In some embodiment, the compressibility of a compressible layer is at least 10% under a load of P=2 bars.

A compressible layer is made of any suitable compressible material or compressible combination of materials, having mechanical and optionally thermal properties suitable for the operability of the intermediate transfer member. In some embodiments, a compressible layer comprises (or even consists of) a material selected from the group consisting of room temperature vulcanization RTV and RTV2, liquid silicone LSR, Vinyl Methyl Silicone (VMQ), Phenyl Silicone Rubber (PMQ, PVMQ), fluorosilicone rubber (FMQ, FMVQ), alkyl acrylate copolymer (ACM), ethylene propylene diene monomer (EPDM) rubber, nitrile rubber, void-comprising hydrogenated nitrile butadiene rubber, S-cured and/or peroxide cured rubbers, open-cell rubbers, saturated open-cell rubbers, closed-cell rubbers and combinations thereof. In some embodiments, the rubber is a nitrile rubber having 40-60% (by volume) small voids. In some embodiment, the nitrile rubber is a void-comprising hydrogenated nitrile butadiene rubber (HNBR).

In some embodiments, a compressible layer comprises one or more sponge-like layers. In some embodiments, wherein a compressible layer comprises a single sponge-like layer, the thickness of the compressible layer ranges from about 50 μm to about 1250 μm, from about 100 μm to about 1000 μm, from about 200 μm to about 600 μm, and even from about 300 μm to about 400 μm. In some embodiments, a compressible layer has a thickness of not more than about 500 μm. In some embodiments, a compressible layer is a single sponge layer having a thickness of about 350 μm.

Thermally-Insulating Layer

In some embodiments, an intermediate transfer member is heated during use, inter alia, allowing quick evaporation of the carrier of an ink composition.

In some embodiments, an intermediate transfer member is heated from the outside, that is to say, there is a heat source facing the image transfer surface of the release layer.

In some such embodiments, it is advantageous that the body of the intermediate transfer member be configured for preventing the transfer of heat through the release layer to dissipate in the body. Thus, in some such embodiments, a body of an intermediate transfer member according to the teachings herein comprises a thermally-insulating layer. In some such embodiments, the thermally-insulating layer has a low thermal conductivity, functioning as a thermal insulator to prevent or reduce undesired heat dissipation through the bulk of the body.

A thermally-insulating layer is made of any suitable thermally-insulating material or thermally-insulating combination of materials.

In some embodiments, a thermally-insulating layer has a thickness of at least 100 micrometers.

Thermally-Conductive Layer

As noted above, in some embodiments, an intermediate transfer member is heated during use, inter alia, allowing quick evaporation of the carrier of an ink composition.

In some embodiments, an intermediate transfer member is heated from the inside or beneath, that is to say, there is a heat source facing the body of the intermediate transfer member, and the heat is transferred through the body, through the release layer to the image transfer surface.

In some such embodiments, it is advantageous that the body of the intermediate transfer member be configured for sufficient transfer of heat through the body to the release layer. In some embodiments, the thermally conductive layer serves as thermal reservoir allowing maintaining the desired operating temperature for the duration of a printing cycle even if heating is not constantly applied along the path of the belt.

Accordingly, in some embodiments, the body of an intermediate transfer member according to the teachings herein comprises a thermally-conductive layer. Typically, such a thermally-conductive layer is configured to facilitate the transfer of heat from the inside of the body towards the image transfer surface of the release layer.

A thermally-conductive layer is made of any suitable thermally-conductive material or thermally-conductive combination of materials. In some embodiments, a thermally-conductive layer has no or only a low amount of air voids. In some embodiments, a thermally-conductive layer comprises (and in some embodiments substantially consists of) low-void room temperature vulcanization RTV and RTV2, liquid silicone LSR, Vinyl Methyl Silicone (VMQ), Phenyl Silicone Rubber (PMQ, PVMQ), fluorosilicone rubber (FMQ, FMVQ) or hydrogenated nitrile butadiene rubber. In some embodiments, a thermally-conductive layer includes thermally-conductive fillers such as alumina, carbon black, and aluminium nitride, typically in particulate form in a continuous matrix, especially a polymer matrix.

In some embodiments, a thermally-conductive layer has a thickness of not less than 100 micrometers.

In some embodiments, a thermally-conductive layer comprises or essentially consists of low-void hydrogenated nitrile butadiene rubber.

Electrically-Conductive Layer

In some embodiments, the body of an intermediate transfer member according to the teachings herein comprises an electrically-conductive layer.

An electrically-conductive layer allows application of a voltage to an intermediate transfer member, allowing electrowetting of ink droplets applied to an image transfer surface of the release layer, and in some embodiments, also allowing other physical treatments.

An electrically-conductive layer is made of any suitable electrically-conductive material or electrically-conductive combination of materials. In some embodiments, an electrically-conductive layer is or comprises a conductive polymer. In some embodiments, an electrically-conductive layer comprises materials such as carbon black, metal salts or conductive plasticizers, typically in a continuous matrix, especially a polymer matrix, such as silicone rubber. In some embodiments, an electrically-conductive layer comprises or even consists of nitrocellulose loaded with carbon black.

In some embodiments, the thickness of an electrically-conductive layer ranges between about 10 μm and about 300 μm. In some such embodiments, the thickness of an electrically-conductive layer is about 100 μm.

In some embodiments, the resistivity of an electrically-conductive layer ranges between about 5 Ω/cm and about 1000 Ω/cm. In some embodiments, the resistivity of an electrically conductive layer is about 500 Ω/cm.

Low Friction Layer

In some embodiments, the body of an intermediate transfer member according to the teachings herein comprises a low-friction layer, typically as an innermost layer (furthest from the release layer) of a blanket-type intermediate transfer member. In some embodiments, the low-friction layer has a coefficient of friction of less than 3.

Such intermediate transfer members having a low-friction layer as an innermost layer are exceptionally useful for use with printing systems where the intermediate transfer member is mounted on a supporting structure that includes both rolling supports (rollers) and static supports (e.g., plates, pins) across which the intermediate transfer member slides. A low-friction layer reduces drag and unwanted frictional heating during printing, and helps reduce wear on the printing device support structure and on the intermediate transfer member. Accordingly, in typical embodiments a low-friction layer also comprises an abrasion-resistant surface for contacting a printing system support structure.

In some embodiments, a low-friction layer is configured to allow heat conduction through the body of the intermediate transfer member, especially for use with printing systems where the intermediate transfer member is heated from the inside. In some such embodiments, the low-friction layer is configured to be sufficiently heat-resistant, allowing intermediate transfer member operating temperatures of up to about 250° C.

A low-friction layer is made of any suitable material or combination of materials, in some embodiments polymers, such as thermoplastic, thermoset and elastomer polymers, including rubbers. In some embodiments, a low-friction layer comprises (or even substantially consists of) a material selected from the group consisting of silicone, polytetrafluoroethylene (e.g., Teflon®), fluorinated rubber (FKM), polyethylene terephthalate (PET), hydrogenated nitrile butadiene rubber (HNBR) and combinations thereof. In some embodiments, a suitable polymer is supplemented with additives providing a low coefficient of friction.

In some embodiments wherein the low-friction layer comprises FKM and/or HNBR, a thin layer (e.g., about 4 microns) of a hard rubber (i.e., hardness 70-80 Shore A), is applied to the image transfer surface of the low-friction layer to provide the required texture. In some embodiments, the low-friction layer has a roughness of between about 4 and about 500 microns. In some embodiments, a suitable roughness is achieved, for example, by buffing or by use of a textured mold before curing of the material making up the low-friction layer, or by inclusion in the material making up the low-friction layer with a filler such as silica or calcium carbonate, having sufficiently large particle size such that particles of the filler are apparent through the surface of the low-friction layer. In some embodiments, the thickness of a low-friction layer is in the range of from about 1 μm to about 250 micrometer. In some embodiment, the thickness of a low-friction layer is not more than about 100 μm, not more than about 50 μm and even not more than about 10 μm. In some typical embodiments, the thickness is between about 3 and about 10 μm, e.g., about 4 to about 5 μm.

High Friction Layer

In some embodiments, the body of an intermediate transfer member according to the teachings herein comprises a high-friction layer, typically as an innermost layer (furthest from the release layer) of a blanket-type intermediate transfer member. In some embodiments, the high-friction layer has a coefficient of friction of greater than 3.

Such intermediate transfer members are exceptionally useful for use with printing systems where the intermediate transfer member is mounted substantially exclusively on rolling supports (rollers) and does not substantially slide past any supports (e.g., static pins). Such a high-friction layer facilitates non-slip contact of the intermediate transfer member over the support structure (rollers) of the printing system, ensuring that the rollers have sufficient friction to accurately move the intermediate transfer member.

In some embodiments, a high-friction layer is configured to allow heat conduction through the body of the intermediate transfer member, especially for use with printing systems where the intermediate transfer member is heated from the inside. In some such embodiments, the high-friction layer is configured to be sufficiently heat-resistant, allowing intermediate transfer member operating temperatures of up to about 250° C.

A high-friction layer is made of any suitable material or combination of materials, in some embodiments polymers, such as silicone rubbers. Typically, such materials, such as silicone rubbers are relatively soft, allowing high-friction with sufficient mechanical strength and abrasion resistance.

In some embodiments, the thickness of a high-friction layer is in the range of from about 25 μm to about 100 μm and even from about 25 μm to about 50 μm.

Reinforcement Layer

In some embodiments, the body of an intermediate transfer member according to the teachings herein comprises a reinforcement layer, configured to provide the intermediate transfer member with mechanical strength. Any suitable reinforcement layer may be used in implementing the teachings herein. That said, in some embodiments it is preferred to use a reinforcement layer according to the teachings herein.

Properties of Reinforcement Layer

In some embodiments, the tensile and tear properties of a reinforcement layer are as follows: tensile strength>10 kg/cm in the longitudinal (printing) direction and tear strength>30 kg/cm in the longitudinal direction.

Low Crimp Fabric

As discussed herein, in some embodiments, a blanket-type intermediate transfer member as described herein includes a fabric layer, typically as part of a reinforcement layer. A fabric allows stretching according to two modes.

The first mode is crimp stretching. As used herein, crimp refers to the extent (in percent of initial length) that a woven fabric used in reinforcing a blanket-type intermediate transfer member can be elongated in a direction as a result of the properties of the weave properties applying substantial stretching forces to the constituent fibers. When a intermediate transfer member is stretched in a direction (e.g., longitudinally or laterally), initially resistance to stretching is only from the other components, and the fabric component only crimps.

The second mode is elastic stretching of the constituent fibers of the fabric

In some embodiments, a fabric used as a reinforcement component of an intermediate transfer member has low crimp of from about 0.1% to about 1.5% in the longitudinal (printing) direction as measured with a tensile meter recording elongation over time under a constant load. Preferably, the low crimp properties of a reinforcement layer are maintained at the printing operating conditions, especially temperature and tension.

Low Creep

Creep is a material property (e.g., of fabrics fibers and elastomers) and refers to permanent elongation that occurs when a material is stretched within the elastic limit for a sustained period of time. For most, if not all, materials, creep over a given period of time increases with higher applied tension and temperature.

As used herein, creep is a measure of the permanent elongation of an intermediate transfer member compared to its starting dimension over a certain time period. Creep typically depends upon operating conditions (e.g., the tension to which the intermediate transfer member is subjected during operation, the operating temperatures, etc.).

In some embodiments, an intermediate transfer member is configured to have low creep under operating tension at the operating temperatures.

Preferably, a reinforcement layer (and consequently the intermediate transfer member) is such that the creep of the intermediate transfer member is less than about 1.5%, less than about 1% less than about 0.5% and more preferably less than about 0.1% in the longitudinal (printing) direction during a period of at least about 1 day, and more preferably at least about 3 days of continuous use at a typical operating temperature of 150-200° C. In a preferred embodiment, there is substantially no creep (~0%) of the intermediate transfer member in the longitudinal direction during the lifetime (typically not less than about 1 day, not less than about 3 days) of the intermediate transfer member at an operating temperature of 150-200° C.

Fibers

In some embodiments, a reinforcement layer comprises a plurality of fibers. In some embodiments, at least some of the fibers are predominantly unidirectional fibers. In some embodiments, the unidirectional fibers are oriented substantially parallel to the longitudinal (printing) direction. In some embodiments, the unidirectional fibers are oriented substantially parallel to the lateral direction, that is to say, substantially perpendicular to the longitudinal direction.

Fabric Layers

In some embodiments, the reinforcement layer comprises at least one layer of fabric fashioned from a plurality of fibers, that is to say at least some of the plurality of fibers constitute a layer of fabric. In some embodiments, at least one layer of fabric comprises one or more fabric ply.

In some embodiments, where a reinforcement layer is of a single fabric layer, the thickness of the reinforcement layer ranges from about 100 μm to about 600 μm, from about 100 μm to about 200 μm, from about 400 μm to about 600 μm, from about 200 μm to about 500 μm, and even from about 450 μm to about 550 μm. In some embodiments, a reinforcement layer with a single fabric layer has a thickness of about 350 μm.

In some embodiments, where a reinforcement layer comprises two distinct fabric layers, the thickness of each fabric layers ranges from about 100 μm to about 600 μm, from about 100 μm to about 200 μm, from about 400 μm to about 600 μm, from about 200 μm to about 500 μm, from about 450 μm to about 550 μm, and even from about 100 μm to about 400 μm.

In some embodiments, a reinforcement layer comprises two fabric layers each having a thickness of between about 50 micrometer and about 350 μm. In some embodiments, a reinforcement layer comprises two fabric layers each having a thickness of about 300 μm. In some embodiments, a reinforcement layer comprises two fabric layers, one having a thickness of about 200 μm and the other having a thickness of about 350 μm.

Fiber Types

Each layer of fabric is fashioned from any suitable fiber, twisted or non-twisted. The fibers may be in any suitable form including monofilaments, grouped filaments and yarns. In embodiments including a yarn, the yarn may be of a single type of fiber, or a blend of two or more different types of fibers. In some embodiments, at least some of the fibers (and in some embodiments, substantially all of the fibers) making up a given layer of fabric are selected from the group consisting of meta-aramide polymers (e.g., Nomex® fibers), para-aramide polymers (e.g., Kevlar® fibers), ceramic-based fibers, nylon-based fibers, twisted nylon based fibers, cotton-based fibers, twisted cotton-based fibers, polyester-based fibers, twisted polyester-based fibers, glass-based fibers, carbon-fiber (graphite) based fibers, and metal-based fibers, or a combination thereof. In some embodiments, all of the layers of fabric are of the same fiber or combination of fibers. In some embodiments, at least one layer of fabric is of substantially different fiber composition.

Types of Fabric

In some embodiments, at least one fabric layer of the reinforcement layer is a non-woven fabric.

In some embodiments, at least one fabric layer of the reinforcement layer is a woven fabric. In woven fabrics, there are two distinct sets of fibers interlaced at right angles. The longitudinally-oriented fibers are called the warp while the laterally-oriented fibers are called the weft (the filling). Any suitable weave may be used in implementing such embodiments, for example, in some embodiments, a woven fabric layer has a weave selected from the group consisting of plain weave, twill weave, basket weave, satin weave, leno weave and mock leno weave.

In one embodiment, the longitudinally oriented fibers are selected from the group of high performance fibers comprising aramide polymers, carbon-based fibers, ceramic-based fibers, glass-based fibers, and combinations thereof.

In some embodiments, the fibers of a reinforcement layer are fully or partially embedded in (or impregnated with) a solid (non fibrous) elastomer matrix as known in the art of fabrics. A fully-impregnated fabric is a fabric in which the interstices between the filaments/yarns are completely filled with the matrix. In some embodiments, such impregnation improves thermal conductivity and/or enables a better distribution of the mechanical stress between the reinforcement layer and adjacent layers and/or improves mechanical properties of the reinforcement layer, such as reducing crimp. Preferably, the elastomer matrix is compatible with (can be bonded to) adjacent layers of the intermediate transfer member. In some embodiments, the elastomer matrix is a thermally-conductive elastomer, for example an elastomer prepared by extrusion such that polymeric chains of the elastomer are oriented in the direction of extrusion. Any suitable elastomer may be used. In some embodiments, a suitable elastomer is selected from the group consisting of silicone rubber (e.g., VMQ, PMQ, FMQ, PVMQ), neoprene rubber, hydrogenated nitrile butadiene rubber (HNBR), nitrile butadiene rubber (NBR), alkyl acrylate copolymer (ACM), or ethylene propylene diene monomer (EPDM), or combinations thereof.

Anisotropic

As noted above, any suitable reinforcement layer may be used in implementing the teachings herein, and preferably, a reinforcement layer according to the teachings herein.

That said, in some embodiments, especially when the intermediate transfer member is a blanket, it is preferable to use an anisotropic reinforcement layer according to the teachings herein as discussed hereinbelow. As used herein, the term "anisotropic" means having different physical or mechanical properties when measured along different axes.

As used herein, the term "printing direction" means a direction from the image forming station where printing heads apply ink to the release layer towards the location of the impression station, where the ink image is transferred to the printing substrate.

In the art, blanket-type intermediate transfer members are preferably substantially elastic in the longitudinal direction. When such an intermediate transfer member is mounted on a printing system, elements of the supporting structure (e.g., rollers and pins) are moved parallel to the printing direction as known in the art of belt-driven wheels so that the intermediate transfer member is stretched and held taut. Since the intermediate transfer member is held taut, the image transfer surface is flat and smooth, providing superior transfer of ink residue to the desired substrate. Further, the longitudinal elasticity and tension allow such an intermediate transfer to conform to, and thereby compensate for, minor imperfections and misalignments of the printing system supporting structure and substrate. In order to avoid lateral narrowing as a result of longitudinal tension, known blanket-type intermediate transfer members are preferably inelastic and stretch-resistant in the lateral direction.

In the art, it is known to provide a blanket-type intermediate transfer member that includes a reinforcement layer having a woven fabric element. Woven fabrics inherently possess give (in all directions) so a suitable woven fabric element of an intermediate-transfer member does not compromise the required longitudinal elasticity. At the same time, a fabric element renders a reinforcement layer tear resistant without compromising flexibility.

A challenge to known reinforcement layer design relates to exceptionally-long (longitudinal direction) intermediate transfer members. For example, the Applicant has contemplated a printing system requiring belts at least about 5 meters, about 6 meters, about 7 meters and even at least about 9 meters long. In one case, the Applicant has considered a printing system requiring a 10 meter long belt. Due to the great length, components of the printing system for stretching and maintaining the required intermediate transfer member tension must have an unusually large range of motion. Further, it has been found that due to the great length, typical fabrics used in a reinforcement layer provide insufficient tear-resistance in the longitudinal direction.

An additional challenge, when taken alone but also compounded by exceptionally-long intermediate transfer members, relates to high-temperature operation. Specifically, the Applicant has contemplated a printing system where a belt-type intermediate transfer member is routinely maintained at temperatures greater than 70° C., greater than 90° C., greater than 110° C., greater than 130° C. and even greater than 140° C., and locally exposed to temperatures greater than 180° C. and even greater than 190° C. Such temperatures have been found useful when printing with aqueous-based inks, to allow sufficient evaporation of the aqueous carrier before transfer of an ink residue to a substrate. As is known in the field of material science, the yield strength of a material is typically reduced with increasing temperature. A material that is maintained at relatively high temperatures (even well below the softening temperature) under tension (even when well within the elastic limit) eventually undergoes inelastic deformation and loss of elasticity, a creep process as discussed above. As a result, it has been found that known blanket-type intermediate transfer members with known reinforcement layers including a fabric, quickly lose longitudinal elasticity and are inelastically stretched in the longitudinal direction, losing tension, becoming slack, and providing inferior printing results.

Applicant has found that in some instances one or both challenges can be at least partially ameliorated by rendering a flexible intermediate transfer member substantially inelastic in the longitudinal direction. Specifically, such an intermediate transfer member does not substantially stretch in the longitudinal direction when mounted in and during use in a suitable printing system. At the same time, to ensure that the image transfer surface is flat and smooth during use, as well as allow conforming to and compensation for minor imperfections and misalignments of the printing system supporting structure and substrate, such an intermediate transfer member is substantially elastic in the lateral direction. Preferably, such an intermediate transfer member is stretched taut in the lateral direction during use, e.g., is used with a printing system configured to stretch the intermediate transfer member in the lateral direction (perpendicular to the printing direction, also known as transverse direction). Operating tensions applied are preferably sufficient to hold the intermediate transfer member sufficiently taut to provide the desired flatness. Operating tensions applied can flatten the blanket so as to facilitate the transfer of at least 95% of the ink residue film from the image transfer surface of the release layer to the substrate. Preferably, the intermediate transfer member may sustain operating tensions enabling the transfer of at least 99%, and preferably 100%, of an ink residue film.

Thus, in some embodiments of the intermediate transfer member described above, the reinforcement layer is anisotropic, having a different elasticity in the longitudinal and lateral directions, that in some embodiments solves the problem of insufficient elasticity in the lateral direction, thereby improving the flatness of the blanket under applied tension during printing. In some embodiments, the anisotropic reinforcement layer has a greater elasticity in the lateral direction than in the longitudinal direction.

Thus, according to an aspect of some embodiments of the teachings herein, there is provided an intermediate transfer member (preferably, a flexible belt) for use with a printing system, comprising:

a longitudinal direction and a lateral direction;

a release layer (in some embodiments, of an elastomer according to the teachings herein) having an image transfer surface; and the release layer attached to a body supporting the release layer, the body configured so that the intermediate transfer member has a substantially greater elasticity in the lateral direction than in the longitudinal direction.

Typically, the body is a laminated structure as described above, and includes at least one distinct anisotropic reinforcement layer, the anisotropic reinforcement layer or layers being responsible for the desired elasticity properties. That said, in some embodiments, the body does not comprise a reinforcement layer, or does not comprise an anisotropic reinforcement layer, and some other feature is responsible for the desired anisotropic elasticity properties.

As noted above, when the intermediate transfer member is mounted for use in a suitable printing system, the longitudinal direction is the direction parallel to the motion vector of the intermediate transfer member between the image forming station and the image transfer or impression station of the printing system, and the lateral direction is perpendicular to the longitudinal direction.

Length to Width Ratio

The ratio of the length (longitudinal dimension) to width (lateral dimension) of the intermediate transfer member is any suitable ratio, and typically depends on the construction of the printing system with which the intermediate transfer member is intended for use. That said, the length of the intermediate transfer member is typically greater than the width. Thus, in some embodiments, the ratio of the longitudinal dimension to the lateral dimension of the intermediate transfer member is at least about 1.1:1, at least about 2:1, at least about 3:1, at least about 4:1, at least about 5:1, at least about 6:1, at least about 7:1, at least about 8:1, at least about 9:1, and even at least about 10:1.

Creep

The body is configured to allow the intermediate transfer member to be used under tension in both the longitudinal and the lateral direction.

In some embodiments, the intermediate transfer member is configured to be used under tension in the lateral direction of between about 2 and about 20 N per cm of length.

For example, in such embodiments, a total lateral tension of between about 400 N and 4000 N is applied to a 200-cm long intermediate transfer member and a total lateral tension of between about 800 N and 8000 N is applied to a 400-cm long intermediate transfer member. By "configured to be used" is meant that the intermediate transfer member, is configured to be regularly subjected to the given lateral tension at a temperature of at least about 70° C., or at least about 90° C., at least about 110° C., or at least about 130° C., or at least about 150° C., or at least about 200° C., 140° C. (more typically between 150° C.-200° C.) for a substantial period of time, e.g., at least about 1 day (in some embodiments at least about 3 days, and even at least about 1 week) without substantial permanent lateral deformation (lateral creep), that is to say less than about 0.5% and more preferably less than about 0.1%, and even more preferably ~0% creep. In some embodiments, the entire length of the intermediate transfer member is continuously maintained at the given lateral tension during use. That said, in some embodiments, during use only a portion of the intermediate transfer member is subjected to the given lateral tension at any one instant.

In some embodiments, the intermediate transfer member is configured to be used under longitudinal tension of between about 3 and about 200 N per cm of width. For example, in such embodiments, a total longitudinal tension of between about 30 N and 2000 N is applied to a 10-cm wide intermediate transfer member and a total longitudinal tension of between about 60 N and 4000 N is applied to a 20-cm long intermediate transfer member. By "configured to be used" is meant that the intermediate transfer member is configured to be regularly subjected to the given tension at a temperature of at least 70° C., or at least about 90° C., at least about 110° C., or at least about 130° C., or at least about 150° C., or at least about 200° C., for a substantial period of time, e.g., at least about 1 day (in some embodiments at least about 3 days, and even at least about 1 week) without substantial permanent longitudinal deformation (longitudinal creep), that is to say less than about 0.5% and more preferably less than about 0.1%, and even more preferably ~0%.

Elasticity

In some embodiments, the intermediate transfer member is substantially inelastic in the longitudinal direction, that is to say, configured so that during normal operation the length (longitudinal direction dimension) of the intermediate transfer member does not substantially change. Specifically, in some embodiments, the intermediate transfer member is configured so that during normal operation (including being maintained at an elevated temperature, e.g., of about 150° C.) the length of the intermediate transfer member does not increase by more than about 1.5%, not more than about 1%, more than about 0.5% and even does not increase by more than about 0.2%.

For example, in some embodiments, an intermediate transfer member, when maintained at a temperature of 150° C., is configured to stretch in the longitudinal direction by not more than about 1.5% under 100 Newton per cm width longitudinally-applied tension, by not more than about 1% under 100 Newton per cm width longitudinally-applied tension, by not more than about 0.5% under 100 Newton per cm width longitudinally-applied tension, and even by not more than about 0.2% under 100 Newton per cm width longitudinally-applied tension.

Such inelasticity can be tested by taking a test strip from the intermediate transfer member, 1 cm wide in the lateral direction and 1 meter long in the longitudinal direction. While being maintained at 150° C., the test strip is suspended from one (upper) end, a 0.1 kg weight attached to the other (lower end) and the length of the test strip measured so that the ends of the test strip correspond to the edges of the longitudinal direction. Subsequently, an additional 1 kg weight is attached to the lower end and the resulting increase in length is determined. For example, a change of 5 mm length of such a meter-long strip after addition of the 1 kg weight indicates a 0.5% stretch in the longitudinal direction.

In some embodiments, the intermediate transfer member is substantially elastic in the lateral direction, that is to say, configured so that during normal operation the width (lateral direction dimension) of the intermediate transfer member can substantially elastically increase. Specifically, in some embodiments, the intermediate transfer member is configured so that during normal operation (including being maintained at an elevated temperature, e.g., of about 150° C.) the width of the intermediate transfer member increases by not less than about 5%, not less than about 10% and even not less than about 20%.

For example, in some embodiments, an intermediate transfer member, when maintained at a temperature of 150° C., is configured to elastically stretch in the lateral direction by not less than about 10% under 2 Newton per cm length applied tension, by not less than about 15% under 2 Newton per cm length applied tension, and even by not less than about 20% under 2 Newton per cm length applied tension.

Such elasticity can be tested by taking a test strip from the intermediate transfer member, 10 cm wide in the longitudinal direction and 20 cm long in the lateral direction. While being maintained at 150° C., the test strip is suspended from one (upper) end, a 0.05 kg weight attached to the other (lower end) so that the ends of the test strip correspond to the edges of the lateral direction and the length of the test strip measured. Subsequently, an additional 0.2 kg weight is attached to the lower end and the resulting increase in length is determined. For example, a change of 20 mm length of such a 20 cm-long strip after addition of the 0.2 kg weight indicates a 10% stretch in the lateral direction.

Tensile and Tear

In some embodiments, the tensile and tear properties of an anisotropic intermediate transfer member according to the teachings herein: tensile strength>0.2 N per cm width in the longitudinal (printing) direction and tear strength>10 N per cm width in the longitudinal direction; tensile strength>0.1 N per cm length in the lateral direction; and tear strength>0.4 N per cm length in the lateral direction.

Primary Fibers

The required anisotropic elasticity properties of the intermediate transfer member can be implemented in any suitable way. That said, in some embodiments, the body includes a plurality of primary fibers oriented substantially parallel to the longitudinal direction. Preferably, the primary fibers are sufficiently inelastic so as to provide the intermediate transfer blanket with the desired longitudinal inelasticity. In some such embodiments, the primary fibers are substantially inelastic. In some such embodiments, the primary fibers are made of a material that is substantially inelastic, that is to say, does not substantially stretch at the applied tensions. In some such embodiments, the primary fibers are straight, e.g., devoid of features such as curls, twists or bends: such features typically provide an elasticity unsuitable for implementing the teachings herein. It is important to note that fibers making up a woven fabric are typically not straight, being bent by the force applied by the perpendicular fibers of the weave.

In some embodiments, the primary fibers are a component of and found in at least one distinct anisotropic reinforcement layer. That said, in some embodiments, the primary fibers are not a component of a reinforcement layer.

Primary fibers are of any suitable structure. In some embodiments, each primary fiber is a single monofilament. In some embodiments, each primary fiber is an aggregate of monofilaments or is a thread (a group of short filaments spun or twisted together to make single continuous fiber).

Primary fibers are of any suitable material. For example, in some embodiments, the primary fibers comprises a material selected from the group consisting of organic polymer fibers such as meta-aramid (e.g., Nomex®, Conex®, Kermel®), para-aramid (e.g., Kevlar®, Twaron®), polyamide (Nylon), nylon fibers (twisted or not twisted) and polyester fibers (twisted or not twisted); natural fibers such as cotton (twisted or not twisted); inorganic fibers such as glass fibers, carbon fiber (graphite) fibers, ceramic fibers and metal fibers (wires); and combinations thereof.

That said, a disadvantage of organic polymer and natural fibers is that such fibers are typically elastic, both as an inherent material property and as a result of an inherent curly structure (especially cotton), and may therefore be less suitable as primary fibers for some embodiments. In some embodiments, such fibers are pre-stressed (stretched) to an extent to be substantially inelastic. However, as noted above, pre-stressed fibers eventually lose the stress by creep, especially when maintained at elevated temperature under stress.

Similarly, a disadvantage of metal fibers for some embodiments is metal fatigue. Typically, during use an intermediate transfer member snakes and bends around a plurality of rollers, frequently changing direction, all the while maintained at an elevated temperature, conditions that may lead to failure of the metal fibers due to fatigue.

Accordingly, in some preferred embodiments, the primary fibers comprise a material selected from the group consisting of aramid polymers, glass fibers, carbon-fibers, ceramic-fibers and combinations thereof. In some such embodiments, the primary fibers consist essentially of a material selected from the group consisting of aramid polymers, glass fibers, carbon-fibers, ceramic fibers and combinations thereof. In some such embodiments, the primary fibers consist of a material selected from the group consisting of glass fibers, carbon-fiber fibers and combinations thereof. Suitable such fibers are commercially available from many manufacturers.

Supporting Component

In some embodiments, the body of the intermediate transfer member further comprises at least one supporting component different from the primary fibers. Such a reinforcement component serves one or more functions such as facilitating keeping primary fibers properly oriented and positioned in the body, providing the intermediate transfer member strength in the lateral and/or longitudinal direction, providing the intermediate transfer a desired elasticity in the lateral direction and distributing stress and other forces more homogenously within the intermediate transfer member.

Matrix Supporting Component

In some embodiments, a supporting component of the at least one supporting components comprises a matrix of non-fibrous elastomer. Such a supporting component may be made of any suitable elastomer. In some embodiments, the elastomer comprises a material selected from the group consisting of silicone rubber, neoprene rubber, hydrogenated nitrile butadiene rubber (HNBR), nitrile butadiene rubber (NBR), alkyl acrylate copolymer (ACM), ethylene propylene diene monomer (EPDM) and combinations thereof. In some embodiments, the elastomer consists essentially of a material selected from the group consisting of silicone rubber, neoprene rubber, hydrogenated nitrile butadiene rubber (HNBR), nitrile butadiene rubber (NBR), alkyl acrylate copolymer (ACM), ethylene propylene diene monomer (EPDM) and combinations thereof. In some embodiments, the elastomer consists of a material selected from the group consisting of silicone rubber, neoprene rubber, hydrogenated nitrile butadiene rubber (HNBR), nitrile butadiene rubber (NBR), alkyl acrylate copolymer (ACM), ethylene propylene diene monomer (EPDM) and combinations thereof.

Figure 24:
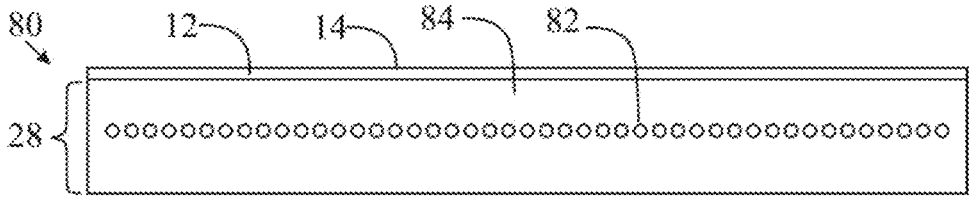
FIG. 24 is a schematic depiction of a cross section along a lateral direction of an embodiment of a body of an intermediate transfer member having longitudinal primary fibers embedded in silicone rubber matrix as a supporting component.

In some embodiments, the primary fibers are impregnated with such a non-fibrous elastomer. In some embodiments, the primary fibers are embedded in such a non-fibrous elastomer. In some such embodiments, such a supporting component constitutes a layer of the body that defines a (distinct) reinforcement layer. In some such embodiments, the elastomer serves, inter alia, in helping adhesion to other layers making up the body of intermediate transfer component. In some embodiments, silicone rubber is preferred as being heat resistant, tough (even when heated) and having relatively high-friction with mechanical components, allowing such an elastomer to serve as a high-friction layer. In FIG. 24, an intermediate transfer member 80 including such a supporting component is schematically depicted in lateral cross section, including a release layer 12 having an image transfer surface 14 directly secured to a body comprising a reinforcement layer 28 made up of primary fibers 82 embedded in a non-fibrous matrix 84 of rubber (e.g., silicone rubber).

Solid Polymer Sheet Supporting Component

Figure 25:
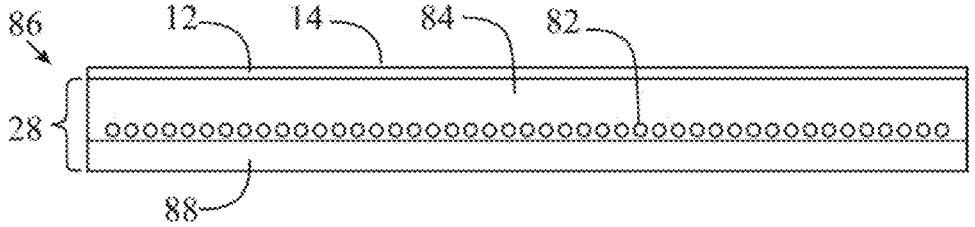
FIG. 25 is a schematic depiction of a cross section along a lateral direction of an embodiment of a body of an intermediate transfer member having longitudinal primary fibers embedded in silicone rubber matrix and an elastomer sheet as a supporting component.

In some embodiments, a supporting component comprises a distinct sheet of non-fibrous elastomer, e.g, a sheet of elastomer. In some embodiments, primary fibers are in direct physical contact with such a supporting component. In some such embodiments, primary fibers are associated with such a sheet of elastomer by binding (e.g., with the use of adhesive), stitching or stapling. In FIG. 25, an intermediate transfer member 86 including such a supporting component is schematically depicted in lateral cross section, including a release layer 12 having an image transfer surface 14 directly secured to a body comprising a reinforcement layer 28 made up of primary fibers 82 embedded in a non-fibrous matrix 84 of silicone rubber, and secured to an elastic sheet of silicone rubber 88.

Fiber Supporting Component

In some embodiments, a supporting component of the at least one supporting components comprises secondary fibers, distinct from the primary fibers. In some embodiments, the secondary fibers are oriented substantially not-parallel to the primary fibers. In some such embodiments, the secondary fibers are oriented to diverge by at least about 30° from parallel, at least about 45°, at least about 60° and even at least about 75° to the primary fibers. In some embodiments, the secondary fibers are oriented substantially parallel to the lateral direction, thereby substantially perpendicular to the longitudinal direction and the primary fibers.

In some embodiments, the secondary fibers are substantially elastic.

Any suitable fibers of any suitable material may be used as secondary fibers to implement the teachings herein. In some embodiments, the secondary fibers are selected from the group of fibers consisting of single monofilaments, aggregated monofilaments and threads. In some embodiments, the secondary fibers comprise a material selected from the group consisting of: cotton (twisted or untwisted), polyester (twisted or untwisted), polyamide (twisted or untwisted), elastane (spandex, Lycra®) and combinations thereof. In some embodiments, the secondary fibers consist essentially of a material selected from the group consisting of: cotton (twisted or untwisted), polyester (twisted or untwisted), polyamide (twisted or untwisted), elastane (spandex, Lycra®) and combinations thereof. In some embodiments, the secondary fibers consist of a material selected from the group consisting of: cotton (twisted or untwisted), polyester (twisted or untwisted), polyamide (twisted or untwisted), elastane (spandex, Lycra®) and combinations thereof.

When the primary and secondary fibers are distinct, not only by properties, but also by chemical composition, the reinforcement layer or fabric within which such fibers would be combined may be referred to as "hybrid". For example, in some embodiments the longitudinally oriented fibers are substantially inelastic while the laterally oriented fibers are elastic. In one embodiments, a 100-200 gram fabric 100 to 300 micrometer thick is used, having substantially inelastic fibers (e.g., glass fibers) in one direction (preferably warp) and elastic fibers (e.g., twisted cotton, polyester or nylon) in the other direction (preferably weft). Suitable fabrics may be designed (e.g., warp fibers, weft fibers, type of weave) as desired and ordered from many commercial sources that provide custom-woven fabrics.

In some embodiments, the body of the intermediate transfer member comprises a single fiber ply in which substantially all fibers (primary and, if present, secondary) are located. In some such embodiments, the thickness of the single ply is: from about 100 μm to about 600 μm, from about 300 μm to about 600 μm, from about 200 μm to about 500 μm, and in some embodiments, and even from about 300 μm to about 550 μm. In some embodiments, thickness of the single fiber ply is about 350 μm.

In some embodiments, the body of the intermediate transfer member comprises at least two distinct fiber plies in which all fibers (primary and, if present, secondary) are located, each of the distinct fiber plies including at least some of the fibers. In some such embodiments, the thickness of each one of the at least two fiber plies is: from about 100 μm to about 600 μm, from about 100 μm to about 200 μm, from about 400 μm to about 600 μm, from about 200 μm to about 500 μm, from about 450 μm to about 550 μm, and even from about 100 μm to about 400 μm. In some embodiments, the body comprises two distinct fiber plies, each fiber ply having a thickness of about 100 μm.

In some embodiments, the body comprises two distinct fiber plies, a thickness of a first of two fiber plies being about 100 μm and a thickness of a second of two fiber plies being about 200 μm.

In some embodiments, where the body of the intermediate transfer member comprises at least two distinct fiber plies, at least some fibers of a first fiber ply are in direct physical contact with at least some fibers of an adjacent second fiber ply.

In some embodiments, where the body of the intermediate transfer member comprises at least two distinct fiber plies, a first fiber ply and an adjacent second fiber ply are physically separated by an intervening sublayer of material substantially devoid of fibers.

In some embodiments, at least one fiber ply is of a woven fabric. In some embodiments, at least one fiber ply is of a non-woven fabric.

Primary and Secondary Fibers Together in a Single Ply

In some embodiments, a supporting component of the at least one supporting components comprises primary fibers and secondary fibers aggregated together to constitute a single ply of fabric. In some embodiments, the fabric is impregnated (partially or completely) with a non-fibrous elastomer as discussed above.

In some such embodiments, primary fibers and secondary fibers are aggregated together to constitute a single ply of non-woven fabric.

In some such embodiments, primary fibers and secondary fibers are aggregated together by weaving, thereby together constituting a woven fabric. In some such embodiments, the primary fibers constitute the warp and the secondary fibers constituted the weft of the woven fabric. Any suitable weave can be used. In some embodiments, the weave is selected from the group of weaves consisting of plain weave, twill weave, basket weave, satin weave, leno weave and mock leno weave.

Primary and Secondary Fibers in Separate Plies

It is important to note that typically fabrics, especially woven-fabrics, have an inherent structural elasticity (e.g., from the weave structure) independent of the elasticity of the constituent fibers. Accordingly in some instances, such structural elasticity renders a fabric including primary fibers unsuitable for use in implementing the teachings herein.

In some embodiments, at least some, or even substantially all, primary fibers are in a ply of primary fibers substantially devoid of secondary fibers. In some embodiments, substantially all primary fibers are in a ply of primary fibers substantially devoid of secondary fibers.

In some embodiments, at least some, or even substantially all, secondary fibers are in a ply of secondary fibers substantially devoid of primary fibers. In some embodiments, substantially all secondary fibers are in a ply of secondary fibers substantially devoid of primary fibers.

In some such embodiments, a supporting component of the at least one supporting components comprises secondary fibers aggregated to constitute a fabric.

In some embodiments, such a fabric is a non-woven fabric.

In some such embodiments, such a fabric is a woven fabric. Any suitable weave can be used. In some embodiments, the weave is selected from the group of weaves consisting of plain weave, twill weave, basket weave, satin weave, leno weave and mock leno weave.

In some such embodiments, the secondary fibers are substantially all arranged substantially in parallel one to the other.

Figure 26:
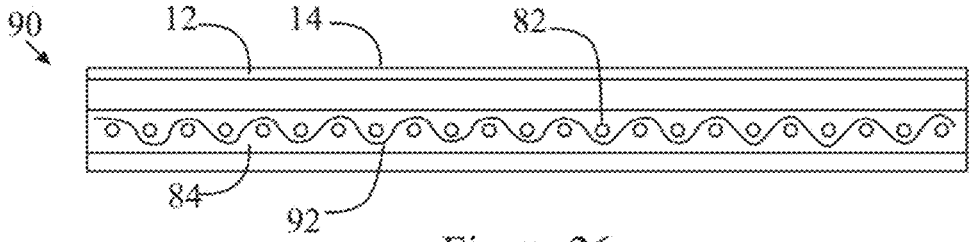
FIG. 26 is a schematic depiction of a cross section along a lateral direction of an embodiment of a body of an intermediate transfer member having longitudinal primary fibers and secondary fibers woven therewith as a supporting component.

In FIG. 26, an intermediate transfer member 90 is schematically depicted having longitudinally-oriented primary fibers 82 of glass woven together with secondary fibers 92 of cotton, fully impregnated with and embedded in non-fibrous matrix 84 of silicone rubber, where primary fibers 82 are the warp and secondary fibers 92 are weft of the resulting woven fabric.

Figure 27:
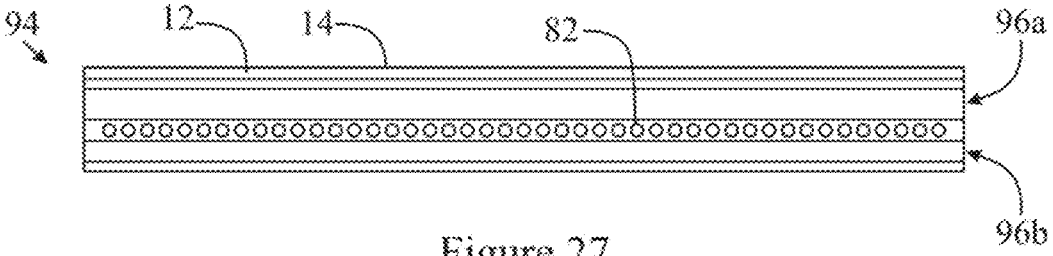
FIG. 27 is a schematic depiction of an embodiment of a body of an intermediate transfer member having a ply of longitudinal primary fibers in direct physical contact with two plies of secondary fibers as supporting components.

In FIG. 27, an intermediate transfer member 94 is schematically depicted having a ply of longitudinally-oriented primary fibers 82 of glass in direct physical contact with two distinct plies of woven polyamide fabric 96*a* and 96*b*, all three plies fully impregnated with and embedded in non-fibrous matrix of silicone rubber. In other similar embodiments, the plies of woven polyamide fabric 96*a* and 96*b* are non-woven fabric. In other similar embodiments, the plies of 96*a* and 96*b* are simply laterally-oriented polyamide fibers that are not part of a fabric.

Figure 28:
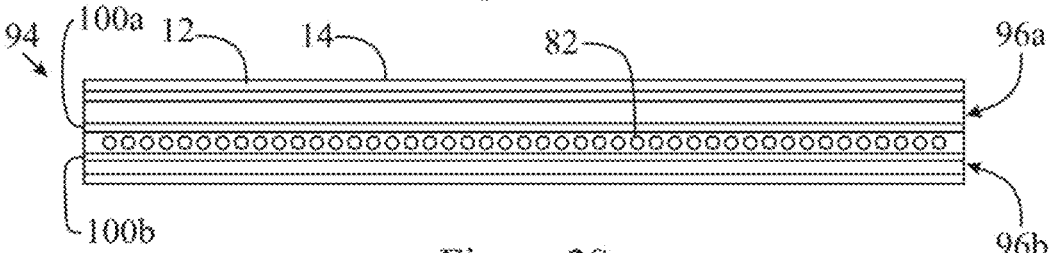
FIG. 28 is a schematic depiction of a cross section along a lateral direction of an embodiment of a body of an intermediate transfer member having a ply of longitudinal primary fibers and two plies of secondary fibers as supporting components.

In FIG. 28, an intermediate transfer member 98 is schematically depicted having a ply of longitudinally-oriented primary fibers 82 of glass and two distinct plies of woven polyamide fabric 96*a* and 96*b*, all three plies fully impregnated with and embedded in non-fibrous matrix of silicone rubber, the plies separated by 20 micrometer thick layers of silicone rubber 100*a* and 100*b*. In other similar embodiments, the plies of woven polyamide fabric 96*a* and 96*b* are non-woven fabric. In other similar embodiments, the plies of 96*a* and 96*b* are simply laterally-oriented polyamide fibers that are not part of a fabric.

Additional Features

In some embodiments, the intermediate transfer member is a blanket which may be looped to form a continuous flexible belt and further comprises: lateral projections from sides thereof, the projections configured to engage guiding components of a suitable printing system, optionally including driving components such as toothed wheels.

In some embodiments, the blanket further comprises: fasteners at ends thereof, allowing the intermediate transfer member to be formed into a loop by engaging fasteners at a first end with fasteners at a second end of the intermediate transfer member. The fasteners when engaged form a seam and in some embodiments, the intermediate transfer member is a seamless belt.

In some embodiments, the flexible belt further comprises: markings detectable by a detector of a suitable printing system, allowing registration of a relative positioning of the intermediate transfer member when mounted on such a suitable printing system.

In some embodiments, the flexible belt further comprises, a component (e.g., RFID tag) allowing monitoring of data relating to the intermediate transfer member, the data entry selected from the group consisting of a catalogue number, a manufacturing date, a manufacturing batch number, a manufacturing plant identifier, a technical datasheet identifier, a regulatory datasheet identifier, and an online or remote support identifier. In some embodiments, the monitoring component may record data from the printing system, including monitoring data relating to the use of the intermediate transfer member in operation, the recorded data relating to any of, the duration of use of the transfer member since installation, the number of sheets of substrate or length of web printed using this transfer member and any such data of relevance to the user of such printing system.

Further details on exemplary lateral projections suitable to maintain the blanket under desired lateral tension, on fasteners suitable the ends of the blanket and on representative markings or monitoring components are disclosed in co-pending PCT application No. PCT/IB2013/051719 (Agent's reference LIP 7/005 PCT). Monitoring methods suitable for certain printing systems are disclosed in co-pending PCT application No. PCT/IB2013/051727 (Agent's reference LIP 14/001 PCT).

Connective Layer

In some embodiments, the body of an intermediate transfer member according to the teachings herein comprises a connective layer. A connective layer is typically a layer placed between any two functional layers such as described above, and serves to improve adherence therebetween. Specifically, in some embodiments where two functional layers have insufficient mutual adherence, a connective layer able to adequately bond to both is interposed between the two layers. A connective layer is of any suitable thickness. That said, a connective layer is typically between about 100 micrometers and about 300 μm thick, more typically between about 150 μm and about 250 μm thick. In some embodiments, a connective layer is about 200 μm thick.

For example, in some embodiments, the body of an intermediate transfer member comprises two or more distinct reinforcement layers (anisotropic or not). In some such embodiments, there is a connective layer between the two distinct reinforcement layers. For example, in some embodiments, there are two distinct reinforcement layers each comprising fibers embedded in (or impregnated with) and elastomer matrix, and a connective layer disposed between the two reinforcement layers is of an elastomer that binds to both elastomer matrices, for example, all three layers (first and second reinforcement layers and the connective layer) comprise the same elastomer.

Specific Embodiments of Intermediate Transfer Members

As noted, an intermediate transfer member according to the teachings herein is a laminated structures comprising a body having one or more layers and a surface (of the last one of the one or more layers) and a release layer attached to the surface, in some embodiments through an adhesive layer. The body of the intermediate transfer member comprises one or more of a conformational layer, compressible layer, thermally-insulating layer, thermally-conductive layer, electrically-conductive layer, low-friction layer, high-friction layer, reinforcement layer and connective layer. In some embodiments, one or more reinforcement layers are anisotropic reinforcement layers as described above. The number, identity and order of the layers of the body of the intermediate transfer member is selected so that the resulting intermediate transfer member has the desired combination of properties.

In some embodiments, the body of an intermediate transfer member comprises a single layer, e.g., an (anisotropic) reinforcement layer. In some embodiments, the body comprises an additional layer between the (anisotropic) reinforcement layer and the release layer, and/or the (anisotropic) reinforcement layer is between an additional layer and the release layer. In some embodiments, the body of an intermediate transfer member comprises at least two (anisotropic) reinforcement layers. In some embodiments, two of the layers are adjacent one to the other. In some embodiments, there is some intervening layer between two of the (anisotropic) reinforcement layers, e.g., of any of the other types of layers.

A number of specific embodiments of intermediate transfer members according to the teachings herein are discussed hereinbelow, some with reference to the Figures.

In FIG. 1A, an intermediate transfer member 10 in the form of a blanket according to the teachings herein is seen in side cross section. Intermediate transfer member 10 comprises a release layer 12 having an image-transfer surface 14 (e.g., of an elastomer according to the teachings herein) attached to and supported by a body 16 through surface 18. Body 16 includes a second surface that defines an inner surface 20 of intermediate transfer member 10 that contacts various mechanical components, such as rollers, of a printing system when intermediate transfer member 10 is mounted therein. In intermediate transfer member 10 release layer 12 is directly attached to surface 18 of body 16 without the use of an adhesive.

Figure 1B:
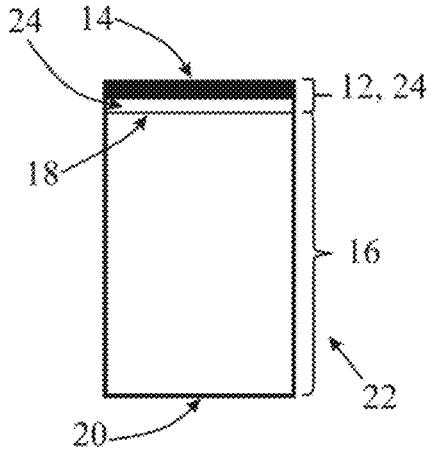
FIG. 1B is a schematic cross-sectional view of an embodiment of an intermediate transfer member, having a release layer attached to a surface of the body of the intermediate transfer member with an adhesive.

In FIG. 1B, an intermediate transfer member 22 is schematically depicted in side cross section. Intermediate transfer member 22 is substantially identical to intermediate transfer member 10 except that release layer 12 is attached to surface 18 of body 16 through a layer of adhesive 24.

Figure 2:
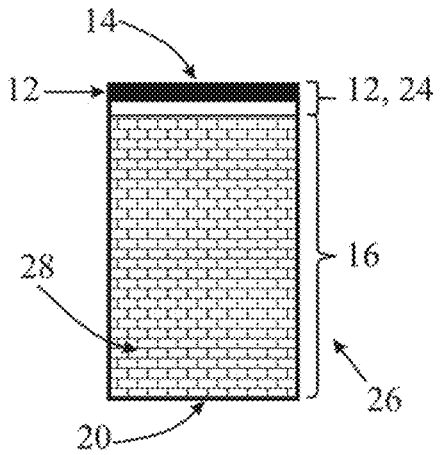
FIG. 2 is a schematic cross-sectional view of an embodiment of an intermediate transfer member, comprising a release layer adhered to a body having a reinforcement layer.

In FIG. 2, an intermediate transfer member 26 is schematically depicted in side cross section, having a body 16 of a single layer, a reinforcement layer 28 (e.g., a 200 micrometer thick layer, of a neoprene rubber impregnated woven fabric) as described herein. In some embodiments, reinforcement layer 28 is an anisotropic reinforcement layer as described herein, (e.g., a 200 μm thick layer, of a neoprene rubber impregnated woven fabric having longitudinal inelastic primary fibers of glass warp and lateral elastic secondary fibers of twisted cotton weft).

Figure 3:
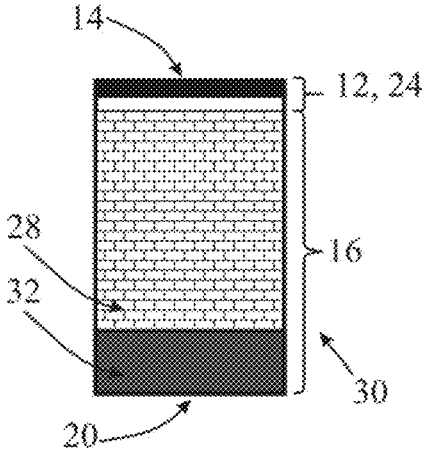
FIG. 3 is a schematic cross-sectional view of an embodiment of an intermediate transfer member, comprising a release layer adhered to a body having a reinforcement layer and a low-friction layer.

In FIG. 3, an intermediate transfer member 30 is schematically depicted in side cross section, having a body 16 with two layers, a reinforcement layer 28 as described herein and a low-friction layer 32 as described herein (e.g., a 150 micrometer thick layer of PTFE).

Figure 4:
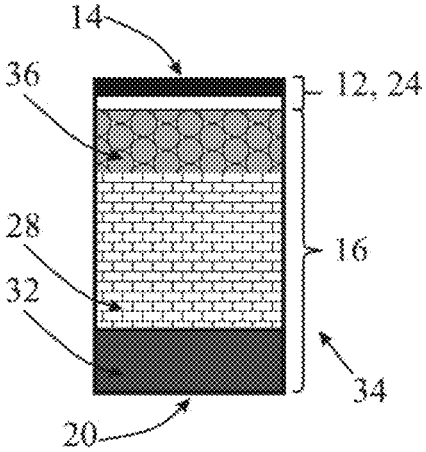
FIG. 4 is a schematic cross-sectional view of an embodiment of an intermediate transfer member, comprising a release layer adhered to a body having a compressible layer, a reinforcement layer and a low-friction layer.

In FIG. 4, an intermediate transfer member 34 is schematically depicted in side cross section, having a body 16 with three layers, a reinforcement layer 28 as described herein, a low-friction layer 32 as described herein, and a compressible layer 36 as described herein (e.g., a single 350 micrometer thick sponge-like layer of hydrogenated nitrile butadiene rubber having 50% by volume small voids).

Figure 5:
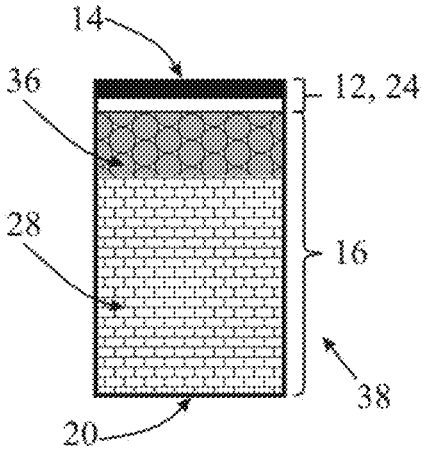
FIG. 5 is a schematic cross-sectional view of an embodiment of an intermediate transfer member, comprising a release layer adhered to a body having a compressible layer and a reinforcement layer.

In FIG. 5, an intermediate transfer member 38 is schematically depicted in side cross section, having a body 16 with two layers, a reinforcement layer 28 as described herein and a compressible layer 36 as described herein.

Figure 6:
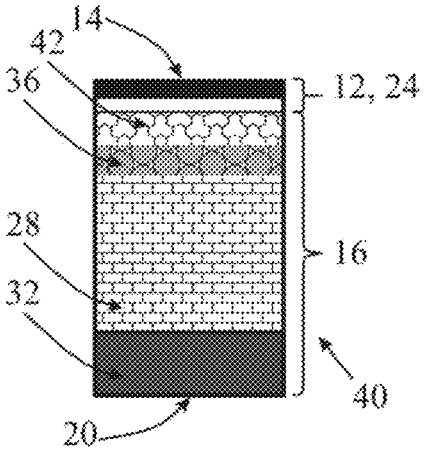
FIG. 6 is a schematic cross-sectional view of an embodiment of an intermediate transfer member, comprising a release layer adhered to a body having a conformational layer, a compressible layer, a reinforcement layer and a low-friction layer.

In FIG. 6, an intermediate transfer member 40 is schematically depicted in side cross section, having a body 16 with four layers, a reinforcement layer 28 as described herein, a low-friction layer 32 as described herein, a compressible layer 36 as described herein and a conformational layer 42 as described herein (e.g., a 150 micrometer thick layer of soft hydrogenated nitrile butadiene rubber having a hardness of 30 Shore A).

Figure 7:
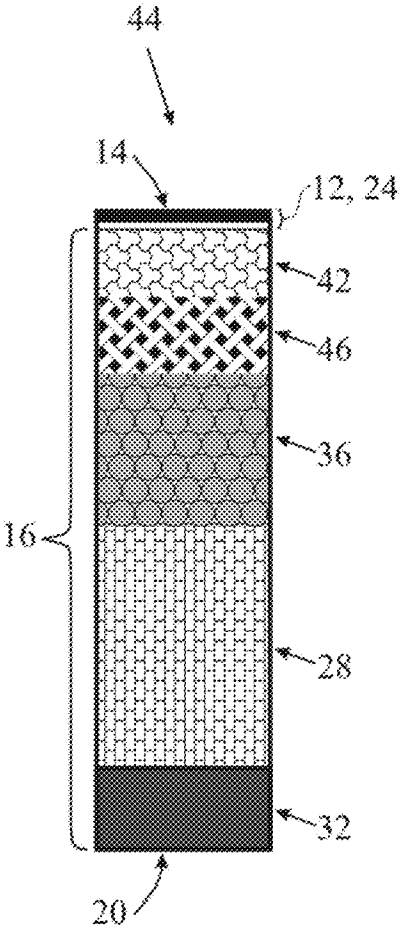
FIG. 7 is a schematic cross-sectional view of an embodiment of an intermediate transfer member, comprising a release layer adhered to a body having a conformational layer, an electrically-conductive layer, a compressible layer, a reinforcement layer and a low-friction layer.

In FIG. 7, an intermediate transfer member 44 is schematically depicted in side cross section, having a body 16 with five layers, a reinforcement layer 28 as described herein, a low-friction layer 32 as described herein, a compressible layer 36 as described herein, a conformational layer 42 as described herein, and an electrically-conductive layer 46 as described herein (e.g., a 100 micrometer thick layer of nitrocellulose loaded with carbon black). The release layer 12 is adhered to the outermost surface of the body (here, conformational layer 42) through adhesive layer 24.

Figure 8:
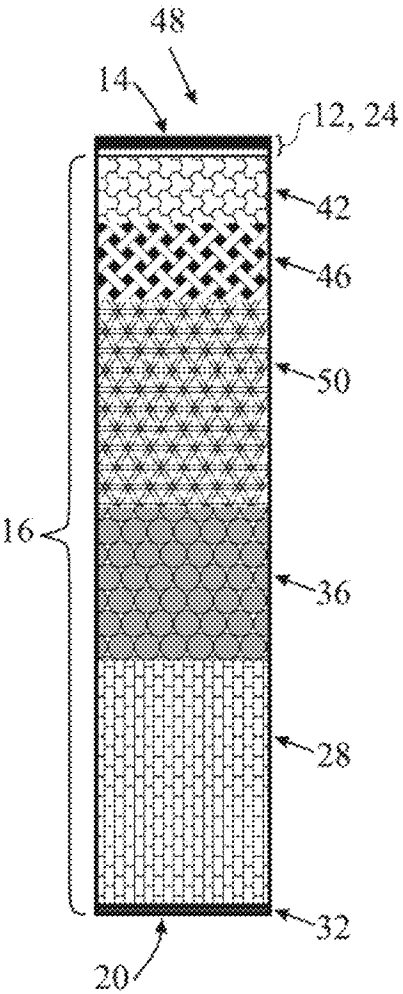
FIG. 8 is a schematic cross-sectional view of an embodiment of an intermediate transfer member, comprising a release layer adhered to a body having a conformational layer, an electrically-conductive layer, a thermally-insulating layer, a compressible layer, a reinforcement layer and a low-friction layer.

In FIG. 8, an intermediate transfer member 48 is schematically depicted in side cross section, having a body 16 with six layers, a reinforcement layer 28 as described herein, a low-friction layer 32 as described herein, a compressible layer 36 as described herein, a conformational layer 42 as described herein, an electrically-conductive layer 46 as described herein, and a thermally-insulating layer 50 as described herein (e.g., a 100 micrometer thick of thermally-insulating rubber). The release layer 12 is adhered to the outermost surface of the body (here, conformational layer 42) through adhesive layer 24.

Figure 9:
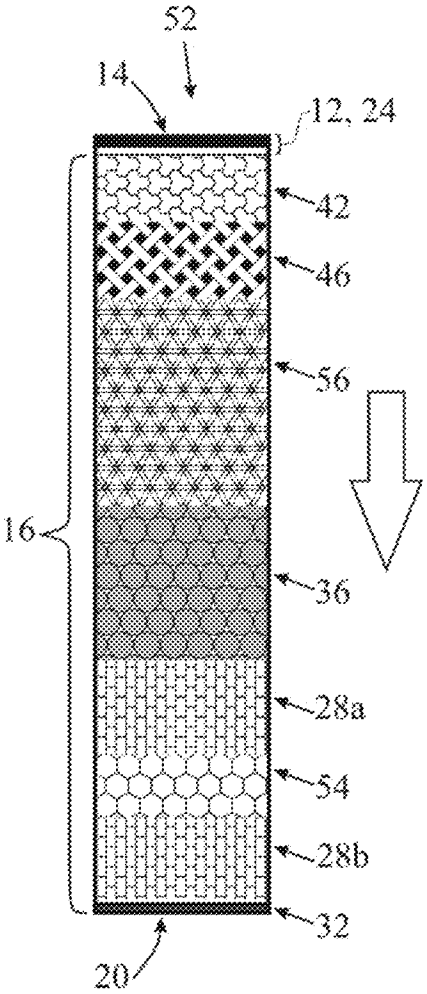
FIG. 9 is a schematic cross-sectional view of an embodiment of an intermediate transfer member, comprising a release layer adhered to a body having a conformational layer, an electrically-conductive layer, a thermally-conducting layer, a compressible layer, two reinforcement layers connected by a connective layer and a low-friction layer.

In FIG. 9, an intermediate transfer member 52 is schematically depicted in side cross section, having: a release layer 12 (e.g., 10 μm thick having a hardness of 30 to 40 Shore A, and made of any suitable material, such as an elastomer according to the teachings herein), attached to a body 16 with a layer of adhesive 24, and a body 16 with eight layers: a conformational layer 42 as described herein (e.g., 150 μm thick layer of cured acrylic rubber ACM having a hardness of 25 to 35 Shore A and an electrical resistance of $10^{10}$ ohm/cm); an electrically-conductive layer 46 as described herein (e.g., 100 μm thick layer of cured acrylic rubber ACM having an electrical resistance of 500 ohm/com substantially the same as used in conformational layer 42 but with suitable conductive additives (e.g., carbon black); a thermally-conducting layer 56 as described herein (e.g., 300 μm thick HNBR rubber with a low amount of voids; a compressible layer 36 as described herein (e.g., 350 μm thick void-comprising HNBR rubber having a compressibility of 80 μm at P=2 kg/cm$^2$; a first reinforcement layer 28*a* as described herein (e.g., a 300 μm thick layer of neoprene rubber impregnated anisotropic woven fabric); a connective layer 54 as described herein (e.g., a 200 μm thick layer of neoprene rubber); a second reinforcement layer 28*b* as described herein (e.g., a 300 micrometer thick layer of neoprene rubber impregnated anisotropic woven fabric); and a low-friction layer 32 as described herein (e.g., a 4 μm thick layer of FMQ fluorinated silicone rubber).

Figure 10:
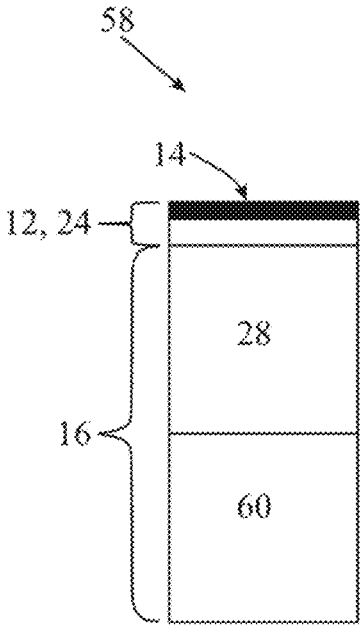
FIG. 10 is a schematic cross-sectional view of an embodiment of an intermediate transfer member, comprising a release layer adhered to a body having a reinforcement layer and an inner (multi)layer.

In FIG. 10, an intermediate transfer member 58 is schematically depicted in side cross section, having a body 16 with two or more layers: a (anisotropic) reinforcement layer 28 as described herein and an inner (multi)layer 60 selected from any one or more of a conformational layer, a compressible layer, a thermally conductive layer, a thermally isolating layer, an electrically-conductive layer, a high-friction layer and a low-friction layer.

Figure 11:
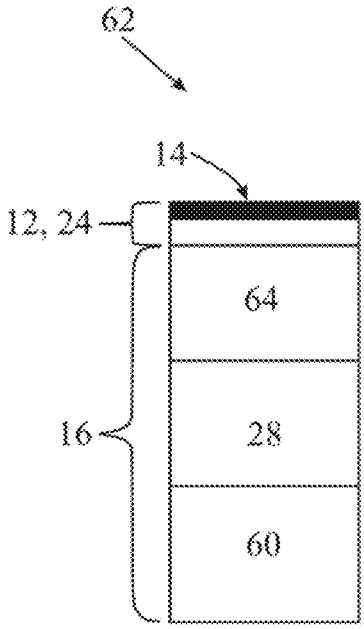
FIG. 11 is a schematic cross-sectional view of an embodiment of an intermediate transfer member, comprising a release layer adhered to a body having an intermediate (multi)layer, a reinforcement layer and an inner (multi)layer.

In FIG. 11, an intermediate transfer member 62 is schematically depicted in side cross section, having a body 16 with at least three layers: an intermediate (multi)layer 64 selected from any one or more of a conformational layer, a compressible layer, a thermally conductive layer, a thermally isolating layer, an electrically-conductive layer, a high-friction layer and a low-friction layer; a (anisotropic) reinforcement layer 28 as described herein; and an inner (multi)layer 60 wherein each one or more layer is selected from any one or more of a conformational layer, a compressible layer, a thermally conductive layer, a thermally isolating layer, an electrically-conductive layer, a high-friction layer and a low-friction layer. Intermediate (multi-)layer 64 and inner (multi)layer 60 may be the same or different.

Figure 12:
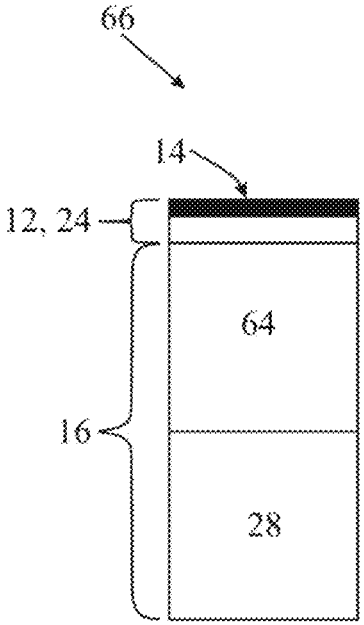
FIG. 12 is a schematic cross-sectional view of an embodiment of an intermediate transfer member, comprising a release layer adhered to a body having an intermediate (multi)layer and a reinforcement layer.

In FIG. 12, an intermediate transfer member 66 is schematically depicted in side cross section, having a body 16 with at least two layers: an intermediate (multi)layer 64 wherein each one or more layer is selected from any one or more of a conformational layer, a compressible layer, a thermally conductive layer, a thermally isolating layer, an electrically-conductive layer, a high-friction layer, and a low-friction layer; and a (anisotropic) reinforcement layer 28 as described herein.

Figure 13:
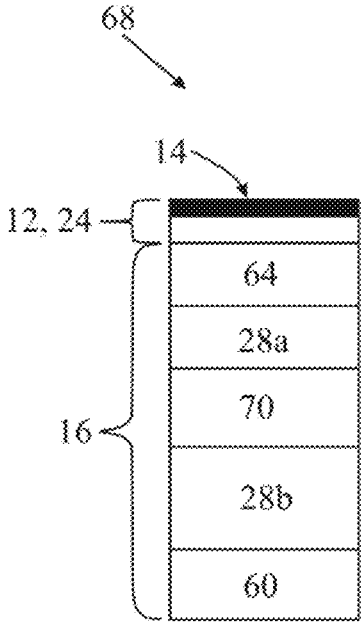
FIG. 13 is a schematic cross-sectional view of an embodiment of an intermediate transfer member, comprising a release layer adhered to a body having an intermediate (multi)layer, a first reinforcement layer, an intervening (multi)layer, a second reinforcement layer and an inner (multi) layer.

In FIG. 13, an intermediate transfer member 68 is schematically depicted in side cross section, having a body 16 with at least five layers: an intermediate (multi)layer 64 wherein each one or more layer is selected as previously described for 64; a first (anisotropic) reinforcement layer 28*a* as described herein; an intervening (multi)layer 70 selected from any one or more of a conformational layer, a compressible layer, a thermally conductive layer, a thermally isolating layer, an electrically-conductive layer, a high-friction layer, and a low-friction layer; a second (anisotropic) reinforcement layer 28*b* as described herein; and an inner (multi)layer 60 wherein each one or more layer is selected from any one or more of a conformational layer, a compressible layer, a thermally conductive layer, an electrically-conductive layer, a low-friction layer and a high-friction layer). Intermediate (multi-)layer 64, inner (multi) layer 60 and intervening (multi)layer 70 may be the same or different.

Figure 14:
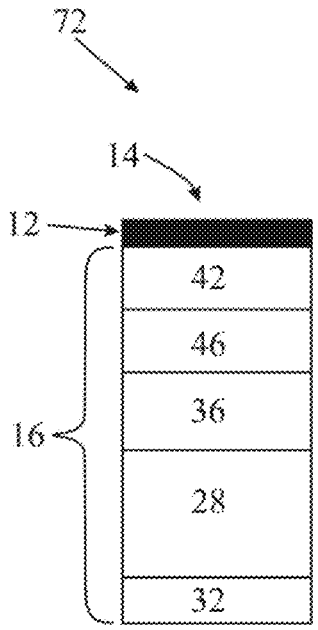
FIG. 14 is a schematic cross-sectional view of an embodiment of an intermediate transfer member, comprising a release layer directly attached to a body having a conformational layer, an electrically-conductive layer, a compressible layer, a reinforcement layer and a low-friction layer.

In FIG. 14, an intermediate transfer member 72 is schematically depicted in side cross section, having: a release layer 12 (e.g., 5 to 8 micrometer thick and made of any suitable material, such as an elastomer according to the teachings herein), directly attached to a body 16 without adhesive 24, body 16 with five layers: a conformational layer 42 as described herein (e.g., a 100 μm thick layer of cured acrylic rubber ACM having a hardness of 25 to 35 Shore A and an electrical resistance of $10^{10}$ ohm/cm); an electrically-conductive layer 46 as described herein (e.g., 100 μn thick layer of cured acrylic rubber ACM having an electrical resistance of 500 ohm/com substantially the same as used in conformational layer 42 but with suitable conductive additives (e.g., carbon black); a compressible layer 36 as described herein (e.g., 350 μm thick void-comprising HNBR rubber having a compressibility of 80 μm at P=2 kg/cm$^2$; a reinforcement layer 28 as described herein (e.g., a 250 μm thick layer of neoprene rubber impregnated anisotropic woven fabric); and a low-friction layer 32 as described herein (e.g., a 40 μn thick layer of fluorinated rubber).

Figure 15:
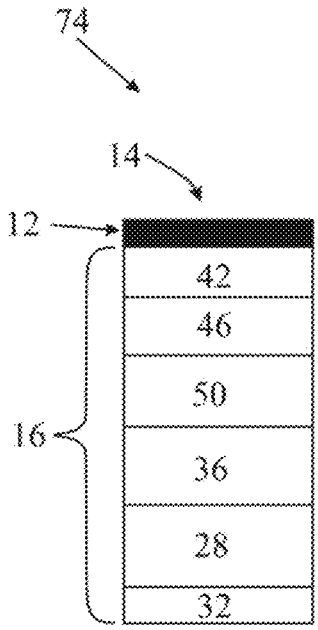
FIG. 15 is a schematic cross-sectional view of an embodiment of an intermediate transfer member, comprising a release layer directly attached to a body with a conformational layer, an electrically-conductive layer, a thermally-insulating layer, a compressible layer, a reinforcement layer and a low-friction layer.

In FIG. 15, an intermediate transfer member 74 is schematically depicted in side cross section, having: a release layer 12 (e.g., 10 micrometer thick and made of any suitable material, such as an elastomer according to the teachings herein), directly attached to a body 16 without adhesive 24, body 16 with six layers: a conformational layer 42 as described herein (e.g., a 150 μm thick layer of cured acrylic rubber ACM having a hardness of 25 to 35 Shore A and an electrical resistance of $10^{10}$ ohm/cm); an electrically-conductive layer 46 as described herein (e.g., 100 μm thick layer of cured acrylic rubber ACM having an electrical resistance of 500 ohm/com substantially the same as used in conformational layer 42 but with suitable conductive additives (e.g., carbon black); a thermally-insulating layer 50 as described herein (e.g., a 80 μm thick layer of soft rubber); a compressible layer 36 as described herein (e.g., 350 μm thick void-comprising HNBR rubber having a compressibility of 80 μn at P=2 kg/cm$^2$; a reinforcement layer 28 as described herein (e.g., a 250 μm thick layer of neoprene rubber impregnated anisotropic woven fabric); and a low-friction layer 32 as described herein (e.g., a 10 μm thick layer of fluorinated rubber).

In co-pending PCT patent application PCT/IB2013/051718 (Agent's reference LIP 5/006 PCT) is described an indirect printing system where some of the functions ordinarily served by some layers in an intermediate transfer member are served by one or more elements of the transfer member supporting structure, for example, one or more of the layers described above can be "separated" and/or "transferred" to a roller. In particular, it is advantageous to have a thin flexible belt including the release layer, while the compressible layer is now "separated" to form the outer surface of a pressure cylinder which at the impression station urges the thin belt against the impression cylinder, to transfer the ink image from the release layer of the belt to the substrate. It is desired, for reasons already explained in the context of the previous "thick" blanket which included the compressible layer, that such thin belt further comprises a reinforcement layer, and optionally a layer controlling the frictional drag of the belt over supporting surfaces of its support structure.

Figure 16:
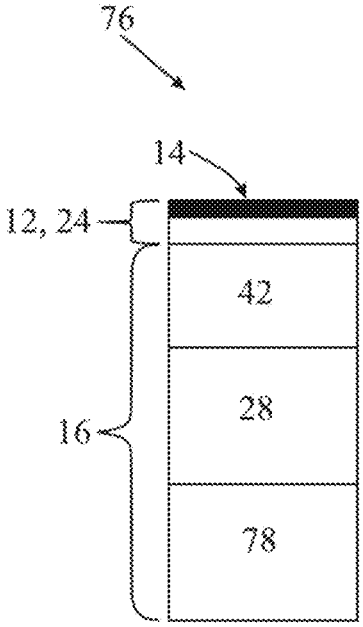
FIG. 16 is a schematic cross-sectional view of an embodiment of an intermediate transfer member, comprising a release layer adhered to a body with a conformational layer, a reinforcement layer and a high-friction layer.

In FIG. 16, an embodiment of an intermediate transfer member 76 exceptionally suitable for use with such a printing system is schematically depicted in side cross section. Intermediate transfer member 76 comprises, a release layer 12 (e.g., a layer of elastomer according to the teachings herein) having a thickness between about 0.1 micrometer and about 100 μm, and even between about 1 and about 50 μm; in some embodiments not less than about 1 μm and not more than about 30 μm, thus between about 1 μm and about 30 μm, between about 1 μm and about 20 μm, and even between about 5 μm and about 15 μm), attached to a body 16 with an adhesive layer 24 (e.g., about 0.1 μm to about 10 μm thick layer of any suitable adhesive, preferably between about 1 μm and about 3 μm), body 16 having three layers: a conformational layer 42 as described herein (e.g., soft silicone rubber (20-65 shore A having a thickness of e.g., about 50 μm to about 1000 μm, preferably about 150 μm); a reinforcement layer 28 as described herein (e.g., about 100 μn to about 500 μm thick, fabric (preferably woven fiberglass, optionally anisotropic as described herein, for example, comprising primary fibers of inelastic glass parallel to the longitudinal direction and secondary fibers of elastic twisted fibers such as cotton) fully impregnated with silicone rubber) and a high-friction layer 78 as described herein (e.g., soft silicone rubber, having a thickness ranging from about 5 μm to about 250 μm, from about 100 μm to about 200 μm, and even from about 50 μm to about 200 μm). In an alternative embodiment, the release layer of the thin belt can be directly attached to the body without an intermediate adhesive layer.

Such an intermediate transfer member is typically up to about 1 mm thick, more typically between 300 and 500 μm, in contrast with other intermediate transfer members that are typically between about 1.5 mm and about 2 mm thick.

In some such embodiments, where the reinforcement layer includes a single layer of fabric, reinforcement layer is between about 150 μn and about 400 μm thick, in some embodiments about 350 μm thick.

In some such embodiments, where the reinforcement layer includes two distinct layers of fabric, each layer is between about 50 μm and about 250 μm thick, and the reinforcement layer is between about 100 μm and about 500 μn thick.

In the embodiments of intermediate transfer members depicted in the Figures above, layers of a respective body are depicted positioned in a particular order. In some similar embodiments, the order and/or number of layers can be different.

Manufacture of Intermediate Transfer Member

A person having ordinary skill in the art is able to make an intermediate transfer member according to the teachings herein upon perusal of the disclosure herein, using personal judgement standard methods, techniques and materials known in the art, and may optionally include blending, melting, coating, laminating and spraying materials.

In a preferred method, a desired body having a surface is manufactured using known techniques. Subsequently, a release layer is attached to the surface of the body to make the intermediate transfer member.

Preparing Body Surface for Attaching Release Layer

In some embodiments, the surface of the body is provided in a cured state so that the incipient release layer is attached to an already cured surface. In some embodiments, the surface of the body is provided in a partially cured state so that the incipient release layer is attached to a partially cured surface. In some embodiments, the time between manufacture of the surface and attachment of the release layer is sufficiently variable and long that the curing state of the surface of the body is variable and indeterminant. In some such embodiments, the surface of the body is pre-cured (e.g., conditions are applied to substantially fully cure the surface) so that the release layer is attached to a standardized surface.

In some embodiments, a removable foil having a glossy surface finish is applied to the surface of the body prior to attachment of the incipient release layer, typically when the surface is substantially uncured or only partially cured so that the resulting surface of the body is particularly smooth. Such a smooth surface helps in providing a homogenously thick, even and smooth release layer, especially when the incipient release layer is applied as a fluid curable polymer composition, see below. Any suitable foil can be used, for example, a thermoplastic polyester (PET) foil, especially a metallized PET, e.g., an aluminium PET laminate. Prior to application of a release layer precursor or adhesive, the foil is removed.

Solid Incipient Release Layer

In some embodiments, the incipient release layer is a solid component (e.g., a solid elastomer sheet) that is attached to the surface of the body, for example with a suitable curable adhesive.

Fluid Incipient Release Layer

In some embodiments, a fluid curable composition is applied as a layer on the surface of the body to form an incipient release layer, and upon curing, the fluid curable composition becomes the desired release layer. In some embodiments, the fluid curable composition is applied directly to the surface of the body of the intermediate transfer member. In some embodiments, a layer of an adhesive composition is first applied to the surface of the body of the intermediate transfer member, and subsequently the fluid curable composition is applied on the layer of the adhesive composition. The required thickness of adhesive and/or fluid curable polymer composition can be applied using any suitable method, for example by spraying or with the use of a Meyer rod or offset gravure coater.

In some embodiments, an adhesive layer is first cured (partially or completely) before application of a fluid curable polymer composition. In some embodiments, a fluid curable polymer composition is applied on an uncured adhesive layer.

Preparing a Fluid Curable Composition

A fluid curable composition, such as a composition according to the teachings herein, is generally prepared by combining all of the components in the required relative amounts. The length of time before application that a fluid curable composition is made, and possibly stored, is dependent on how quickly the composition cures in storage conditions. In some embodiments, a prepared composition is storable without substantial curing for a relatively long time (e.g., a week). In some embodiments, a prepared composition must be used within less than an hour.

Curing a Fluid Incipient Release Layer

Curing of the applied incipient release layer and/or adhesive layer is achieved using any suitable method that depends on the composition thereof, and includes inter alia waiting, applying a chemical curing agent, heating, and exposure to ultraviolet or electron beam radiation.

For example, in some embodiments of a fluid curable composition according to the teachings herein including a condensation cure catalyst, the rate of curing is dependent on humidity and temperature. Complete curing typically occurs within 5 minutes when an applied layer of composition is held at a temperature of between 80° C. and 150° C. at a relative humidity of above 30%.

Completing an Intermediate Transfer Member

Typically, the laminated structure of an intermediate transfer member is made on a planar sheet (if narrow, substantially a strip). Once the laminated structure of the intermediate transfer member is set, it is necessary to give the intermediate transfer member a required form.

When the intermediate transfer member is in the form of a cylinder, typically the sheet is cut to an appropriate size and the laminated structure secured to a rigid (metal, hard plastic) roll base, for example, using adhesive.

When the intermediate transfer member is a blanket, the ends of the sheet are joined together to form a loop. The ends may be joined in any suitable method, as known in the art, Depending on the embodiment, the ends may be joined releasably (e.g., zip fastener, hooks, magnets) or permanently (e.g., soldering, welding, adhesive, taping)

Adhesion of Release Layer to Intermediate Transfer Member Body

As noted above, intermediate transfer members, including an intermediate transfer member according to the teachings herein, are laminated structures comprising a body having one or more layers and a surface (of the last one of the one or more layers) and a release layer attached to the surface.

In some instances, it is desired that the last layer of the body of an intermediate transfer member be of a rubber so that the release layer is attached to a rubber surface. As noted above, in some embodiments of making such an intermediate transfer member, the body is provided with an uncured rubber layer surface. To the uncured rubber layer surface is applied a layer of a suitable curable adhesive composition, and layer of fluid curable polymer composition is applied on to the adhesive composition layer. The uncured layers of the thus-formed incipient intermediate transfer member are then allowed to cure, where the uncured adhesive composition cures together with the uncured rubber surface and also cures together with the uncured curable polymer composition. When curing is complete, the thus-produced release layer (e.g., of an elastomer according to the teachings herein) of the intermediate transfer member is securely bonded to the now-cured rubber layer of the body through the now-cured adhesive.

Adhesive compositions suitable for bonding elastomers comprising at least one cross-linked silicone-related polymer (e.g., the cured form of curable polymer compositions including a silicone-related polymer such as a curable polymer compositions according to the teachings herein) to uncured rubbers surfaces are known in the art.

Some adhesive compositions suitable for bonding elastomers comprising at least one cross-linked silicone-related polymer to at least partially-cured or cured rubbers surfaces have been described in the art, see for example, U.S. Pat. Nos. 3,697,551; 4,401,500; US 2002/0197481; and US 2008/0138546 and PCT Patent Publications WO 2002/094912 and WO 2010/042784. That said, Applicant has found an adhesive including an azido silane or an organic peroxide that generates free radicals on thermal activation that in some embodiments has advantages compared to other adhesives, as described hereinbelow and especially in the "summary of the invention" section.

Accordingly, if intermediate transfer member manufacture is limited to a method including providing an uncured rubber layer, an adhesive layer and a fluid curable polymer composition layer, and then curing the three layers together, suitable intermediate transfer members can be made. However, it is often desirable to preproduce the body of the intermediate transfer member at one site (e.g., with a subcontractor) and to assemble the intermediate transfer member by attaching an elastomer release layer to the body at a different site. By the time the preproduced body is delivered and ready for attachment of the release layer, an originally uncured rubber surface is already at least partially, if not substantially completely, cured.

Accordingly, there is a need to increase the adhesion of elastomers comprising at least one cross-linked silicone-related polymer to an at least partially cured or even substantially completely cured rubber surface. In the context of the teachings herein, there is a need for a method for preparing an intermediate transfer member of a printing system that includes attaching a release layer made of an elastomer comprising at least one cross-linked silicone polymer (such as an elastomer according to the teachings herein) to the surface of an at least partially cured rubber layer.

As described immediately hereinbelow, an aspect of the teachings herein provides methods of attaching an elastomer comprising at least one cross-linked silicone-related polymer to an at least partially cured or even substantially completely cured rubber surface.

Surface of at Least Partially Cured Rubber

In some embodiments, the rubber surface is substantially completely cured. In some embodiments, the rubber surface is partially cured. In some embodiments, the at least partially cured rubber is a rubber which is stable at temperatures of greater than about 100° C. In some embodiments, the rubber is selected from the group consisting of room temperature vulcanization RTV and RTV2, liquid silicone LSR, Vinyl Methyl Silicone (VMQ), Phenyl Silicone Rubber (PMQ, PVMQ), fluorosilicone rubber (FMQ, FMVQ), alkyl acrylate copolymer rubbers (ACM), ethylene propylene diene monomer rubber (EPDM), fluoroelastomer polymers (FKM), nitrile butadiene rubber (NBR), ethylene acrylic elastomer (EAM), and hydrogenated nitrile butadiene rubber (HNBR).

Elastomer

The elastomer is any suitable elastomer comprising at least one cross-linked silicone-related polymer, for example, an elastomer according to the teachings herein. Typically, such an elastomer is the cured form of a curable polymer composition including a silicone-related polymer, for example, a curable polymer compositions according to the teachings herein.

In the specific context of the instant application, in some embodiments the laminated product is an intermediate transfer member of a printing system and the elastomer layer constitutes a release layer thereof.

In some embodiments, the elastomer layer is between 1 micrometer and about 200 micrometers thick.

Adhesive Composition

According to an aspect of some embodiments of the teachings herein, sufficient adhesion of an elastomer comprising at least one cross-linked silicone-related polymer to an at least partially cured or even substantially completely cured rubber surface is achieved by first applying a layer of an adhesive composition to the surface, and only subsequently applying a fluid curable composition comprising at least one silicone-related polymer on the applied adhesive composition layer. Subsequent curing of the curable composition forms a cured elastomer bonded to the surface of the rubber layer with an adhesive layer to form the desired product, e.g., an intermediate transfer member.

Any suitable curable adhesive composition may be used for implementing such embodiments. That said, in some embodiments, it is preferable to use a curable adhesive composition according to the teachings herein. In some embodiments, the curable adhesive compositions according to the teachings herein provide a very strong and heat-stable attachment between a release layer for use in printing, and a rubber layer to which attached.

Thus, according to an aspect of some embodiments of the teachings herein, there is also provided a method for bonding an elastomer layer comprising at least one cross-linked silicone-related polymer to an at least partially cured rubber surface to form a laminated product comprising providing a body having a surface of at least partially cured rubber; on the surface of at least partially cured rubber, applying a layer of a curable adhesive composition including at least one organosilane, and material that generates free radicals on activation; on the applied layer of adhesive composition, applying a layer of a fluid curable composition comprising at least one silicone-related polymer (in some embodiments, a fluid curable composition according to the teachings herein), to form an incipient laminated product; and curing the fluid curable composition and the curable adhesive composition, thereby forming a laminated product.

In the specific context of the instant application, in some embodiments: the laminated product is an intermediate transfer member of a printing system; the elastomer layer constitutes a release layer of the intermediate transfer member; the rubber surface is a surface of a body of the intermediate transfer member; and the incipient laminated product is an incipient intermediate transfer member.

According to an aspect of some embodiments of the teachings herein, there is also provided a laminated product, comprising a body having a surface of at least partially cured rubber; an elastomer layer comprising at least one cross-linked silicone-related polymer (in some embodiments, an elastomer according to the teachings herein); and a cured adhesive layer comprising at least one organosilane bonded to the surface through an organic portion of the organosilane and bonded to the elastomer layer through a silicone portion of the organosilane.

In the specific context of the instant application, in some embodiments: the laminated product is an intermediate transfer member of a printing system; and the cured silicone polymer layer constitutes a release layer of the intermediate transfer member.

Organosilane

In some embodiments of the method or laminated product, the at least one organosilane is of the formula:

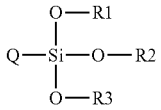

wherein

Q is any organic group having at least three carbon atoms, in some embodiments at least three alkyl carbon atoms.

In some embodiments, Q is a linear or branched alkyl group. In some embodiments, Q includes a functional group such as an epoxide or methacrylate group.

In some embodiments, Q includes at least one aromatic group and/or at least one halogen atom and/or at least one double bond.

In some embodiments, R1, R2, and R3 are each independently an alkyl group having between 1 and 30 carbon atoms. In some embodiments, one, two, or (preferably) all three of R1, R2, and R3 are each independently an alkyl group having between 1 and 4 carbon atoms so that cleavage of the corresponding silyl ether bond produces a relatively volatile alcohol.

In some embodiments of the method or laminated product, the at least one organosilane comprises a single type of organosilane.

In some embodiments of the method or laminated product, the at least one organosilane comprises a combination of at least two different types of organosilane.

In some embodiments, the at least one organosilane is glycidoxypropyl trimethoxysilane and/or methacryloxypropyl trimethoxysilane, both available from Evonik Industries, Essen, Germany under the tradenames Dynasylan® Glymo and Dynasylan® Memo respectively.

In some embodiments of the method or laminated product, the at least one organosilane comprises at least one aminosilane, such as, for example, Dynasylan® AMEO (3-Aminopropyltriethoxysilane) or Dynasylan® AMMO (3-Aminopropyltrimethoxysilane), or mixture thereof. According to a preferred embodiment, the adhesive composition comprises a blend of (3-Aminopropyltriethoxysilane) or Dynasylan® AMMO (3-Aminopropyltrimethoxysilane) and an azido silane, such as, for example, azidosulfonylhexyltriethyoxysilane.

The at least one organosilane comprises any suitable amount of organosilane. In some embodiments, the amount of organosilane is in the range of from 3% to 98% w/w, preferably from 80% to 98% w/w of the curable adhesive composition. In one preferred embodiment, the at least one organosilane comprises about 95% by weight of the curable adhesive composition. More preferably, the composition comprises 95% (w/w) Dynasylan® AMEO or Dynasylan® AMMO and 5% (w/w) azido silane.

Materials that Generate Free Radicals on Activation

In some embodiments of the method, the material that generates free radicals on activation is a thermally activated material.

In some such embodiments, curing comprises application of heat to the layer of adhesive composition. In some such embodiments, applying heat comprises heating the layer of adhesive composition to a temperature of at least 100° C. When heated above 100° C., suitable thermally activated materials generate free radicals in an amount sufficient to lead to a chemical reaction, such as described below, that generates strong covalent bonds between functional groups of the curable adhesive composition and components of cured rubbers.

Typically, such thermally activated materials are selected from the group consisting of peroxides, azo compounds and azide compounds. In some embodiments, such a thermally activated material is selected from the group consisting of benzoyl peroxide, azo bis-isobutyronitrile (AIBN) and azidosulfonylhexyltriethoxysilane (SIA 0780 from Gelest Inc, Morrisville, Pa., USA).

In embodiments wherein the thermally activated material comprises an azide compound such as 6-azidosulfonylhexyltriethoxysilane, the azido group decomposes upon heating to above 110° C., leaving $N_2$ and a nitrene biradical that links by insertion mechanisms to the cured rubber. The hydrolysable part of the azidosulfonylhexyl triethoxysilane links to the fluid silicone composition, using organo titanate or tin catalysts.

In embodiments wherein the thermally activated material comprises peroxide, the free radicals generated upon heating by the decomposition of the peroxide activate the functional part of the organosilane, that undergo crosslinking with the rubber, while the hydolysable part of the organosilane creates links with the fluid silicone composition.

During use, the thermal curing composition is heated, causing the thermally activated material to generate free radicals. The generated free-radicals initiate a chemical reaction with the rubber surface that leads to direct chemical binding of the organo-alkoxysilane through the Q group, wherein the Q group binds to the rubber surface and the Si group to the silicone polymer.

The thermal curing composition comprises any suitable amount of thermally activated material, typically between 2% and 20% by weight of organosilane on a weight basis, preferably between 3% and 7%, and most preferably about 5%.

In some embodiments, the material that generates free radicals on activation is an ultraviolet activated material. In some such embodiments, curing comprises application of ultraviolet radiation to the layer of adhesive composition. In some such embodiments, the ultraviolet activated material comprises a photoinitiator, for example, a benzophenone derivative, or 2-hydroxy 2-methyl 1-phenyl 1-propanol.

Combined Function

In some embodiments, the curable adhesive composition comprises a single chemical entity that serves as both the thermally activated material component and the organosilane component. For example, in some such embodiments, the curable adhesive composition comprises an azido silane, such as azidosulfonylhexyltriethoxysilane, which can act as both the thermally activated material and the organosilane.

Condensation Cure Catalyst

In some embodiments of the method, the curable adhesive composition further comprises a condensation cure catalyst, that is any catalyst suitable for catalysing binding of the organosilane through the alkoxysilane groups to silanol functions in a silicone precursor composition.

During use, the condensation cure catalyst catalyzes the formation of chemical bonds between the silicon atom of the organosilane to a silanol in a silicone composition, forming a Si—O—Si bond and releasing the R1, R2 or R3 group of the organosilane as an alkyl alcohol.

The condensation cure catalyst comprises any suitable condensation cure catalyst. In a preferred embodiment, the condensation cure catalyst is an organo tin carboxylate, for example dibutyltin dilaurate (CAS No. 77-58-7) or a titanate catalyst such as titanium diisopropoxy (bis-2,4-pentanedionate) commercially available as AKT855 from Gelest Inc, Morrisville, Pa., USA.

The thermal curing composition comprises any suitable amount of condensation cure catalyst, typically between 1% and 10% w/w of the organosilane.

Diluent

In some embodiments of the method, the curable adhesive composition comprises a diluent that reduces the viscosity of the composition. In some such embodiments, the diluent is an organic solvent, for example, an organic solvent selected from the group consisting of isopropanol, xylene and toluene, or combinations thereof.

In some embodiments, the curable adhesive composition is substantially devoid (i.e., less than 1% by weight and even less than 0.5% of a diluent.

In some embodiments of the method, the curable adhesive composition is applied on the at least partially cured rubber surface as a layer of thickness in the range of from about 0.1 to about 10 micrometer.

In some embodiments of the laminated product, the cured adhesive layer has a thickness in the range of from about 0.1 to about 10 micrometer.

In some embodiments of the method, the fluid curable composition is applied on the layer of adhesive composition as a layer of thickness in the range of from about 1 to about 200 micrometer.

In some embodiments of the laminated product, the elastomer layer has a thickness in the range of from about 1 to about 200 micrometer.

In some embodiments of the method, the curing of the curable adhesive composition is at least partially performed prior to applying the layer of fluid curable composition.

In some embodiments of the method, the curing of the curable adhesive composition is performed subsequent to applying the layer of fluid curable composition.

Adhesive Compositions

The teachings herein additionally provide specific exceptionally useful curable adhesive compositions.

This, according to an aspect of some embodiments of the teachings herein, there is also provided a curable adhesive composition comprising an aminosilane and an azido silane. In some such embodiments, the curable adhesive composition is a thermally curable adhesive composition. In some such embodiments, the azido silane comprises azidosulfonyl-hexyl-triethyoxysilane.

According to an aspect of some embodiments of the teachings herein, there is also provided a curable adhesive composition comprising an aminosilane and a photoinitiator. In some such embodiments, the adhesive composition is an ultraviolet curable adhesive composition. In some such embodiments, the photoinitiator comprises a benzophenone derivative. In some such embodiments, the photoinitiator comprises 2-hydroxy 2-methyl 1-phenyl 1-propanol.

In some embodiments of the curable adhesive compositions, the aminosilane is selected from the group consisting of 3-aminopropyltriethoxysilane and 3-aminopropyltrimethoxysilane.

In some embodiments of the curable adhesive compositions, the aminosilane is present at a concentration of about 95 weight percent of the curable adhesive composition.

According to an aspect of some embodiments of the teachings herein, there is also provided a thermal curing adhesive composition, comprising: an organosilane; a thermally activated material that generates free radicals on heating; and a condensation-cure catalyst.

Bonding Already-Cured Silicone Polymers

The methods described above for bonding an elastomer comprising at least one cross-linked silicone-related polymer to an at least partially-cured rubber surface to form a laminated product with an adhesive composition are described where a layer of a fluid curable composition comprising at least one silicone-related polymer is applied to a layer of adhesive composition. Curing of the two layers leads to formation of a desired laminated product such as an intermediate transfer member, where the cured elastomer layer is a release layer thereof.

In a related aspect of the teachings herein, instead of the fluid curable composition, an already-cured elastomer layer (in some embodiments, between 1 and 200 micrometer thick) is contacted with the applied layer of adhesive composition. Curing of the adhesive composition leads to formation of a desired laminated product such as an intermediate transfer member, where the cured elastomer layer is a release layer thereof.

Thus, according to an aspect of some embodiments of the teachings herein, there is also provided a method for bonding an elastomer layer comprising at least one cross-linked silicone-related polymer to an at least partially cured rubber surface to form a laminated product comprising providing a body having a surface of at least partially cured rubber; on the surface of at least partially cured rubber, applying a layer of a curable adhesive composition including at least one organosilane, and a material that generates free radicals on activation; on the applied layer of adhesive composition, placing an elastomer comprising at least one cross-linked silicone-related polymer (in some embodiments, an elastomer according to the teachings herein), to form an incipient laminated product; and curing the adhesive composition; wherein the curing of the adhesive composition binds the elastomer to the surface of the rubber, thereby forming a laminated product.

Features and options of the embodiments of such a method are substantially the same, mutatus mutandi, as described above for bonding an elastomer comprising at least one cross-linked silicone-related polymer to an at least partially cured rubber surface to form a laminated product comprising by applying a layer of a fluid curable composition, so are not repeated.

Other Uses

The bonding methods described herein (using adhesives) have been discussed in the context of bonding an elastomer comprising at least one cross-linked silicone-related polymer to an at least partially cured rubber surface. It is important to note that if desired, the methods can be implemented for bonding an elastomer comprising at least one cross-linked silicone-related polymer to an uncured rubber surface.

Method and Device for Printing

An intermediate transfer member including a release layer according to the teachings herein can be used with any suitable printing device and/or to implement any suitable printing method to transfer an ink residue film to any suitable substrate.

A typical suitable method of printing comprises: during a printing cycle when a specific image is printed on a specific substrate, to:

a. apply one or more inks (each ink comprising a coloring agent in a liquid carrier) as a plurality of ink droplets to form an ink image on the image transfer surface of a release layer of an intermediate transfer member;
b. while the ink image is being transported by the intermediate transfer member, evaporating the carrier to leave an ink residue film including the coloring agents on the image transfer surface of the release layer; and
c. transferring the residue film from the image transfer surface of the release layer to the substrate (e.g., paper, cardboard, cloth), thereby printing the desired image on the substrate. In preferred embodiments, the inks are applied as droplets by ink jetting, in the usual way.

The intermediate transfer members of the invention, or any of their inventive composition (e.g., release layer, adhesive layer, reinforcement layer), structure or use may in some embodiments thereof, be suitable for use with indirect printing systems as described in the co-pending PCT application of the applicant Nos. PCT/IB2013/051716 (Agent's reference LIP 5/001 PCT), PCT/IB2013/051717 (Agent's reference LIP 5/003 PCT) and PCT/IB2013/051718 (Agent's reference LIP 5/006 PCT), which are included by reference as if fully set forth herein.

Ink Compositions

An intermediate transfer member including a release layer according to the teachings herein can be used with any suitable ink, especially suitable inks having a coloring agent and resin binder in an aqueous carrier. In such embodiments, the residue film that remains on the image transfer surface of the release layer after evaporation of the carrier that is subsequently transferred to the substrate to produce the desired image on the substrate includes both the coloring agent and the resin binder.

In some embodiments, such inks suitable for use in conjunction with the teachings herein contain a coloring agent (e.g., dyes or nanoparticulate pigments) and a water-dispersible or water-soluble organic polymeric resin.

Any suitable coloring agent may be used.

Any suitable water-dispersible or water-soluble resin binder may be used. As discussed in greater detail below, in some embodiments it is preferred that the resin binder include functional groups that are chargeable by proton transfer in an aqueous solution, e.g., carboxylic acid groups that are proton donors in water solutions. In some embodiments, suitable resin binders are styrene-acrylic copolymers having carboxylic acid groups that are proton donors to water, thereby acquiring a negative charge.

Suitable inks are described by the Applicant in the PCT application No. PCT/IB2013/051755 (Agent's reference LIP 11/001 PCT), which is included by reference as if fully set forth herein.

A specific embodiment of a suitable ink comprises:

| | |
|---|---|
| Carbon Black Mogul L (Cabot Corp., Boston, MA, USA) | 1.3% w/w |
| Joncryl HPD 296 (35.5% water solution) (BASF) | 35% w/w (12.5% of solid resin) |
| Glycerol (Aldrich) | 15% w/w |
| Zonyl FSO-100 | 0.2% w/w |
| Diethanolamine | 1% w/w |
| Water (distilled) | Balance to 100% |

The carbon black pigment, water, Joncryl HPD 296 and diethanolamone were mixed and milled using a homemade milling machine. The milling may be performed using any one of many commercially available milling machines deemed suitable by one of ordinary skill in the art. The progress of milling was controlled on the basis of particle size measurement (Malvern, Nanosizer). The milling was stopped when the particle size (D50) reached 70 nm. Then the rest of materials were added to the pigment concentrate and mixed. After mixing the ink was filtered through a 0.5 micron filter. The thus-made ink was found to have a viscosity of 9 cP and a surface tension of 24 mN/m.

Pretreatment

As is known to a person having ordinary skill in the art, it is convenient to apply the ink droplets directly to the image transfer surface of the release layer. Accordingly, in some embodiments, an intermediate transfer member including a release layer according to the teachings herein is used for printing as-is, that is to say, the ink droplets are directly applied to the image transfer surface of the release layer.

Although often such direct application of ink to the release layer gives acceptable printing results, it has been found that under some printing conditions using some aqueous ink compositions, the printing results are suboptimal.

Consider that an aqueous ink composition is applied to the image transfer surface of the release layer as droplets, e.g., by inkjetting. As a result of momentum, each (presumably close to spherical) droplet flattens upon impact with the image transfer surface. Subsequently, the surface tension and cohesion of the ink composition together with the hydrophobic properties of the image transfer surface causes each droplet to adopt a more spherical shape to reduce the area of contact with the image transfer surface of the release layer. This more spherical shape is considered to be at least a contributory reason for suboptimal printing results observed under certain conditions.

The Applicant has found that in some embodiments, superior printing results (in some embodiments, expressed in terms of ink-pixel sharpness and/or optical density of the image printed in the substrate) are obtainable by applying a pretreatment that covers the image transfer surface of the release layer with a layer of proton-accepting chemical agent, where the layer of chemical agent does not substantially change the wettability of the image transfer surface of the release layer.

Prior to application of the ink droplets to the image transfer surface, the proton-accepting chemical agent is applied to the image transfer surface of the release layer of the intermediate transfer member (e.g., by spraying or rolling) thereby forming a layer chargeable by proton transfer with the ink.

When the ink droplets are applied to the image transfer surface in the usual way, a proton transfer reaction occurs between the chemical agent of the pretreatment and the polymeric resin of the ink so these are oppositely charged, i.e., protons are transferred from the resin (that becomes negatively charged) to the chemical agent (that becomes positively charged). Without discussing potential reasons or mechanisms therefore, the charging, and electrostatic forces thus enabled, at least temporarily counteracts the tendency of the ink droplets to adopt a more spherical shape, so that the ink droplets adopt a more flattened and less spherical shape for a longer time. This longer time provides sufficient time for the aqueous carrier to be evaporated sufficiently so that the formed ink residue film is distributed over a greater surface area of the image transfer surface as if the droplet had adopted a more flattened shape. It has been found that all other things being equal, in some embodiments such ink residue film distribution provides superior printing results.

Accordingly, in some embodiments, the method of printing comprises: during a printing cycle when a specific image is printed on a specific substrate:

a. pretreating the release layer by applying a chemical agent to the image transfer surface of a release layer to form a layer of a proton-accepting chemical agent on the image transfer surface of the release layer of an intermediate transfer member;
b. applying one or more inks (each ink comprising coloring agent in a liquid carrier) as a plurality of ink droplets to form an ink image on the layer of chemical agent on the image transfer surface, so that protons are transferred from the ink droplets to the layer of chemical agent, thereby forming positive charges on the layer of chemical agent and negative counter-charges in the ink droplets;
c. while the ink image is being transported by the intermediate transfer member, evaporating the carrier to leave an ink residue film including the coloring agents on the image transfer surface of the release layer; and
d. transferring the residue film from the image transfer surface to the substrate, thereby printing the desired image on the substrate. In preferred embodiments, the inks are in an aqueous carrier and applied as droplets by ink jetting, in the usual way.

Suitable ink compositions include components bearing proton-donating functions such as carboxylic acid groups, acrylic acid groups or methacrylic acid groups on resins. The proton-accepting chemical agents are any suitable proton-accepting chemical agent. In some embodiments, the chemical agent is a polymer. In some embodiments, the chemical agent has an average molecular weight of at least 800 and preferably of at least 10,000 g/mole. In some embodiments, the chemical agent includes nitrogen atom-containing proton-accepting functional groups selected from primary, secondary, tertiary amines or quaternary ammonium salts. Typical such chemical agents include linear and branched polyethyleneimine, modified polyethyleneimine, guar hydroxylpropyltrimonium chloride, hydroxypropyl guar hydroxypropyl-trimonium chloride, vinyl pyrrolidone dimethylaminopropyl methacrylamide copolymer, vinyl caprolactam dimethylaminopropyl methacrylamide hydroxyethyl methacrylate, quaternized vinyl pyrrolidone dimethylaminoethyl methacrylate copolymer, poly(diallyldimethylammonium chloride), poly(4-vinylpyridine), and polyallylamine.

Such chemical agents are preferably applied to the release layer as liquids, for example, as a pretreatment solution, especially a pretreatment solution including water as a solvent. In some embodiments, the solution is a dilute solution, e.g., having not more than 1% (w/w) of the chemical agent.

In some embodiments, subsequent to application of the chemical agent as a solution, but prior to application of the ink, at least some and preferably substantially all of the solvent of the pretreatment solution is evaporated or otherwise removed from the image transfer surface of the release layer. Such evaporation is typically not a challenge, as the image transfer surface of the release layer is typically maintained at an elevated temperature (typically at least about 70° C.) to assist in evaporation of the ink solvent. Removal can be effected by blowing away the applied pretreatment solution by a stream of high pressure air.

In some embodiments, subsequent to application of the chemical agent (in a pretreatment solution), a layer of chemical agent is formed on the image transfer surface of the release layer, typically not than 20 nm thick, not more than 15 nm thick and even not more than 10 nm thick. In some embodiments, the amount of chemical agent making up the layer of chemical agent is not more than 50 mg/m$^2$, not more than 40 mg/m$^2$, not more than 30 mg/m$^2$, not more than 20 mg/m$^2$ and even not more than 10 mg/m$^2$.

Accordingly, in some preferred embodiments, for printing with an intermediate transfer member including a release layer according to the teachings herein is used with such pretreatment. Such pretreatment is described in detail in the PCT patent application No. PCT/IB2013/000757 (Agent's reference LIP 12/001 PCT) of the Applicant claiming priority, inter alia, from U.S. 61/607,537, both which are included by reference as if fully set forth herein.

EXAMPLES

Aspects of the teachings herein were experimentally demonstrated.

Methods

Testing of Abrasion Resistance

The abrasion resistance of the release layer of embodiments of intermediate transfer members prepared was tested by measuring Gloss Loss:

3M Scotch® transparent tape was used to remove dust particles from the image transfer surface of the release layer of a swatch of the intermediate transfer member.

The gloss of the thus-cleaned image transfer surface was measured using a hand-held gloss meter (BYK-Gardner USA, Columbia, Md., USA) at a 75° angle of incidence. Gloss was measured at 3 different locations on the image transfer surface. "Original Gloss" was calculated as the average of the three measurements.

The swatch of intermediate transfer member was mounted on the sample stage of a "Rub-Test" abrasion tester (Test Machine Inc.) fitted with 3M 261×9 μm Lapping Film.

The abrasion tester was operated at 1000 cycles at a load of 1 kgf.

The swatch was removed and "Abraded Gloss" measured again as described above.

The Gloss Loss was calculated as:

$$\text{Gloss Loss}=100-((\text{OriginalGloss}-\text{Abraded Gloss})/\text{OriginalGloss})\times 100$$

Printing

Ink Composition

The following materials were used to make an ink composition:

| | |
|---|---|
| Carbon Black Mogul L (Cabot Corp., Boston, MA, USA) | 1.3% w/w |
| Joncryl HPD 296 (35.5% water solution) (BASF) | 35% w/w (12.5% of solid resin) |
| Glycerol (Aldrich) | 15% w/w |
| Zonyl FSO-100 | 0.2% w/w |
| Diethanolamine | 1% w/w |
| Water (distilled) | Balance to 100% |

The carbon black pigment, water, Joncryl HPD 296 and diethanolamone were mixed and milled using a homemade milling machine. The milling may be performed using any one of many commercially available milling machines deemed suitable by one of ordinary skill in the art. The progress of milling was controlled on the basis of particle size measurement (Malvern, Nanosizer). The milling was stopped when the particle size (D50) reached 70 nm. Then the rest of materials were added to the pigment concentrate and mixed. After mixing the ink was filtered through a 0.5 micron filter. The thus-made ink was found to have a viscosity of 9 CP and a surface tension of 24 mN/m.

Release-Layer Pretreatment Solution

Commercially-available PEI (polyethylenimine) having an average molecular weight of 25,000 g/mole (as Lupasol® WF from BASF Corporation, Florham Park, N.J., USA; CAS 9002-98-6) was diluted with triple-distilled water to give a 0.2% w/w PEI release layer pretreatment solution.

Printing

To test the printing performance of a given embodiment of an intermediate transfer member having a release layer in accordance to the teachings herein, an intermediate transfer member was fashioned as a patch of approximately 200 mm×300 mm. The patch was fixed image transfer surface facing upwards to a hotplate (with clamps) that was heated to 130° C.

A 1 micrometer thick layer of the release-layer pretreatment solution was applied to completely cover the image transfer surface of the release layer. Specifically, the solution was sprayed at the image transfer surface of the release layer and then evened to the desired thickness using a chrome evening roller.

After about 30 seconds, the solvent of the release-layer pretreatment solution had evaporated leaving a nanometric layer of PEI as a chemical agent coating the image transfer surface of the release layer.

An ink cartridge of a Dimatic DMP-2800 inkjet printer (Fujifilm, Akasaka, Minato, Tokyo, Japan) was charged with the ink composition.

The printer was used, in the usual way to deposit a plurality of 10 picoliter ink droplets on the image transfer surface of the release layer, forming an ink image.

After about 30 seconds, the aqueous carrier of the ink had evaporated, living an ink residue film on the image transfer surface of the release layer.

An A4 (210 mm×297 mm) sheet of 135 gram paper (gloss, Condat, le Plessis Robinson, France) was wrapped around a 210 mm long-48 mm radius stainless steel cylinder. The cylinder with paper was manually rolled along the image transfer surface of the release layer so that the ink residue film was transferred to the paper.

To evaluate the print quality, the optical density of the ink transferred to the paper was measured (Model 528 Spectro-Densitometer, X-Rite, Grand Rapids, Mich., USA).

Effect of Pretreatment on Print Quality

The optical density of the ink transferred to the paper as described above was compared to the optical density of the ink transferred in substantially the same way using the same ink composition and same image transfer surface of the same release layer, but without the pretreatment that applied the PEI chemical agent. The optical density of the ink was found to be 2.4 times greater when using the pretreatment.

Testing Transfer of Residue Film from a Release Layer

As discussed above, after ink droplets are applied to a release layer and the ink carrier evaporated, it is necessary to transfer the resulting residue film to the substrate to effect printing. Generally, it is preferred that an image transfer surface of a release layer have a high releasability of an ink residue film to ensure complete transfer of the residue film to the substrate. To evaluate the releasability of ink from image transfer surfaces of release layers according to the teachings herein the following method was used.

An ink residue film was formed on the image transfer surface of a release layer to be tested, substantially as described above. Abutting lengths of 25 mm wide standard pressure-sensitive adhesive tape (Tesa 7475) was applied by light finger pressure on top of the residue film to completely cover the release layer. The release layer with residue film and tape was cleanly cut into 25 mm wide 175 mm long test strips using a sharp knife. Each test strip was rolled twice in each direction using a FINAT test roller at a speed of approximately 10 mm per second. Each thus-rolled test strip was fixed in a tensile tester, and the tensile tester activated to strip the tape from the release layer at an angel of peel of 180° at a rate of 300 mm per minute, with release force measured at 10 mm intervals. The average of 5 measurements was calculated.

Bonding Elastomers to Rubber Surface

To demonstrate the efficacy of attaching an elastomer layer comprising at least one cross-linked silicone-related polymer to an at least partially cured rubber surface according to the teachings herein, embodiments of the curable adhesive composition as described herein were used to adhere a fluid curable composition comprising at least one silicone-related polymer to a cured acrylic (ACM) rubber layer constituting the uppermost layer of the body of an intermediate transfer member. The ACM rubber was cured, in the usual way, using a combination of sodium stearate and quaternary ammonium salts. Prior to the experiments, the body samples were held at 150° C. for 20 hours to ensure full curing of the acrylic rubber layer.

Abrasion resistance of the elastomer layers was tested as described above.

Adhesion of the elastomer layers to the acrylic rubber layer was tested by rubbing with a finger. Results were given based on a scale from 1 to 4, wherein:

1=poor adhesion (elastomer easily removed from the rubber, rubber surface visible after rubbing);

2=fair adhesion (elastomer removed with difficulty, rubber surface partially to totally visible after rubbing);

3=good adhesion (elastomer removed with great effort, only small or localized areas of the rubber layer are visible); and 4=excellent adhesion (elastomer cannot be removed with rubbing).

Example 1: Adhesive Composition 1

Fluid curable composition A was formulated by combining silanol-terminated 700-800 cSt polydimethylsiloxane (DMS S-27, Gelest), 9% (of the weight of the silicone) ethylpolysilicate (PSI023, Gelest or Ethylsilicate 48, Colcoat); and 1% (of the weight of the silicone) dioctyl tin bis(acetylacetonate) (CAS No. 54068-28-9, Tib Kat® 223, TIB).

Thermal Curing Adhesive Composition 1

A curable adhesive composition 1 was prepared by combining:

| Organosilane | | |
|---|---|---|
| glycidoxypropyl trimethoxysilane | Dynasylan ® Glymo (Evonik) | 48.4% mol |
| methacryloxypropyl trimethoxysilane | Dynasylan ® Memo (Evonik) | 41% (mol) |
| Condensation cure catalyst | | |
| titanium diisoproposy (bis-2,4-pentanedionate) | Tyzor AKT855 (Gelest) | 7% (mol) |
| Thermally activated material/organosilane | | |
| 6-azidosulfonylhexyl triethoxysilane | SIA0780 (Gelest) | 3.6% (mol) |

Curing Method I: Curing of Adhesive Composition Prior to Application of Curable Polymer Composition A uniform 1 to 5 micrometer thick layer of adhesive composition 1 was applied to an upper face of a 20 cm by 20 cm sheet of the ACM rubber sheet using a Meyer rod.

The rubber sheet with applied adhesive composition 1 was placed in a curing oven and maintained at an elevated temperature of 120° C. for 5 minutes during which time the azido function of the thermally activated material decomposed, generating free radicals that initiated reactions that formed covalent bonds between the organosilane components of the adhesive composition and the cured acrylic rubber.

Subsequently, the rubber sheet was removed from the curing oven and allowed to cool to room temperature (i.e., about 23° C.). A uniform 5 to 100 μm thick layer of the fluid silicone polymer precursor composition was applied on top of the layer of the adhesive composition. The laminated structure comprising the rubber sheet with the layer of adhesive composition 1 and the layer of fluid curable composition A was allowed to cure 20 hours at room temperature, during which time curable composition A cured to form a solid elastomer bonded to the rubber through the cured adhesive composition 1. The thus partially-cured laminated structure was placed in a curing oven maintained at 140° C. for 1 hour to ensure full curing. The thus fully-cured laminated structure was allowed to cool.

Adhesion was tested and rated at 4 "excellent" according to the above scale.

Results of abrasion resistance are presented in Table 1.

Curing Method II: Curing of Adhesive Composition Subsequent to Application of Polymer Composition As described above, a uniform 1 to 5 micrometer thick layer of adhesive composition 1 was applied to an upper face of a 20 cm by 20 cm (150-250 μm) sheet of a cured acrylic (ACM) rubber layer. A uniform 5 to 100 micrometer thick layer of the fluid curable composition A was applied on top of the uncured layer of adhesive composition 1.

The rubber sheet with the applied composition layers was left for 1 hour at room temperature to ensure that adhesive composition 1 and curable composition A. Then the incipient laminated structure was placed in a curing oven and maintained at an elevated temperature of 140° C. for 1 hour during which time the azido function of the thermally activated material decomposed, generating free radicals that initiated reactions that formed covalent bonds between organosilane components of the adhesive composition and the cured acrylic rubber surface. The fluid curable composition cured to form a solid elastomer layer where the organosilane components of adhesive composition 1 bonded to the elastomer layer through the respective alkoxysilane functions. The thus fully-cured laminated structure was allowed to cool.

Adhesion was tested and rated at 4 "excellent" according to the above scale. Results of abrasion resistance are presented in Table 1.

TABLE 1

| Gloss (75°) | Abrasion cycles numbers | | | | | | Gloss Loss |
|---|---|---|---|---|---|---|---|
| Adhesive 1 | 0 | 200 | 400 | 600 | 800 | 1000 | % |
| curing method I | 88.5 | 86.8 | 84.4 | 82.1 | 79.3 | 76.8 | 13.3 |
| curing method II | 88.5 | 87.1 | 86.1 | 84.8 | 83.7 | 81.9 | 7.5 |

Example 2: Adhesive Composition 2

A curable adhesive composition 2 was prepared by combining:

| organosilane | | |
|---|---|---|
| glycidoxypropyl trimethoxysilane | Dynasylan Glymo (Evonik) | 48.4% mol |
| methacryloxypropyl trimethoxysilane | Dynasylan MEMO (Evonik) | 46% mol |

-continued

| Condensation cure catalyst | | |
|---|---|---|
| dibutyl tin dilaurate | (Sigma-Aldrich) | 2% mol |
| Thermally activated material/organosilane | | |
| 6-azidosulfonylhexyl triethoxysilane | SIA0780 (Gelest) | 3.6% mol |

Adhesion of curable composition A to the rubber surface using adhesive composition 2 using both curing methods I and II was tested as described above for adhesive composition 1. The results for adhesive composition 2 were substantially identical to those of adhesive composition 1.

Example 3: Adhesive Composition 3

A curable adhesive composition 3 was prepared by combining (per mol):

| Organosilane | | |
|---|---|---|
| glycidoxypropyl trimethoxysilane | Dynasylan ® Glymo (Evonik) | 31.1% |
| Vinyltrimethoxysilane | Dynasylan ® Memo (Evonik) | 49.5% |
| Condensation cure catalyst | | |
| titanium diisoproposy (bis-2,4-pentanedionate) | Tyzor AKT855 (Gelest) | 4.7% |
| Thermally activated material (peroxide) | | |
| Dibenzoyl peroxide | BP 75% water (ACROS) | 2.7% |
| Water* from peroxide | | 12% |

Fluid curable composition B was formulated by combining polydimethylsiloxane silanol-terminated 700-800 cSt (DMS S-27, Gelest), 7% (of the weight of the silicone) ethylpolysilicate (PSI023, Gelest or Ethylsilicate 48, Colcoat); 6% (of the weight of the silicone) of Oleic Acid (CAS No 112-80-1, JT Baker) and 1.6% (of the weight of the silicone) dibutyl tin dilaurate (CAS No. 77-58-7, Sigma Aldrich).

A uniform 1 to 5 micrometer thick layer of adhesive composition 3 was applied to an upper surface of a 20 cm by 20 cm sheet of a cured acrylic (ACM) rubber using a Meyer rod.

In accordance with curing method I, the rubber sheet with applied adhesive composition 3 was placed in a curing oven and maintained at an elevated temperature of 90° C. for 2 minutes during which time the dibenzoyl peroxide material decomposed, generating free radicals that initiated reactions that formed covalent bonds between organosilane components of the adhesive composition and the cured acrylic rubber.

Subsequently, the rubber sheet was removed from the curing oven and allowed to cool to room temperature. A uniform 5 to 100 μm thick layer of the fluid curable composition B was applied on top of the layer of the adhesive composition. The incipient laminated structure comprising the rubber sheet with the applied layers was allowed to cure 1 hour at room temperature, during which time the fluid curable composition B cured to form a solid elastomer where which the organosilane components of adhesive composition 3 bonded to the elastomer through the respective alkoxysilane functional groups.

The thus partially-cured laminated structure was placed in a curing oven maintained at 140° C. for 1 hour to ensure full curing. The thus fully-cured laminated structure was allowed to cool. Adhesion was tested and rated at 4 "excellent" according to the above scale.

Example 4: Adhesive Composition 4, Curing Method I

A silane-terminated polymer (STP) fluid curable composition was bonded to a cured acrylic (ACM) rubber layer using a thermal curing adhesive composition.

STP fluid curable composition C was prepared by combining a silane-terminated polypropylene glycol polymer of 20 000 MPa·s viscosity (ST XP 2/1228 grade, Hanse Chemie), 0.5% (of the weight of the STP polymer) of BYK®-333 (BYK) silicone surfactant additive (for wettability and leveling), 2% (of the weight of the STP polymer) of polydimethylsiloxane silanol-terminated 700-800 cSt (DMS S-27, Gelest), 5% (of the weight of the STP polymer) of ethylpolysilicate (PSI023, Gelest or Ethylsilicate 48, Colcoat); and 2% (of the weight of the silicone) of dibutyl tin dilaurate 95% (CAS 77-58-7, Sigma Aldrich).

Thermal Curing Adhesive Composition 4

A curable adhesive composition 4 was prepared by combining (per mol):

| | | |
|---|---|---|
| Organosilane | | |
| glycidoxypropyl trimethoxysilane | Dynasylan ® Glymo (Evonik) | 41% |
| methacryloxypropyl trimethoxysilane | Dynasylan ® Memo (Evonik) | 34.7% |
| Condensation cure catalyst | | |
| titanium diisoproposy (bis-2,4-pentanedionate) | Tyzor AKT855 (Gelest) | 5.9% |
| Thermally activated material (peroxide) | | |
| Dibenzoyl peroxide | BP 75% water (ACROS) | 3.3% |
| Water * from peroxide | | 15% |

Curing Method I: Curing of Adhesive Composition Prior to Application of Curable Polymer Composition A uniform 1 to 5 micrometer thick layer of adhesive composition 4 was applied to an upper face of a 20 cm by 20 cm sheet of sheet of a cured acrylic (ACM) rubber layer using a Meyer rod.

The rubber sheet with applied adhesive composition 4 was placed in a curing oven and maintained at an elevated temperature of 100° C. for 5 minutes during which time the dibenzoyl peroxide material decomposed, generating free radicals that initiated reactions that formed covalent bonds between organosilane components of the adhesive composition and the cured acrylic rubber.

Subsequently, the rubber sheet was removed from the curing oven and allowed to cool to room temperature. A uniform 5 to 100 μm thick layer of STP fluid curable composition C was applied on top of the layer of the composition. The laminated structure comprising the rubber sheet with the layers was allowed to cure 20 hours at room temperature, during which time curable composition C cured to form a solid elastomer layer where the organosilane components of adhesive composition 4 bonded to the silicone polymer layer through the respective alkoxysilane functions.

The thus partially-cured laminated structure was placed in a curing oven maintained at 80° C. for 1 hour, then at 120° C. for 1 hour, and finally at 150° C. for 1 hour to ensure full curing. The thus fully-cured laminated structure was allowed to cool. Adhesion was tested and rated at 3 "good" according to the above scale. Abrasion resistance was tested, and the results presented in Table 2.

TABLE 2

| Gloss (75°) | Abrasion cycles numbers | | | | | | Gloss Loss |
|---|---|---|---|---|---|---|---|
| Adhesive 4 STP 1 | 0 | 200 | 400 | 600 | 800 | 1000 | % |
| curing method I | 92.0 | 90.4 | 89.2 | 87.5 | 87.5 | 86.9 | 5.6 |

Example 5: Adhesive Composition 4, Curing Method II

As for Example 4, but using curing method II: curing of adhesive composition 4 subsequent to the application of STP fluid curable composition C.

As described above, a uniform 1 to 5 micrometer thick layer of adhesive composition 4 was applied to an upper face of a 20 cm by 20 cm (150-250 μm) sheet of a cured acrylic (ACM) rubber layer. A uniform 5 to 100 micrometer thick layer of STP fluid curable composition C was applied on top of the uncured layer of adhesive composition 4.

The rubber layer with applied layers was partially cured for 20 hours at room temperature. The partially cured laminated structure was placed in a curing oven and maintained at an elevated temperature of 80° C. for 1 hour, then at 120° C. for 1 hour and finally at 150° C. for 1 hour to ensure decomposition of dibenzoyl peroxide, generating free radicals that initiated reactions that formed covalent bonds between organosilane components of the adhesive composition 4 and the cured acrylic rubber and to achieve full curing. The thus fully-cured laminated structure was allowed to cool.

Adhesion was tested and rated at 1 "poor" according to the above scale. The failure of adhesion can be attributed to the presence of water that degraded the urethane link of the STP polymer during heating. The best results of adhesion were obtained when the water in the adhesive was removed before applying the STP fluid curable composition.

Example 6: Adhesive Composition 6

This example tested adhesion of STP fluid curable composition C using a thermal curing adhesive composition where the Dynasylan MEMO was replaced by Dynasylan VTMO (Vinyltrimethoxysilane) (CAS 2768-02-7)

Thermal Curing Adhesive Composition 6 (Per Mol)

| | | |
|---|---|---|
| Organosilane | | |
| glycidoxypropyl trimethoxysilane | Dynasylan ® Glymo (Evonik) | 33.3% |
| Vinyltrimethoxysilane | Dynasylan ® VTMO (Evonik) | 47.1% |
| Condensation cure catalyst | | |
| titanium diisoproposy (bis-2,4-pentanedionate) | Tyzor AKT855 (Gelest) | 4.8% |
| Thermally activated material (peroxide) | | |
| Dibenzoyl peroxide | BP 75% water (ACROS) | 2.7% |
| Water * from peroxide | | 12.1% |

A laminated structure of a layer of cured STP fluid curable composition C attached to a sheet of cured acrylic rubber with adhesive composition 6 was prepared using curing method I, substantially as described above.

Adhesion was tested and rated at 3 "good" according to the above scale.

Example 7: Adhesive Composition 6, Curing Method II

A laminated structure of a layer of cured STP fluid curable composition C attached to a sheet of cured acrylic rubber with adhesive composition 6 was prepared using curing method II, substantially as described above.

Adhesion was tested and rated at 1 "poor" according to the above scale, confirming the negative effect of water on STP polymers during the heating Example 8: Adhesive Composition 4, Dilute Polymer Precursor Composition Dilute STP polymer precursor composition D was formulated by combining a silane-terminated polypropylene glycol polymer of 20,000 MPa·s viscosity (ST XP 2/1228 grade from Hanse Chemie), 20% (of the weight of the STP polymer) of Ethyl Acetate, 0.5% (of the weight of the STP polymer) of BYK-333 (BYK) silicone surfactant additive (for wettability and leveling), 2% (of the weight of the STP polymer) of polydimethylsiloxane silanol-terminated 700-800 cSt (DMS S-27, Gelest), 5% (of the weight of the STP polymer) of ethylpolysilicate (PSI023, Gelest or Ethylsilicate 48, Colcoat); and 2% (of the weight of the silicone) of dibutyl tin dilaurate 95% (CAS 77-58-7, Sigma Aldrich).

A laminated structure of a layer of cured dilute STP fluid curable composition D attached to a sheet of cured acrylic rubber with adhesive composition 4 was prepared using curing method I, substantially as described above. Adhesion was tested and rated at 3 "good" according to the above scale.

Example 9: Adhesive Composition 6, Dilute Polymer Precursor Composition

A laminated structure of a layer of cured dilute STP fluid curable composition D attached to a sheet of cured acrylic rubber with adhesive composition 6 was prepared using curing method I, substantially as described above. Adhesion was tested and rated at 3 "good" according to the above scale.

Example 10: Adhesive Composition 10

Adhesive composition 10 was prepared by combining:

| | | |
|---|---|---|
| Condensation cure catalyst | | |
| dibutyl tin dilaurate | (Sigma-Aldrich) | 2% mol |
| Thermally activated material/organosilane | | |
| 6-azidosulfonylhexyl triethoxysilane | SIA0780 (Gelest) | 3.5% mol |
| Diluent | | |
| Mixture of o-, m- and p-Xylene | 214736 (Sigma-Aldrich) | 94.5% mol |

A uniform 1 to 5 micrometer thick layer of adhesive composition 10 was applied to an upper face of a 20 cm by 20 cm sheet of the ACM rubber sheet using a Meyer rod.

The rubber sheet with applied adhesive composition 10 was placed in a curing oven and maintained at an elevated temperature of 120° C. for 5 minutes during which time the azido function of the thermally activated material decomposed, generating free radicals that initiated reactions that formed covalent bonds between organosilane components of the adhesive composition and the cured acrylic rubber.

Subsequently, the rubber sheet was removed from the curing oven and allowed to cool to room temperature (i.e. about 23° C.). A uniform 5 to 100 μm thick layer of the fluid curable silicone polymer composition A was applied on top of the layer of the adhesive composition.

The laminated structure comprising the rubber sheet with the layer of adhesive composition 10 and the layer of fluid curable composition A was allowed to cure 20 hours at room temperature, during which time curable composition A cured to form a solid elastomer bonded to the rubber through the cured adhesive composition 10.

The thus partially-cured laminated structure was placed in a curing oven maintained at 140° C. for 1 hour to ensure full curing. The thus fully-cured laminated structure was allowed to cool.

Adhesion was tested and rated at 3 "good" according to the above scale.

Example 11: Adhesive Composition 11 (Thermally Activated Material is an Azo Compound)

Adhesive composition 11 was prepared by combining (per mol):

| | | |
|---|---|---|
| Organosilane | | |
| glycidoxypropyl trimethoxysilane | Dynasylan ® Glymo (Evonik) | 44.1% |
| methacryloxypropyl trimethoxysilane | Dynasylan ® Memo (Evonik) | 37.3% |
| Condensation cure catalyst | | |
| titanium diisoproposy (bis-2,4-pentanedionate) | Tyzor AKT855 (Gelest) | 6.4% |
| Thermally activated material (Azo compound) | | |
| 2,2 Azobis(2-methylpropionitrile) [solution 0.2M in Toluene] | (Sigma Aldrich) | 0.3% |
| Toluene | | 12.1% |

Fluid curable composition E was prepared by combining polydimethylsiloxane silanol-terminated 700-800 cSt (DMS S-27, Gelest), 7% (of the weight of the silicone) ethylpolysilicate (PSI023, Gelest or Ethylsilicate 48, Colcoat); 3% (of the weight of the silicone) of Oleic Acid (CAS No 112-80-1, JT Baker) and 1.6% (of the weight of the silicone) dibutyl tin dilaurate (CAS No. 77-58-7, Sigma Aldrich).

A laminated structure of a layer of fluid curable composition E attached to a sheet of cured acrylic rubber with adhesive composition 11 was prepared using curing method I. The rubber sheet with applied adhesive composition 11 was placed in a curing oven and maintained at an elevated temperature of 120° C. for 5 minutes during which time the 2,2'-Azobis(2-methylpropionitrile) material decomposed, generating $N_2$ and free radicals that initiated reactions that formed covalent bonds between organosilane components of the adhesive composition 11 and the cured acrylic rubber.

Subsequently, the rubber sheet was removed from the curing oven and allowed to cool to room temperature. A uniform 5 to 100 μm thick layer of fluid curable composition E was applied on top of the layer of the adhesive composition. The laminated structure comprising the rubber sheet with the layers was allowed to cure 1 hour at room temperature, during which time fluid curable composition E cured to form a solid elastomer layer where the organosilane components of adhesive composition 11 bonded to the silicone polymer layer through the respective alkoxysilane functions. The thus partially-cured laminated structure was placed in a curing oven maintained at 140° C. for 1 hour to ensure full curing of the fluid silicone polymer precursor composition. The thus fully-cured laminated structure was allowed to cool.

Adhesion was tested and rated at 3 "good" according to the above scale. Abrasion resistance was tested and results presented in Table 3.

TABLE 3

| Gloss (75°) | Abrasion cycles numbers | | | | | | Gloss Loss |
|---|---|---|---|---|---|---|---|
| Adhesive 11 | 0 | 200 | 400 | 600 | 800 | 1000 | % |
| curing method I | 87.5 | 79.6 | 76.6 | 74.0 | 72.3 | 71.6 | 18.2 |

Example 12: Adhesive Composition 12

Fluid curable composition F was prepared by combining polydimethylsiloxane silanol-terminated 700-800 cSt (DMS S-27, Gelest), 10% (of the weight of the silicone) ethylpolysilicate (PSI023, Gelest or Ethylsilicate 48, Colcoat); and 0.8% (of the weight of the silicone) dioctyl tin bis(acetylacetonate) (CAS No. 54068-28-9, Tib Kat® 223, TIB).

Adhesive composition 12 was prepared by combining 95% 3-Aminopropyl-triethoxysilane and 5% azidosulfonylhexyltriethyoxysilane. As described above, a uniform 1 to 5 micrometer thick layer of adhesive composition 12 was applied to an upper face of a 20 cm by 20 cm (150-250 μm) sheet of a cured acrylic (ACM) rubber layer.

A uniform 5 to 100 micrometer thick layer of fluid curable composition F was applied on top of the uncured layer of adhesive composition 12. The rubber sheet with applied layers was partially cured for 1 h at room temperature and then placed in a curing oven and maintained at an elevated temperature of 140° C. for 1 hour as described above. The thus fully-cured laminated structure was allowed to cool.

Adhesion was tested and rated at 4 "excellent" according to the above scale.

Example 13: Adhesive Composition 13

Adhesive composition 13 was formulated by combining 95% 3-Aminopropyl-triethoxysilane (Dynasylan® AMEO, Evonik) and 5% 6-azidosulfonylhexyl triethoxysilane (SIA0780, Gelest).

Fluid curable composition G was prepared by combining GP 657 (Genesee), GP 397 (Genesee), PSI-021 (Gelest) and benzenepropanoic acid, 3,5-bis(1,1-dimethylethyl)-4-hydroxy-C7-C9 branched alkyl ester (Irganox® 1135, Ciba/BASF).

As described above, a uniform 1 to 5 micrometer thick layer of adhesive composition 13 was applied to an upper face of a 20 cm by 20 cm (150-250 μm) sheet of a cured acrylic (ACM) rubber layer. A uniform 5 to 100 micrometer thick layer of fluid curable composition G was applied on top of the uncured layer of adhesive composition 13. The rubber sheet with applied layers was partially cured for 1 h at room temperature and then placed in a curing oven and maintained at an elevated temperature of 140° C. for 1 hour. The thus fully-cured laminated structure was allowed to cool.

Adhesion was tested and rated at 4 "excellent" according to the above scale.

Example 14: Adhesive Composition 14

Curable adhesive layer composition 14 was formulated by combining 95% 3-Aminopropyltriethoxysilane (Dynasylan® AMEO, Evonik) and 5% 2-hydroxy 2-methyl 1-phenyl 1-propanol photoinitiator (Darocur® 1173 from Ciba/BASF).

As described above, a uniform 1 to 5 micrometer thick layer of adhesive composition 14 was applied to an upper face of a 20 cm by 20 cm (150-250 μm) sheet of a cured acrylic (ACM) rubber layer. A uniform 5 to 100 micrometer thick layer of fluid curable composition G was applied on top of the uncured layer of adhesive composition 14.

The rubber sheet with applied layers was partially cured for 1 h at room temperature and then 7 minutes with infrared heating, then placed in a curing oven and maintained at an elevated temperature of 140° C. for 1 hour. The thus fully-cured laminated structure was allowed to cool. Adhesion was tested and rated at 4 "excellent" according to the above scale.

Curable Polymer Compositions and Intermediate Transfer Member Release Layers

As detailed below, a number of curable polymer compositions according to the teachings herein were prepared.

Sheets of blanket bodies were acquired from Trelleborg including:

a) a 40 micrometer thick low-friction inner layer;
b) contacting a 250 micrometer thick reinforcement layer including a 200 micrometer thick woven 200 gram cotton fabric impregnated with ACM rubber;
c) contacting a 350 micrometer thick compressible layer of ACM rubber sponge (P=2 kg/cm$^2$);
d) contacting a 100 micrometer conductive layer of rubber having a resistivity of 500 Ohm/cm; and
e) contacting a 100 micrometer conformational layer of soft cured ACM rubber, of 30 Shore A.

The upper surface of conformational layer of cured acrylic rubber defined the surface to which embodiments of release layers according to the teachings herein were attached, with or without the use if adhesive. Before use, the bodies were held in a curing oven maintained at 150° C. for 20 hours to ensure complete curing of conformational layer.

Silanol-Terminated Polydialkyl Silicone Release Layers (Table 4)

Three curable polymer compositions including a silanol-terminated polymer #1, #2 and #3 were made as described in Table 4, including DMS S-27 (Gelest) or Silopren E0.7 (Momentive) silanol-terminated polydimethylsiloxane, 9% (of the weight of the silicone related polymer) polyethylsilicate crosslinker, and 1% (of the weight of the silicone related polymer) dioctyl tin bis(acetylacetonate) fast-curing condensation catalyst. Composition #3 further included 2% oleic acid.

The pot life of compositions #1, #2 and #3, i.e., the period of time for which the uncured polymer composition remained flowable, was determined by weighing about 10 g of the composition into an aluminium plate and allowing it to cure at room temperature. Samples were withdrawn periodically with a pipette and checked for flowability.

To make an intermediate transfer member, a uniform 1 to 5 micrometer thick layer of a thermal-curing adhesive composition (example 1 above) was applied to the upper face of the conformation layer of the cured blanket bodies using a Meyer rod.

The polymer compositions #1, #2 and #3 were each applied as a uniform 10 to 15 micrometer thick layer using a Meyer rod on top of the uncured layer of thermal-curing adhesive composition to make a respective incipient blanket.

The incipient blankets was kept for 1 hour at room temperature and relative humidity between 30-70%, and then cured for 2 hours at 140° C. (or 1 hour at 150° C.), during which time the curable polymer composition cured to form an elastomer layer having a uniform thickness of between 10 and 15 μm of elastomer, as described herein, constituting a release layer of the blanket, that was adhered to the body portion by the cured adhesive composition. The thus fully-cured laminated structure was allowed to cool. The release layers were examined and demonstrated a very low level of contamination by dirt during the curing process, attributable to the short time required for curing.

A cured sample of each of the elastomers was weighed and then stored in a curing oven for 24 hours at 200° C. No substantial weight loss was noted after the 24 hours, indicating that the release layers made of the elastomers are thermally stable.

Adhesion of the release layers was tested by hand as described above. All three release layers #1, #2 and #3 were found to have excellent adhesions, see Table 4.

The apparent contact angle of a standing drop of distilled water, as well as the advancing and receding contact angles of a rolling drop of water were tested in the usual way, see Table 4.

The blankets were formed into a loop in the usual way and mounted in a printing system as described in co-pending PCT application No. PCT/IB2013/051716 (Agent's reference LIP 5/001 PCT). Prior to application of an ink composition, the release layer of each blanket was treated with 0.1% polyethylenimine in water solution as a protonatable chemical agent. Each one of release layers #1, #2 and #3 demonstrated superior printing performance using a ink compositions comprising a water carrier. Of particular note was the observed very high print quality as seen from images printed on paper and evaluated in the usual way. Further, the tested release layers exhibited exceptional abrasion resistance (i.e., Gloss Loss less than 10% after 1000 cycles), see Table 4.

The force required to transfer an ink residue film to an adhesive tape was tested as above, as a measure of releasability of ink applied to the surface (after treatment with the protonatable chemical agent). The force was found to be less than 0.04 N, indicative of excellent releasability.

TABLE 4

| Trials | Blanket #1 | Blanket #2 | Blanket #3 |
|---|---|---|---|
| DMS-S27 (silanol terminated polydimethylsiloxane, Gelest) | 100 | — | 100 |
| Silopren E0.7 (silanol terminated polydimethylsiloxane, Momentive) | — | 100 | — |
| Polyethylsilicate-48 | 9 | 9 | 9 |
| Oleic Acid (curing inhibitor) | — | — | 2 |
| condensation cure dioctyl tin bis (acetylacetonate), (TIB) | 0.8 | 0.8 | 0.8 |
| Pot life (minutes) | 47 | 60 | 300 |
| Release layer thickness (μ) | 10 | 12 | 15 |

TABLE 4-continued

| Trials | Blanket #1 | Blanket #2 | Blanket #3 |
|---|---|---|---|
| Initial Gloss % | 88.5 | 89 | 88.2 |
| Abrasion Gloss Loss % 75° after 1000 cycles | −4.70% | −5.70% | −3.2% |
| Adhesion (Hand) | 4 | 4 | 4 |
| Contact Angle (water RT) | 114-103 | 109.3-102 | 112-101 |
| Advancing Contact Angle (water RT) | 105-115 | 105-115 | 105-115 |
| Receding Contact Angle (Water RT) | 40-50 | 40-50 | 40-50 |
| Ink residue release force | <0.04N | <0.04N | <0.04N |
| Relative humidity (%) during curing at RT | 24 | 30 | 26 |

Silyl-Terminated Polyurethane and Polyether Release Layers (Table 5)

Four curable polymer compositions were made, two (#4, #5) including a silanol terminated polyurethane and two (#6, #7) including a silyl terminated polyether and 2% (of the weight of the silicone related polymer) dibutyl tin dilaurate fast-curing condensation catalyst.

To make an intermediate transfer member, a uniform 1 to 5 μm thick layer of an adhesive composition (Table 5) was applied to the upper face of the conformation layer of the cured blanket bodies using a Meyer rod. The polymer compositions #4, #5, #6 and #7 were each applied as a uniform 20 to 40 μm thick layer using a Meyer rod on top of the uncured layer of thermal-curing adhesive composition to make a respective incipient blanket.

The incipient blankets was kept for 1 hour at room temperature and relative humidity between 30-70%, and then cured for 2 hours at 140° C. (or 1 hour at 150° C.), during which time the curable polymer composition cured to form an elastomer layer having a uniform thickness of between 20 and 40 μm of elastomer, as described herein, constituting a release layer of the blanket, that was adhered to the body portion by the cured adhesive composition. The thus fully-cured laminated structure was allowed to cool. The release layers were examined and demonstrated a very low level of contamination by dirt during the curing process, attributable to the short time required for curing.

Results of the following tests are presented in Table 5, below. A cured sample of each of the elastomers was weighed and then stored in a curing oven for 24 hours at 150° C. The loss of weight of the elastomer gives a measure of the thermal stability.

Adhesion of the release layers was tested by hand as described above. Release layers #4, #5 and #6 were found to have fair adhesion and release layer #7 good adhesion. The apparent contact angle of a standing drop of distilled water, as well as the advancing and receding contact angles of a rolling drop of water were tested in the usual way. The blankets were mounted in a printer and formed into a loop as explained in previous experiment. Prior to application of an ink composition, the release layer of each blanket was treated with 0.1% polyethylenimine in water solution as a protonatable chemical agent. Each one of release layers #4, #5, #6 and #7 demonstrated superior printing performance using a ink compositions comprising a water carrier. However, the release of ink residue was insufficient. Specifically, a substantial amount if ink residue was left on the image transfer surface after a relatively low number of printing cycles.

The force required to transfer an ink residue film to an adhesive tape was tested as above, as a measure of releasability of ink applied to the surface (after treatment with the protonatable chemical agent). The force was found to be between 0.6 and 7 N, an unacceptably high releasability.

TABLE 5

| Trials | Blanket #4 | Blanket #5 | Blanket #6 | Blanket #7 |
|---|---|---|---|---|
| Adhesive | SS4179 (Momentive) | SS4179 (Momentive) | SS4179 (Momentive) | example 1, above |
| Desmoseal 2749 (silyl terminated polyurethane, Bayer) | 100 | — | — | — |
| SPUR 3200 HM (silyl terminated polyurethane, Momentive) | — | 100 | — | — |
| ST XP2/1228 (silyl terminated polyether) (Evonik) | — | — | 100 | 100 |
| DMS-S27 (silanol terminated polydimethylsiloxane, Gelest) | — | — | — | 2 |
| Polyethylsilicate-48 | — | — | 2 | 5 |
| Irganox 1141 (antioxidant, BASF) | 0.5 | 0.5 | 0.5 | — |
| BYK333 (surfactant, BYK) | 0.5 | 0.5 | 0.5 | 0.5 |
| condensation cure Dibutyl Tin Dilaurate (SigmaAldrich) | 2 | 2 | 2 | 2 |
| Release layer thickness (μ) | 20 | 34 | 30 | 38 |
| Initial Gloss % | 89 | 92 | 94 | 92 |
| Abrasion Gloss Loss % (75°) | −80% | −45% | −31% | −12% |
| Adhesion (Hand) | 2 | 2 | 2 | 3 |
| Contact Angle (water RT)* | 95 | 90 -> 80 after 2 min | 90 -> 80 after 2 min | 98 -> 85 |
| Advancing Contact Angle (water RT) | 88 | 94 | 90 | 90 |
| Receding Contact Angle (Water RT) | 26 | 35 | 30 | 30 |
| Ink residue release force | 0.6N | 0.8N | 6N | 6N |
| Thermal stability weight Loss after 24 h at 150 C. (%) (TGA) | −20% | −17% | −4% | −4% |
| printed dot size (μm) with 12 pl ink droplet | 60 | — | — | 58 |

Anisotropic Reinforcement Layers

Experiments relating to anisotropic reinforcement layers were performed. The results are summarized in Table 6, below.

Tensile Tests

Mechanical properties of anisotropic reinforcement layers according to the teachings herein were assessed using a tensile meter recording the elongation of a tested sample in any desired direction over time. Unless otherwise indicated the tests were performed under a constant load. A 3 cm wide strip of fabric constituting an anisotropic reinforcement layer was caught at both ends by gripping clamps. One end was hooked at a fixed position in the tensile meter. The other end of the tested strip of fabric was submitted to a constant load at a predetermined temperature. The initial length of the strip between the two clamps internal edges at rest was measured. The increasing distance between the clamps as a result of applied tension was monitored over time and plotted. The samples were typically tested with tension applied in the direction corresponding to the longitudinal (intended printing) direction of an intermediate transfer member in which such fabric would serve as reinforcement layer. Some samples were also tested in the lateral direction.

Control Sample—750N at 23° C.

A blanket intermediate transfer member comprising two plies of a woven cotton fabric was subjected to a constant load of 750N in the longitudinal direction at ambient temperature of about 23° C. This control sample corresponds to a body comprising a mildly anisotropic reinforcement layer, since the cotton fibers in the longitudinal direction (the direction of applied tension during the test) were prestretched during fabric manufacture in an attempt to prevent creep. The cotton fibers in the lateral direction were plain cotton fibers having natural elasticity.

Figure 17:
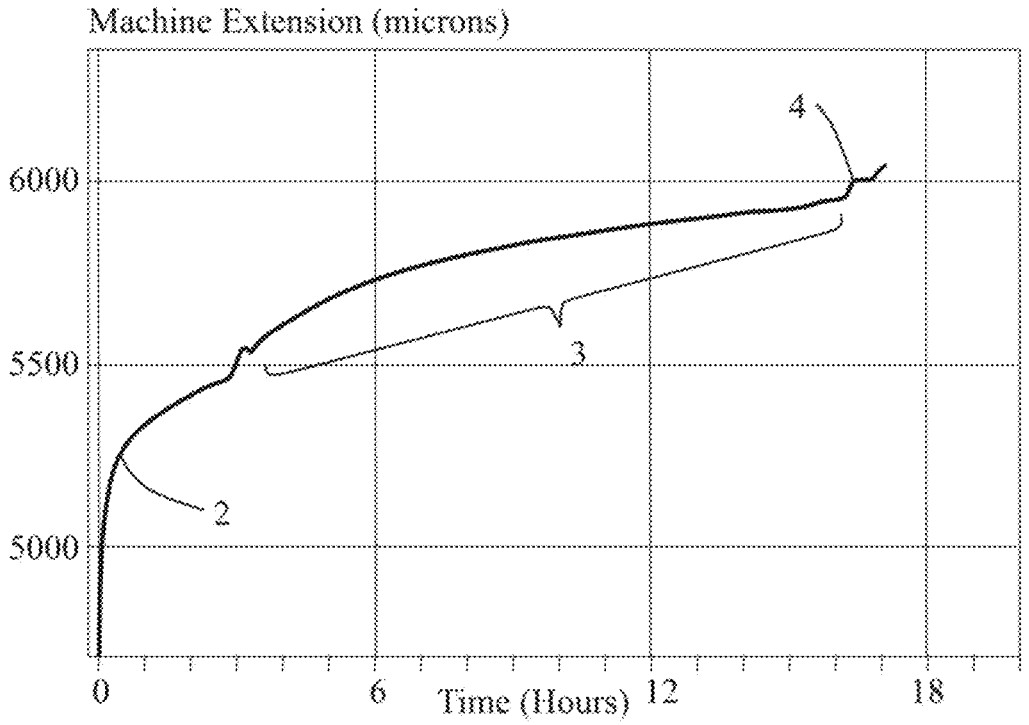
FIG. 17 is a graph showing elongation of a blanket with time with 750N tension at 23° C.

Results showing longitudinal elongation of the control sample with time are presented in FIG. 17. The first part of the graph showing rapid and substantial longitudinal elongation corresponds to the immediate extension of the sample and relates to the elastic properties of the longitudinal cotton fibers. The first "shoulder" in FIG. 17 (labeled 2) corresponds to the crimp of the control sample, i.e., the ability of a woven fabric to elongate without irreversible damage. The subsequent slope in FIG. 17 (labeled 3) corresponds predominantly to the creep of the sample, where each step in FIG. 17 on this slope (labeled 4) indicates partial tearing or creep failure. A vertical slope (as seen for tests at 150° C.) corresponds to final failure and tearing of the sample.

Control Sample—350N at 150° C.

Figure 18:
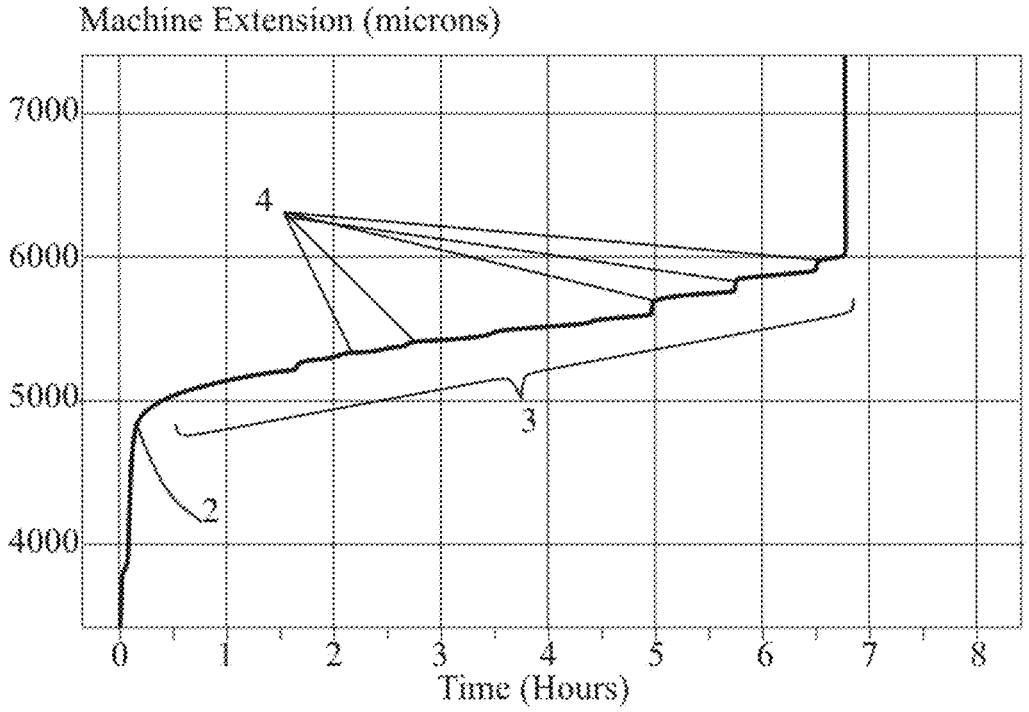
FIG. 18 is a graph showing elongation of a blanket with time with 350N tension at 150° C.

The control sample as described above was subjected to a constant tension of 350N in the longitudinal direction at an elevated temperature of about 150° C. Results showing elongation of the control sample with time is shown in FIG. 18.

Isolated Single Ply Fabric Layer

Figure 19:
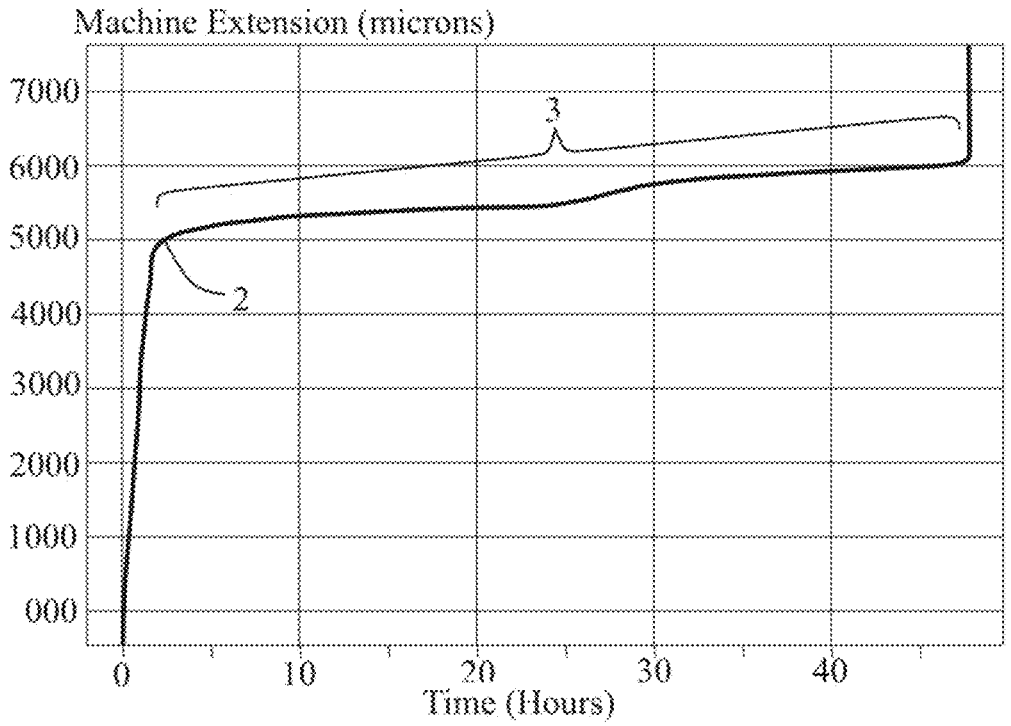
FIG. 19 is a graph showing elongation of an isolated single ply cotton fabric with time with 750N tension at 23° C.

An isolated (not part of a blanket) single ply cotton fabric (as used in the control sample) was subjected to a constant tension of 750N at 23° C. The single ply fabric failed in less than one hour, as shown in FIG. 19.

Single Ply Isotropic Kevlar® Fabric at 750N at 23° C.

Figure 20:
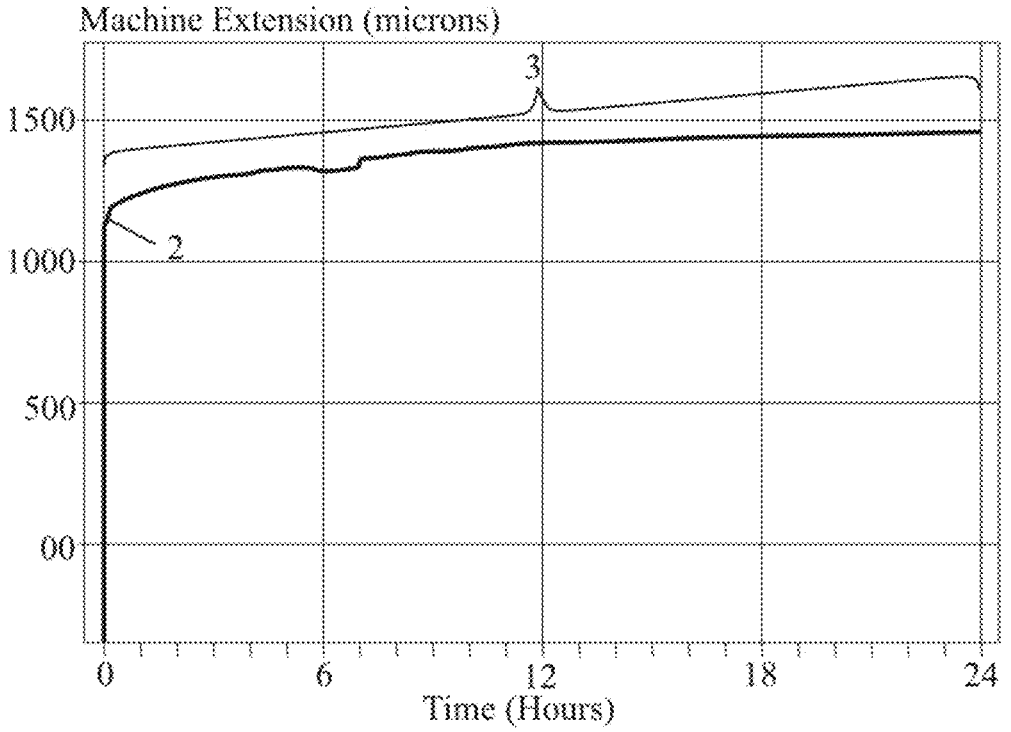
FIG. 20 is a graph showing elongation of a single ply isotropic Kevlar fabric with time with 750N tension at 23° C.

An isolated (not part of a blanket) single ply Kevlar® fabric was subjected to a constant tension of 750N at 23° C. Results are shown in FIG. 20.

Single Ply Isotropic Glass Fabric at 750N at 23° C.

Figure 21:
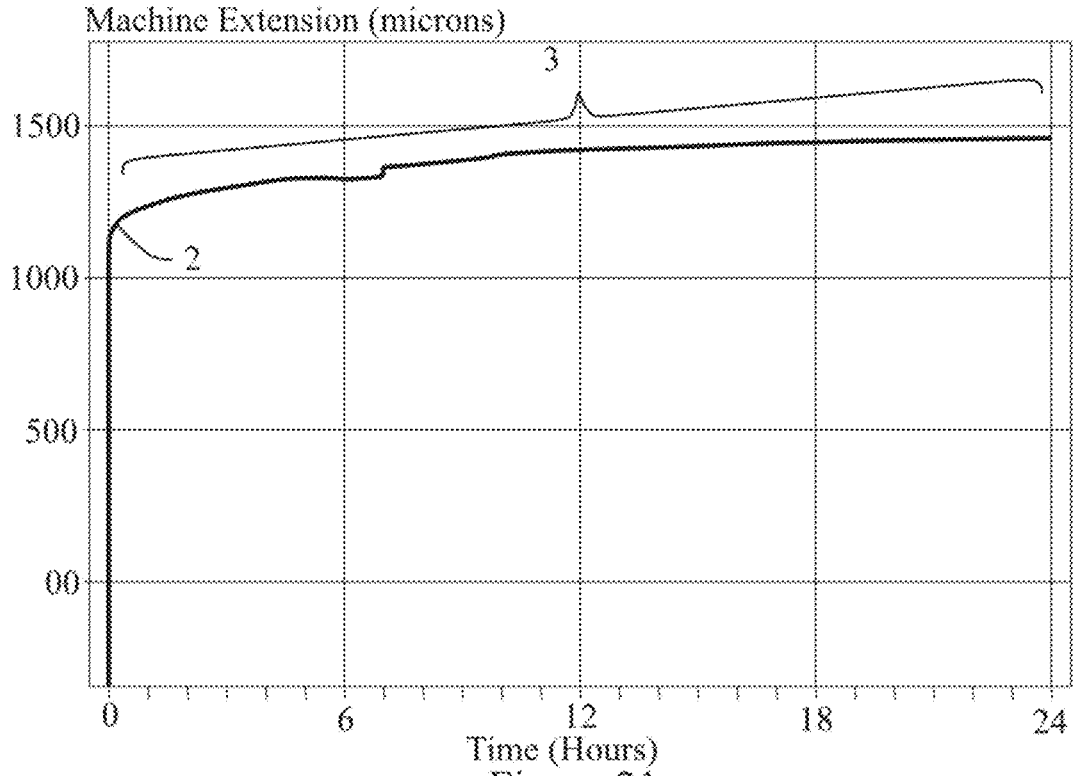
FIG. 21 is a graph showing elongation of a single ply isotropic glass fiber fabric with time with 750N tension at 23° C.

An isolated (not part of a blanket) single ply glass fabric was subjected to a constant tension of 750N at about 23° C. Results are shown in FIG. 21.

Anisotropic Hybrid Sample at 350N at 23° C., Longitudinal Direction

Figure 22:
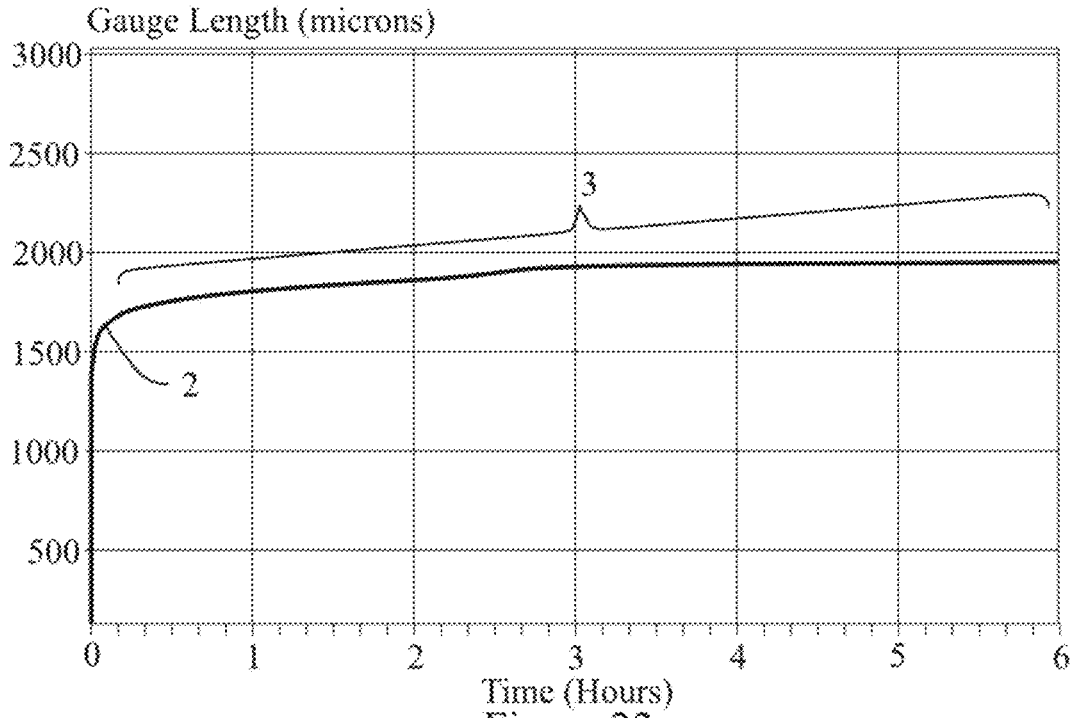
FIG. 22 is a graph showing elongation of a blanket including an anisotropic reinforcement layer according to the teachings herein with time with 350N in a longitudinal direction at 23° C.

A fabric comprising unidirectional glass fibers in the longitudinal direction (20 yarns per cm) and twisted polyamine fibers in the lateral direction (ca. 12 yarns per cm) was subjected to a constant tension of 350N at about 23° C. in the longitudinal direction, parallel to the glass fibers. The initial length of sample between the internal edges of the two grippers was 30 mm Results are shown in FIG. 22.

Anisotropic Hybrid Sample—350N at 23° C., Lateral Direction

Figure 23:
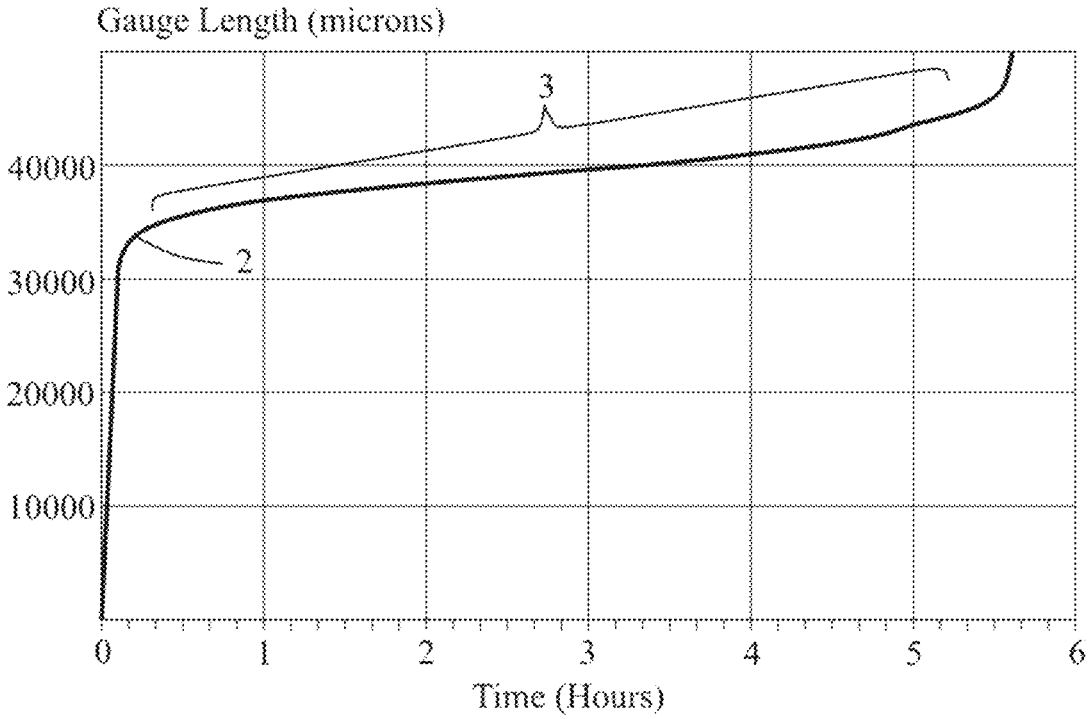
FIG. 23 is a graph showing elongation of a blanket including an anisotropic reinforcement layer according to the teachings herein with time with 350N in a lateral direction at 23° C.

The fabric comprising unidirectional glass fibers in the longitudinal direction and twisted polyamine fibers in the lateral direction was subjected to a constant tension of 350N at about 23° C. in the lateral direction, parallel to the polyamine fibers. The initial length of sample between the internal edges of the two grippers was 60 mm Results are shown in FIG. 23.

Approximate Slope

The approximate slope (angle formed by the curve over an horizontal line) for each of the tested samples was evaluated at different time intervals to ease a rough comparison between the elongation behaviour of the above-described samples.

TABLE 6

| | Control, Cotton in Blanket, FIG. 17 750N @ RT Prestretched | Glass/Nylon in Blanket FIG. 22 350N @ RT | Glass/Nylon in Blanket FIG. 23 350N @ RT | Isotropic Kevlar Fabric, FIG. 20 750N @ RT | Isotropic Glass Fabric FIG. 21 750N @ RT |
|---|---|---|---|---|---|
| longitudinal fibers | Cotton | Glass fiber | Nylon fibers | Kevlar | Glass fiber |
| Between 1-2 hrs | 13.74° | 4.82° | 6.83° | 5.71° | 0.57° |
| Between 2-3 hrs | 18.82° | 4.82° | 5.13° | 3.43° | 2.86° |
| Between 3-4 hrs | 15.52° | 1.38° | 6.15° | 2.29° | NA |
| Between 4-5 hrs | 12.53° | <1° | 12.66° | <1° | NA |
| Between 5-6 hrs | 9.46° | <1° | Failure | <1° | NA |
| Between 1-3 hrs | 16.50° | 4.85° | 6.22° | 4.23° | 2.06° |
| Between 1-5 hrs | 15.03° | 3.30° | 7.83° | 7.61° | NA |
| Between 1-6 hrs | 14.14° | 2.53° | NA | 6.29° | NA |

B. Protonatable Intermediate Transfer Members for Use with Indirect Printing Systems The invention, in some embodiments thereof, relates to intermediate transfer members suitable for use with indirect printing systems having a release layer with an image transfer surface having protonatable functional groups apparent thereupon. It has been found that embodiments of such intermediate transfer members are suitable for printing with inks including an aqueous liquid carrier.

Also disclosed are methods of making such intermediate transfer members.

As noted in the introduction, a stage in indirect printing methods is application of one or more inks as a plurality of ink droplets on the image transfer surface of a release layer of an intermediate transfer member, e.g., by ink jetting.

As a result of momentum, each (presumably close to spherical) ink droplet flattens upon impact with the image transfer surface. Subsequently, the surface tension and cohesion of the ink composition together with the hydrophobic properties of the image transfer surface causes each droplet to adopt a more spherical shape to reduce the area of contact with the image transfer surface of the release layer. This more spherical shape is considered to be at least a contributory reason for suboptimal printing results observed under certain conditions.

Applicant hypothesized that superior printing results (e.g., as expressed in terms of ink-dot sharpness and/or optical density of the image printed in the substrate) are obtainable if the droplets retain a more flattened shape than a more spherical shape. Although not wishing to be held to any one theory, it is believed that advantages resulting from a flattened droplet shape arise, inter alia, from better evaporation of the carrier (due to the greater droplet surface area to unit volume) and formation of a more even ink residue film.

Applicant has discovered that it is possible to at least temporarily retain the flattened droplet shape by using a chargeable aqueous ink compositions together with a chargeable image transfer surface, allowing the above effect to be utilized so that a printing process is devoid of a step of pre-treating the image transfer surface with chemical agents which would otherwise be necessary, prior to application of the ink, to counter the tendency of the thin film formed by each ink droplet to contract and to form a globule on the image transfer member.

Any suitable ink composition may be used, but typically such ink compositions include a coloring agent and an organic polymeric resin in an aqueous carrier, the ink composition having at least one proton-donating component. Exceptionally suitable such ink compositions are described hereinbelow as well as in the co-pending PCT patent application No. PCT/IB2013/051755 of the Applicant identified by Agent's Reference LIP 11/001 PCT, which is included by reference as if fully set forth herein.

During a printing cycle, the ink droplets are applied to the image transfer surface in the usual way. As a result of momentum, the ink droplets flatten on impact with the image transfer surface. A proton-transfer occurs from the proton-donating components of the ink (that becomes negatively charged) to the chargeable image transfer surface (that becomes positively charged). Without desiring to discuss potential reasons or mechanisms therefore, this charging apparently slows down the ink droplet's contraction to a more spherical shape, so that the ink droplets retain a more flattened and less spherical shape for a longer time. This longer time provides sufficient time for the aqueous carrier to be evaporated sufficiently so that the formed ink residue film is distributed over a greater surface area of the image transfer surface as if the droplet had adopted a more flattened shape. It has been found that all other things being equal, in some embodiments such ink residue film distribution provides superior printing results.

Applicant further developed methods of printing that included, prior to application of the ink droplets, pretreatment of the image transfer surface by application of a proton-accepting chemical layer to the image transfer surface, as described in detail in the Applicant co-pending PCT patent application No. PCT/IB2013/000757 identified by Agent's Reference LIP 12/001 PCT, which is included by reference as if fully set forth herein.

Although providing excellent printing results, such methods require the added pretreatment step that may be considered disadvantageous in some applications. Accordingly, Applicant hereby discloses an intermediate transfer member having a protonatable image transfer surface.

Intermediate Transfer Member

Thus, according to an aspect of some embodiments of the teachings herein, there is provided an intermediate transfer member for use with a printing system, comprising:

a release layer having an image transfer surface; and the release layer attached to a body supporting the release layer, wherein apparent on the image transfer surface are protonatable functional groups having a pKb of not more than about 6. The release layer is any suitable thickness. In some embodiments, the release layer is from about 0.1 μm to about 120 μm thick, in some embodiments from about 1 μm to about 50 μm, in some embodiments from about 5 μm to about 20 μm, and in some embodiments even from about 8 μm to about 15 μm thick, e.g., about 10 μm thick.

It has been found that superior printing results are obtained when using such an intermediate transfer member to print using ink compositions as described above. Without wishing to be held to any one theory, it is believed that in a manner analogous to that hypothesized above, proton-transfer occurs from proton-donating components of applied ink droplets to the protonatable functional groups apparent on the image transfer surface. The consequent positive charge of the surface and/or negative charge of components in the ink droplets causes the applied ink droplets to retain a more flattened shape for a longer time, in some embodiments apparently, a time sufficient for evaporation of substantial proportions of the aqueous ink carrier, which in some embodiments is apparently enough to provide the observed superior printing results.

In some embodiments, the protonatable functional groups are bonded to the image transfer surface.

In some embodiments, the protonatable functional groups are covalently bonded to the image transfer surface.

In some embodiments, the protonatable functional groups are functional groups of components that make up the release layer, for example functional groups of polymers that are components of an elastomer that makes up the release layer. As is discussed in greater detailed hereinbelow, release layers made from elastomers of cured standard curable polymer compositions including standard commercially available polymers serendipitously proved to have properties suitable for use as release layers (e.g., abrasion resistance, resilience, smoothness) but also the correct balance of surface properties (e.g., hydrophobicity) and functional group properties (e.g., surface concentration) to implement the teachings herein.

It is important to note that it was initially expected that the protonatable functional groups of polymers would tend to be solvated inside the bulk of the elastomer, leading to an insufficient surface concentration of the functional groups on the surface.

It is also important to note that it was initially expected that subsequent to evaporation of the aqueous carrier, the charged components of the ink composition would form salts with the protonatable functional groups and that such salts would render release of the ink residue film to the substrate impossible. Instead, it was found that the protonation is substantially fully-reversible. Without wishing to be held to any one theory, since the aqueous carrier gradually evaporates during the printing process, with the greatest proportion of carrier at the image forming station and the lowest at the impression station, it is hypothesized that the concentration of aqueous carrier at the image forming station is sufficient to enable protonation of the protonatable groups (e.g., amino groups) of the polymer, while being too low, due to evaporation, to maintain protonation at the impression station, such that the protonated protonatable groups transfer the proton (to become uncharged) to components of the ink residue film (to become uncharged), allowing release of the residue film to the substrate.

pKb of Image Transfer Surface

In some embodiments, the protonatable functional groups have a pKb of not more than about 5.

In some embodiments, the protonatable functional groups have a pKb of not less than about 1. In some embodiments, the protonatable functional groups have a pKb of not less than about 2.

In some embodiments, the protonatable functional groups have a pKb of not less than about 1 and not more than about 6. In some embodiments, the protonatable functional groups have a pKb of not less than about 2 and not more than about 5.

Hydrophobicity of Image Transfer Surface

As noted above, the image transfer surface is preferably hydrophobic. Hydrophobicity is expressed in terms of apparent contact angle that is measured in the usual way using a goniometer, such as commercially available from ramé-hart instrument company, Succasunna, N.J., USA.

In some embodiments, the image transfer surface has an apparent contact angle of not less than about 90°, not less than about 95°, not less than about 100° and even not less than about 105°. In some embodiments, the image transfer surface has an apparent contact angle of not more than about 140°, not more than about 130°, not more than about 120° and even not more than about 115°. In some embodiments, the image transfer surface has an apparent contact angle of between about 90° and about 120°, between about 100° and about 120°, and even between about 105° and about 115°, e.g., about 110°.

Although not wishing to be held to any one theory, it is believed that such hydrophobicity provides a balance to the forces caused by the charged components of the ink composition interacting with the charged image transfer surface to achieve the desired result.

Surface Concentration of Protonatable Functional Groups

The surface concentration of protonatable functional groups on the image transfer surface is any suitable concentration that provides the desired results.

It is currently believed that in some embodiments, the image transfer surface has a surface concentration of not less than about $1\times10^5$ of the protonatable functional groups per micrometer$^2$, in some embodiments not less than about $1\times10^6$ of the protonatable functional groups per micrometer$^2$, and in some embodiments even not less than about $1\times10^7$ of the protonatable functional groups per micrometer$^2$.

It is also currently believed that in some embodiments, the image transfer surface has a surface concentration of not more than about $1\times10^{23}$ of the protonatable functional groups per mm$^2$.

The surface concentration of protonatable functional groups can be determined in any usual way, and typically depends at least partially on the identity of the functional groups of a specific image transfer surface. One approach includes applying a reagent that binds to the specific protonatable functional groups that includes a quantitatively-determinable function. The reagent is applied to the image transfer surface, excess removed, and the amount of quantitatively-determinable functions is determined, for instance using fluorometry to quantitatively determine fluorescent functions, or radiation detection to quantitatively determine radioactive functions (e.g., a DTPA-$^{111}$In function).

For example, when the protonatable functional groups are primary amines, a reagent including a fluoraldehyde portion that binds to primary amines and a quantitatively-determinable function (e.g., a fluorescent or radioactive function) is suitable. For example, when the protonatable functional groups are primary or secondary amines, a reagent including a ninhydrin or FMOC-Cl portion that binds to primary and secondary amines and a quantitatively-determinable function (e.g., a fluorescent or radioactive function) is suitable. Other reagents, suitable for the same or other protonatable functional groups can be made and used without undue experimentation by a person having ordinary skill in the art.

Types of Protonatable Functional Groups

Any suitable protonatable functional groups may be used in implementing the teachings herein. In some embodiments, an image transfer surface includes a single type of protonatable functional group. In some embodiments, an image transfer surface includes a combination of two or more different types of protonatable functional groups.

In some embodiments, the protonatable functional groups comprise protonatable functional groups including at least one nitrogen atom. In some such embodiments, the protonatable functional groups comprise protonatable functional groups selected from the group consisting of primary amines, secondary amines (including, inter alia, indoles, purines, imidazoles), tertiary amines (including, inter alia, pyridines, purines, guanidines, imidazoles), amides and ureas.

In some embodiments, the protonatable functional groups comprise protonatable functional groups selected from the group consisting of primary amines and secondary amines Nature of Release Layer The release layer is fashioned of any suitable material.

Similar to the known in the art, in some embodiments a release layer is advantageously fashioned from an elastomer, especially a silicone elastomer.

In some embodiments, the release layer is fashioned of an elastomer made of a cross-linked curable polymer composition having as a raw ingredient prior to crosslinking: at least one silicone polymer bearing protonatable functional groups having a pKb of not more than about 6.

Method of Making an Intermediate Transfer Member

According to an aspect of some embodiments of the teachings herein, there is also provided a method of preparing a release layer of an intermediate transfer member for use with a printing system, comprising:

a) forming a layer of a curable polymer composition at a thickness of between about 0.1 μm and about 120 μm, as an incipient release layer; and b) curing the layer of curable polymer composition thereby preparing a release layer wherein the curable polymer composition comprises at least one silicone polymer bearing protonatable functional groups having a pKb of not more than about 6.

In some embodiments, the layer of curable polymer composition is formed at a thickness of from about 1 μm to about 50 μm, from about 5 μm to about 20 μm, and in some embodiments even about 8 μm to about 15 μm. The thus-formed incipient release layer, upon curing, becomes the desired release layer. The required thickness of curable polymer composition can be applied using any suitable method, for example by use of a Meyer rod.

Direct Bonding to the Body without Adhesive

In some embodiments, the method further comprises:

providing a body of an intermediate transfer member having a surface;

forming the layer of curable polymer composition directly on the surface of the body so that subsequent to the curing, the release layer is directly attached to the surface of the body, without an adhesive.

In some such embodiments, as the curable polymer composition cures, covalent bonds are formed between components of the curable polymer composition and groups found on the surface of the body of the intermediate transfer member. As discussed hereinbelow, in some such embodiments, an adhesion promoter is added to the curable polymer composition to increase the number of such bonds formed with the surface of the body.

In some embodiments, for example in some embodiments where the body comprises a cured rubber surface (room temperature vulcanization RTV and RTV2, liquid silicone LSR, Vinyl Methyl Silicone (VMQ), Phenyl Silicone Rubber (PMQ, PVMQ), fluorosilicone rubber (FMQ, FMVQ)), alkyl acrylate copolymer rubbers (ACM), ethylene propylene diene monomer rubber (EPDM), fluoroelastomer polymers (FKM), nitrile butadiene rubber (NBR), ethylene acrylic elastomer (EAM), and hydrogenated nitrile butadiene rubber (HNBR), the release layer is directly adherable to the rubber layer without the use of an adhesive layer, especially when the composition comprises an adhesion promoter.

Bonding to the Body Using Adhesive

In some embodiments, even when the body comprises a cured rubber surface as described above, it is desired to bond the release layer to the body using an adhesive.

In some embodiments, the method further comprises:

providing a body of an intermediate transfer member having a surface;

forming a layer of an adhesive on the surface of the body; and forming the layer of curable polymer composition on the adhesive layer so that subsequent to the curing, the release layer is attached to the surface of the body, through an adhesive layer. In some such embodiments, as the curable polymer composition cures, covalent bonds are formed between components of the curable polymer composition and components of the adhesive. As discussed hereinbelow, in some such embodiments, an adhesion promoter is added to the curable polymer composition to increase the number of such bonds formed with the adhesive.

In some embodiments, a layer of an adhesive composition is first applied to the surface of the body of the intermediate transfer member, and subsequently the curable polymer composition is applied on the layer of the adhesive composition. The required thickness of adhesive and/or fluid curable polymer composition can be applied using any suitable method, for example by spraying or with the use of a Meyer rod.

In some embodiments, an adhesive layer is first cured (partially or completely) before application of a curable polymer composition. In some embodiments, a fluid curable polymer composition is applied on an uncured adhesive layer.

Any suitable adhesive may be used. In some embodiments, an adhesive used is an adhesive known in the art, see for example, U.S. Pat. Nos. 3,697,551; 4,401,500; US 2002/0197481; and US 2008/0138546 and PCT Patent Publications WO2002/094912 and WO2010/042784. In some embodiments, an adhesive used is as described in co-pending PCT patent application of the Applicant No. PCT/IB2013/051743 identified by Agent's reference LIP 10/002 PCT.

In some embodiments, the adhesive is a composition comprising an organosilane and a material that generates free radicals upon activation. In some embodiments, the adhesive composition is selected from the group consisting of a thermally-activated adhesive composition and a UV-activated adhesive composition.

In some embodiments, organosilane is an aminosilane, such as, for example, Dynasylan® AMEO (3-Aminopropyltriethoxysilane) or Dynasylan® AMMO (3-Amino-propyltrimethoxysilane), or mixture thereof, both from Evonik.

In some embodiments, the material that generates free radicals upon activation generates free radicals upon thermal-activation, for example, an azidosilane, such as, for example, azidosulfonylhexyltriethyoxysilane. In a preferred embodiment, the adhesive composition is a blend of 3-Aminopropyltriethoxysilane or 3-Aminopropyltrimethoxysilane and an azido silane, such as, for example, Azidosulfonylhexyltriethyoxysilane. More preferably, the adhesive composition comprises 95% (w/w) 3-Aminopropyltriethoxysilane (such as Dynasylan® AMEO) or 3-Aminopropyltrimethoxysilane (such as Dynasylan® AMMO) and 5% (w/w) azido silane.

In some embodiments, the material that generates free radicals upon activation generates free radicals upon UV-activation is a photoinitiator, for example, a benzophenone derivative, or 2-hydroxyl-2-methyl-1-phenyl-1-propanol photoinitiator (Darocur 1173 from Ciba/BASF).

Curing

The curing of the layer of the curable polymer composition may be performed in any suitable manner, for example as known in the art of polymer curing.

In some embodiments, curing is performed at room temperature (i.e., at a temperature of not more than 40° C., preferably not more than 30° C.) for extended period of times, e.g., at least 24 hours. It is generally believed that only such long and slow curing provides an elastomer with sufficient abrasion resistance to serve as a release layer.

Applicant has surprisingly found that in some embodiments curing can be substantially accelerated by curing while heating, and still provide an elastomer suitable for use as a release layer. Thus, in some embodiments, curing the layer of the curable polymer composition comprises: maintaining the layer at an elevated temperature of between about 70° C. and about 160° C. for a period of time of at least about 5 minutes. In some embodiments, the temperature is between about 80° C. and about 150° C., and even between about 130° C. and about 145° C., e.g., 140° C. In some embodiments, the period of time is at least about 1 hour. In some embodiments, the period of time is not more than about 6 hours, not more than about 4 hours and even not more than about 2 hours.

In some, preferred embodiments, prior to the maintaining the layer of the curable polymer composition at the elevated temperature, the layer is maintained at a temperature of not greater than about 40° C. (preferably not more than about 35° C. and even not more than about 30° C.) for a period of time of at least about 1 hour, but not more than about 6 hours, not more than about 4 hours, not more than about 4 hours, and in some embodiments, not more than about 2 hours. That the, in some embodiments, the period of time is at least about 12 hours and even at least about 72 hours.

Curable Polymer Composition

As noted above, in some embodiments, a release layer according to the teachings herein is fashioned of an elastomer made of a cross-linked curable polymer composition having as a raw ingredient prior to crosslinking: at least one silicone polymer bearing protonatable functional groups having a pKb of not more than about 6.

As noted above, in some embodiments the method of making a release layer according to the teachings herein comprises forming a layer of a curable polymer composition as an incipient release layer, wherein the curable polymer composition comprises at least one silicone polymer bearing protonatable functional groups having a pKb of not more than about 6.

Types of Silicone Polymers

In some embodiments, the release layer is fashioned of an elastomer made of a cross-linked curable polymer composition having as a raw ingredient prior to crosslinking: at least one silicone polymer bearing protonatable functional groups having a pKb of not more than about 6. In some embodiments, the protonatable functional groups of the silicone polymer have a pKb of not more than about 5. In some embodiments, the protonatable functional groups of the silicone polymer have a pKb of not less than about 1. In some embodiments, the protonatable functional groups of the silicone polymer have a pKb of not less than about 2. In some embodiments, the protonatable functional groups of the silicone polymer have a pKb of not less than about 1 and not more than about 6. In some embodiments, the protonatable functional groups of the silicone polymer have a pKb of not less than about 2 and not more than about 5.

In some embodiments, the curable polymer composition includes a single type of silicone polymer bearing the protonatable functional groups. In some embodiments, the curable polymer composition includes a combination of at least two different types of silicone polymer bearing the protonatable functional groups. In some embodiments, a given type of such silicone polymer includes a single type of protonatable functional group. In some embodiments, a given type of such silicone polymer includes at least two different types of protonatable functional group.

Typically, the curable polymer composition includes any suitable amount of the silicone polymers bearing the protonatable functional groups. In some embodiments, the silicone polymers bearing protonatable functional groups make up between about 2% and about 98% by weight of the curable polymer composition.

In some embodiments, the protonatable functional groups of the silicone polymers comprise protonatable functional groups including at least one nitrogen atom. In some such embodiments, the protonatable functional groups comprise protonatable functional groups selected from the group consisting of cyclic, primary amines, secondary amines (including, inter alia, indoles, purines, imidazoles), tertiary amines (including, inter alia, pyridines, purines, guanidines, imidazoles), amides and ureas.

Amino Functional Silicone Polymers

In some embodiments, at least one of the silicone polymers is an amino-functional silicone polymer so that the protonatable functional groups include amines. In some such embodiments, amino-functional silicone polymers make-up between about 2% and about 98% by weight of the curable polymer composition.

Amine Number of Curable Polymer Composition

Curable polymer compositions including amino-functional polymers can be characterized by an amine number a measure of the concentration of amine functional groups in a composition. An amine number is a number indicating the amount in milliliters of 0.1N HCl needed to neutralize the amine functional groups of 10 grams of tested composition. In some embodiments, the curable polymer composition has an amine number of between about 10 and about 250. In some embodiments, the curable polymer composition has an amine number of at least about 30, in some embodiments at least about 40 and even in some embodiments of at least about 44.

Specific Examples of Suitable Polymers

Any suitable single amino-functional silicone polymer or combination of amino-functional silicone polymers may be used in implementing a curable polymer composition according to the teachings herein.

In some embodiments, at least one of the amino-functional silicone polymers making up a curable polymer composition according to the teachings herein is selected from the group consisting of: an amino-functional polydialkysiloxane, for example an amino-functional polydimethylsiloxane; an amino-functional polyalkyarylsiloxane, for example an amino-functional polymethylphenylsiloxane; an amino-functional polydiarysiloxane, for example an amino-functional polydiphenylsiloxane; a copolymer methylaminoalkyl dialkyl polysiloxane; an amino-functional alkoxy-functional polydialkylsiloxane; and combinations thereof.

In some embodiments, at least one of the amino-functional silicone polymers making up a curable polymer composition according to the teachings herein is selected from the group consisting of:

a. a pendant amine/dimethyl copolymer of formula I, in some embodiments where x is an integer between 58 and 118, and y is an integer between 4 and 11, such as commercially-available GP4 and GP316 (Genesee) and AMS-132 (Gelest):

Formula I

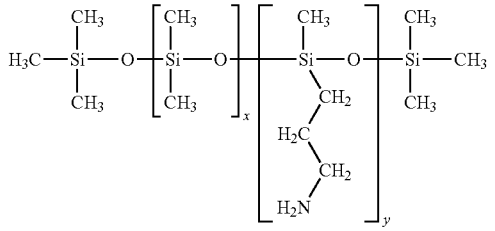

b. an amine-terminated polydimethyl siloxane of formula II, in some embodiments where x is an integer between 10 and 700, such as commercially-available GP965 (Genesee) and DMS-A12 (Gelest):

Formula II

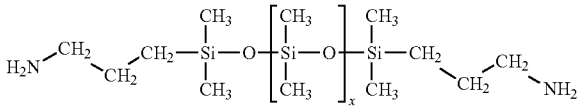

c. an amine-alkyl modified methylalkylaryl silicone polymer of formula III, such as GP7100 (Genesee):

Formula III

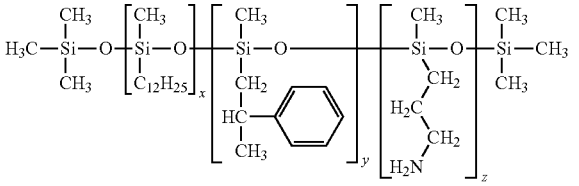

d. an amino or poly-amino and alkoxy end-blocked silicone of formula IV or V, in some embodiments where x is in the range of from 10-350, preferably where x is about 46, such as GP657 (Formula IV) and GP397 (Formula V) both from Genesee:

Formula IV

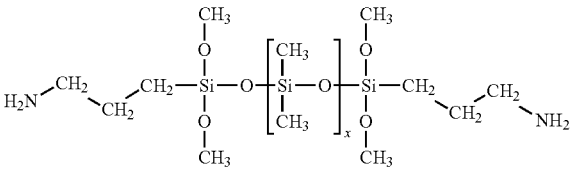

Formula V

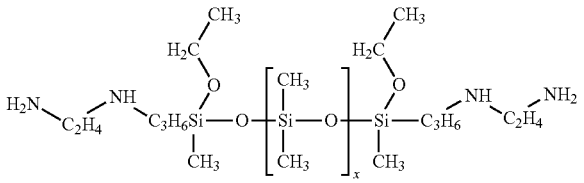

e. a pendant amino functional and alkoxy end blocked silicone of formula VIa (such as KF857, KF862, KF8001 from Shin-Etsu) or VIb:

Formula VIa

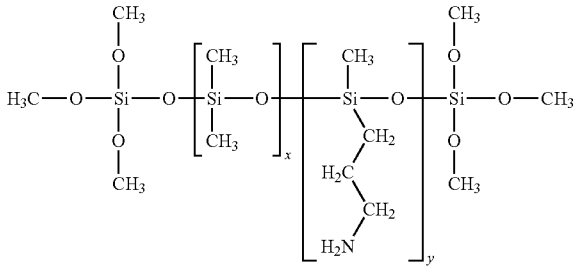

Formula VIb

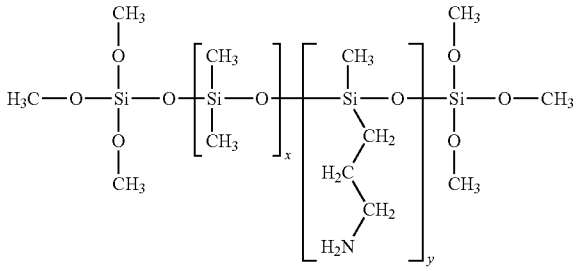

f. a branched amino silicone of formula VII, for example GP 846 and GP1029 (Genesee) and SF 1706 (Momentive):

Formula VII

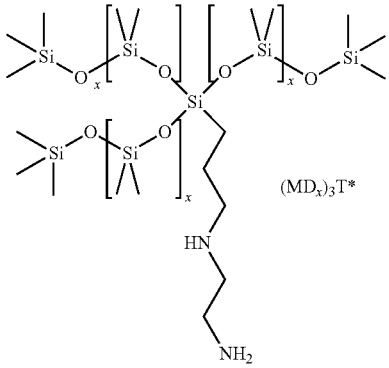

g. a hindered amino silicone containing (tetramethylpiperidinyloxy)propyl methyl siloxane group, for example Rhodorsil® H21654 (Bluestar) or UBS 0822 (Gelest):

Formula VIII

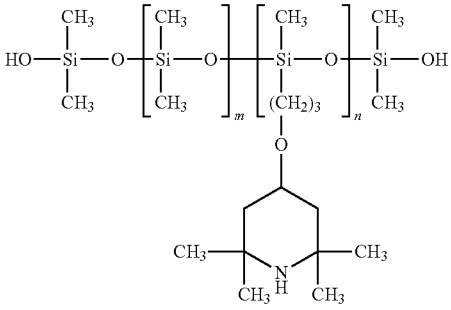

and combinations thereof.

Reactive Silicone Polymer

In some embodiments, a curable polymer composition according to the teachings herein comprises at least one reactive silicone polymer. A reactive silicone polymer is a silicone polymer having two or more functional groups through which crosslinking can be achieved and/or which provide reactive sites on surfaces of the elastomer resulting from curing the curable polymer composition.

In some embodiments, a curable polymer composition according to the teachings herein includes a single type of reactive silicone polymer. In some embodiments, a curable polymer composition according to the teachings herein includes a combination of at least two different reactive silicone polymers.

A curable polymer composition according to the teachings herein includes any suitable amount of reactive silicone polymer.

Any suitable size of reactive silicone polymer may be used to implement the teachings herein.

Any suitable reactive silicone polymer can be used. In some embodiments, at least one of the reactive silicone polymers in the curable polymer composition is selected from the group consisting of: silanol-functional (especially terminated) silicones; silane-functional (especially terminated) silicones; alkoxy-functional (especially terminated) silicones; amido-functional (especially terminated) silicones; amido-functional (especially terminated) alkoxy-functional (especially terminated) silicones; and combinations thereof.

In some embodiments, the reactive-functional silicone is at least partially fluorinated. In some embodiments, the reactive-functional silicone is perfluorinated.

In some embodiments, at least one of the reactive silicone polymers in the curable polymer composition is selected from the group consisting of: silanol-functional polydialkylsiloxane, for example a silanol-functional polydimethylsiloxane; silanol-functional polyalkylarylsiloxane, for example a silanol-functional polymethylphenylsiloxane; silanol-functional polydiarylsiloxane, for example a silanol-functional polydiphenylsiloxane; silane-functional polydialkylsiloxane, for example a silane-functional polydimethylsiloxane; silane-functional polyalkylarylsiloxane, for example a silane-functional polymethyl-phenyl-siloxane; silane-functional polydiarylsiloxane, for example a silane-functional polydipheny-lsiloxane; a silane or silanol terminated copolymer of polydimethyl trifluoropropyl-methylsiloxane; alkoxy-terminated polydialkylsiloxane; amido-functional alkoxy-functional polydialkyl-siloxane; polyalkoxysiloxane; and combinations thereof.

In some embodiments, the reactive-functional silicone is at least partially fluorinated. In some embodiments, the reactive-functional silicone is perfluorinated, for example silanol-terminated polytrifluoropropylmethylsiloxane or silane-terminated polytrifluoropropylmethylsiloxane.

Crosslinker

In some embodiments, a curable polymer composition according to the teachings herein comprises at least one crosslinker, preferably a condensation-cure crosslinker.

In such embodiments, the curable polymer composition includes any suitable amount of crosslinker. In some embodiments, a curable polymer composition includes a crosslinker in an amount between about 1% and about 15%, between about 2% and about 15%; and even between about 2% and about 10% of the weight of the silicone polymers bearing protonatable functional groups.

A curable polymer composition according to the teachings herein includes any suitable type of crosslinker. In some embodiments, the curable polymer composition includes a single type of crosslinker. In some embodiments, the curable polymer composition includes a combination of at least two different crosslinkers.

In some embodiments, at least one (and in some embodiments, substantially all) of the crosslinkers are selected from the group consisting of methylsilicate (tetramethoxysilane, CAS Nr. 681-84-5, $Si(OCH_3)_4$); ethylsilicate (tetraethoxysilane, CAS Nr. 78-10-4, $Si(OC_2H_5)_4$); polymethylsilicates; polyethylsilicates; and combinations thereof.

In some embodiments, the crosslinker consists essentially of tetraethoxysilane and/or polyethylsilicates in an amount between about 1% and about 15% by weight of the silicone polymers bearing protonatable functional groups.

By "polymethylsilicate" is meant oligomers of methylsilicate, having the formula $(CH_3O)_3Si—[O—Si(OCH_3)2]_m—OCH_3$, where m is an integer between 3 and 15, preferably m is an integer between 3 and 10. By "polyethylsilicate" is meant oligomers of ethylsilicate, having the formula $(C_2H_5O)_3Si—[O—Si(OC_2H_5)2]_m—OC_2H_5$, where m is an integer between 3 and 15, preferably m is an integer between 3 and 12. Suitable such crosslinkers that are commercially available include PSI-021 and PSI-023 (Gelest Inc) and Ethylsilicate 48 (Colcoat).

Crosslinking Catalyst

In some embodiments, a curable polymer composition according to the teachings herein further comprises a catalyst suitable for catalyzing the crosslinking of the curable polymer composition, preferably a condensation-cure catalyst.

Such a curable polymer composition includes any suitable type of catalyst. In some embodiments, the curable polymer composition includes a single type of catalyst. In some embodiments, the curable polymer composition includes a combination of at least two different catalysts.

In some embodiments, such a catalyst is selected from the group consisting of tin catalysts, titanate catalysts, chelate titanium, and mixtures thereof.

In some embodiments, the condensation-cure catalyst is a tin catalyst. In some such embodiments, the condensation-cure tin catalyst is selected from the group consisting of dibutyltin bis (acetylacetonate), dioctyl tin stannoxane, stannous octoate, and dioctyl tin bis (acetylacetonate), and combinations thereof.

In some such embodiments, the condensation-cure catalyst is a titanate or chelate titanium catalyst, such as titanium diisopropoxide (bis-2,4-pentanedionate) commercially available as AKT855 from Gelest, titanium diisopropoxide bis(ethylacteoacetate), titanium di-n-butoxide (bis-2,4-pentanedionate), tetrabutyl titanate and tetraoctyl titanate.

In some such embodiments, a curable polymer composition includes a catalyst in an amount of between about 0.1% and about 3%, between about 0.1% and about 2%, between about 0.1% and about 1.6%, between about 0.5% and about 1.8% and even between about 0.8% and about 1.2% of the weight of the silicone polymers bearing protonatable functional groups.

In some embodiments, a curable polymer composition does not include a separate catalyst. In some such embodiments, the amine function acts as an autocatalyst, especially when the curable polymer composition includes highly reactive components such as trialkoxy silane-terminated polymers.

Antioxidant

In some embodiments, a curable polymer composition according to the teachings herein further comprises an antioxidant.

Such a curable polymer composition includes any suitable type of antioxidant. In some embodiments, the curable polymer composition includes a single type of antioxidant. In some embodiments, the curable polymer composition includes a combination of at least two different antioxidants.

In some such embodiments, the antioxidant is selected from the group consisting of sterically hindered phenols (such as, for example, Irganox® 1135 (benzenepropanoic acid, 3,5-bis(1,1-dimethylethyl)-4-hydroxy-C7-C9 branched alkyl ester) (CAS 125643-61-0) from CIBA/BASF); hindered amine light stabilizers; hindered amine functional siloxanes; thioethers; phosphite antioxidants; and mixtures thereof.

The composition may include any suitable amount of antioxidant. In some such embodiments, the curable polymer composition includes an antioxidant in an amount of between about 0.1% and about 3% of the weight of the silicone polymers bearing protonatable functional groups.

Adhesion Promoter

As noted above, the release layer of an intermediate transfer member is attached to a body of the intermediate transfer member. In some embodiments with use of an adhesive and in some embodiments without use of an adhesive. To improve such attachment, in some embodiments, a curable polymer composition according to the teachings herein further comprises an adhesion promoter.

Such a curable polymer composition includes any suitable type of adhesion promoter. In some embodiments, the curable polymer composition includes a single type of adhesion promoter. In some embodiments, the curable polymer composition includes a combination of at least two different adhesion promoters.

In some such embodiments, the adhesion promoter comprises a silane. Suitable silanes include silanes described in U.S. Pat. No. 3,697,551.

In some such embodiments, the adhesion promoter comprises an aminosilane (e.g., mono-amino functional silanes such as 3-amino-propyltriethoxysilane and 3-aminopropyltrimethoxysilane, and mixtures thereof and/or poly-amino functional silanes such as N-2-aminoethyl-3-aminopropyltrimethoxysilane); an acrylosilane (e.g., methacryloxypropyl-trimethoxysilane), an azidosilane (e.g., azidosulfonylhexyltriethoxysilane) and combinations thereof.

In some such embodiments, the curable polymer composition includes an adhesion promoter in an amount of between about 0.1% and about 15% by weight of the silicone polymers bearing protonatable functional groups.

Retardant

In some embodiments, the curable polymer composition further comprises a retardant (also called a curing inhibitor) e.g., short silanol-terminated polydimethylsiloxane.

Retardants increase the room-temperature shelf-life of a curable polymer composition, increasing workability. Such a retardant may be present in any suitable amount, typically between about 1% and about 5% by weight of the silicone polymers bearing protonatable functional groups.

Intermediate Transfer Member and Body

An intermediate transfer member according to the teachings herein may be any type of intermediate transfer member.

Figure 29:
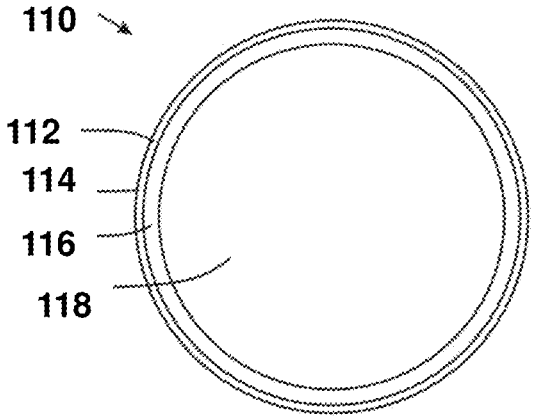
FIG. 29 is a schematic cross-sectional view of an embodiment of a drum-type intermediate transfer member according to the teachings herein.

In some embodiments, an intermediate transfer member according to the teachings herein is a rigid drum-type intermediate transfer member. Any embodiment of such a drum-type intermediate transfer member 110 is schematically depicted in FIG. 29, including a release layer 112 with an image transfer surface 114, release layer 112 supported by body 116 that is secured to a supporting cylinder 118 (e.g., an aluminum roller). In some embodiments, a release layer such as 112 is secured directly to a supporting cylinder such as 118; in such embodiments the supporting cylinder constitutes the body of the intermediate transfer member.

In some such embodiments, a drum-type intermediate transfer member is fashioned as a sheet which is attached to the supporting drum. Typically the sheet is cut to an appropriate size and the laminated structure secured to a rigid (metal, hard plastic) supporting drum, for example, using adhesive.

Figure 30:
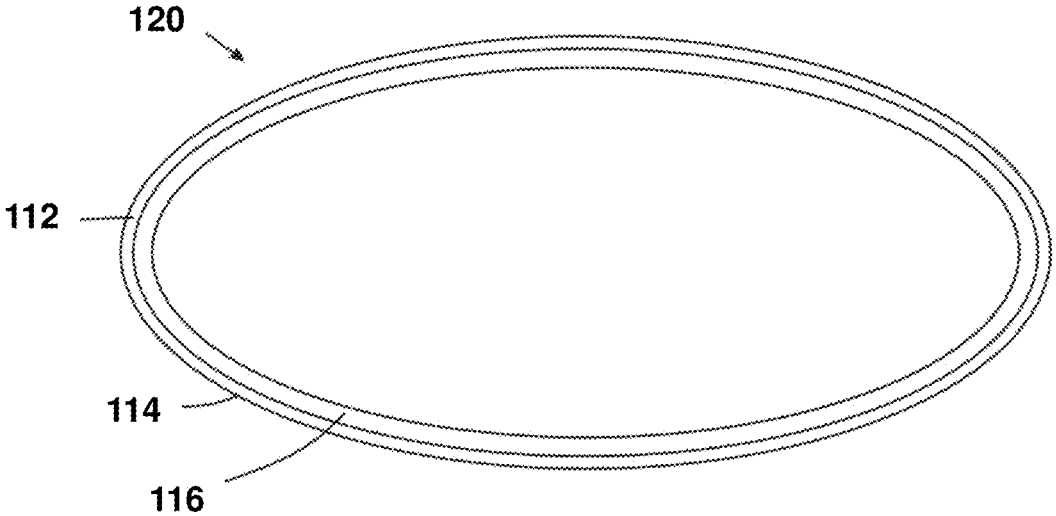
FIG. 30 is a schematic cross-sectional view of an embodiment of a flexible-type intermediate transfer member according to the teachings herein.

In some embodiments, an intermediate transfer member according to the teachings herein is a flexible blanket-type intermediate transfer member (also called belt). Any embodiment of such a blanket-type intermediate transfer member 120 is schematically depicted in FIG. 30, including a release layer 112 with an image transfer surface 114, release layer 112 supported by body 116. In some such embodiments, a blanket-type intermediate transfer member is fashioned as a sheet which ends are joined together to form a loop. The ends may be joined in any suitable method, as known in the art, Depending on the embodiment, the ends may be joined releasably (e.g., zip fastener, hooks, magnets) or permanently (e.g., soldering, welding, adhesive, taping).

A body to which a release layer according to the teachings herein is attached is any suitable body, typically a laminated structure including layers of elastomers each having a different property. A person having ordinary skill in the art is familiar with various types of such bodies and methods of making such bodies. Suitable bodies are discussed, for example, in in the copending PCT patent application of the Applicant identified by Agent's Reference LIP 10/002 PCT. In some embodiments, a body is configured so that the resulting intermediate transfer member has substantially greater elasticity in the lateral direction than in the longitudinal direction (the printing direction), as described in the afore-mentioned application of the Applicant. Some suitable bodies are commercially available, for example from Trelleborg.

As used herein, the term "printing direction" means a direction from the printing heads that apply ink to the release layer towards the location of the printing substrate.

Specifically, a suitable body typically includes at least one layer selected from the group consisting of a conformational layer, a compressible layer, a thermally-insulating layer, a thermally-conductive layer, an electrically-conductive layer, a low-friction layer, a high-friction layer, a reinforcement layer and a connective layer. In some embodiments, the body consists of a reinforcement layer, a compressible layer, a conformational layer and a layer providing desired frictional drag (e.g., low-friction layer, a high-friction layer). In some embodiments, the body consists of a reinforcement layer, a conformational layer and a layer providing desired frictional drag (e.g., low-friction layer, a high-friction layer).

Figure 31:
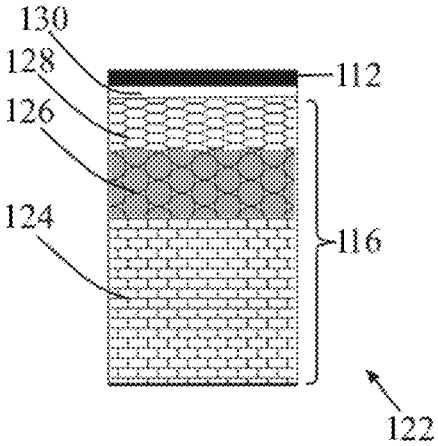
FIG. 31 is a schematic cross-sectional view of an embodiment of a flexible-type intermediate transfer member according to the teachings herein showing layers of the body.

In FIG. 31 is schematically depicted a cross-sectional view of an embodiment of a blanket-type intermediate transfer member 122, including a release layer 112 as described herein. Intermediate transfer member 122 further comprises a body 116, including a reinforcement layer 124, a compressible layer 126, a conformational layer 128, and an adhesive layer 130.

Figure 32:
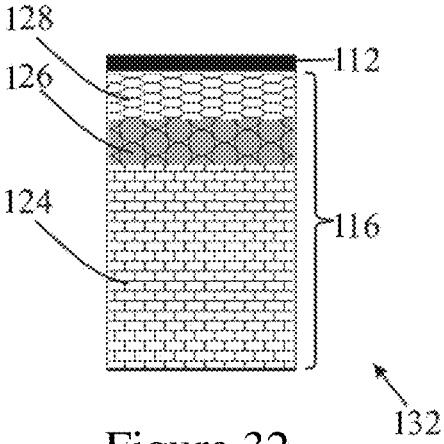
FIG. 32 is a schematic cross-sectional view of an embodiment of a flexible-type intermediate transfer member according to the teachings herein showing layers of the body.

FIG. 32 is schematically depicts a cross-sectional view of an embodiment of a blanket 132 including a release layer 112, a body 116, including a reinforcement layer 124, a compressible layer 126, and a conformational layer 128, without an adhesive layer.

Conformational Layer

A conformational layer is configured to enable an image transfer surface of a release layer of an intermediate transfer member to conform and adapt to the topography of a substrate surface and increases the area of the intermediate transfer member that can be in close proximity to a substrate during impression (the transfer of the residue film to the substrate), thereby improving ink film residue transfer.

A conformational layer is fashioned of any suitable (typically compliant) material or combination of materials, having mechanical properties suitable for the operability of the intermediate transfer member. In some embodiments, a conformational layer is of a material selected from the group consisting of silicone rubber, acrylic rubber (ACM), cured acrylic rubber, hydrogenated nitrile butadiene rubber (HNBR), or combinations thereof.

In some embodiments, a conformational layer has a hardness in the range of from 20 to 65 Shore A. In some embodiments, a conformational layer comprises a soft layer, in some embodiments having a hardness in the range of from 20 to 40 Shore A. In some embodiments, the thickness of a soft conformational layer ranges from about 50 μm to about 1000 μm. In some preferred embodiments, the thickness of a soft conformational layer is about 150 μm.

In some embodiments, a conformational layer comprises a hard layer, in some embodiments having a hardness in the range of from 40 to 65 Shore A. In some embodiments, the thickness of a hard conformational layer ranges from about 5 μm to about 100 μm, from about 10 μm to about 50 μm, and even from about 5 μm to about 30 μm.

In some embodiments, a conformational layer comprises more than one sublayer, each sub-layer optionally having a different hardness. In some such embodiments, a conformational layer comprises both a soft conformational sublayer (substantially as described above for a soft conformational layer) and a hard conformational sublayer (substantially as described above for a hard conformational layer).

In some embodiments, a conformational layer has a glossy surface finish.

Compressible Layer

A compressible layer provides for at least part of the desired compressibility of an intermediate transfer member which improves transfer of an ink residue film from the image transfer surface of the release layer to the substrate. A compressible layer may improve the contact between the release layer and the substrate by adapting the image transfer surface of the release layer of the intermediate transfer member to inherent geometrical variations of the substrate.

In some embodiment, the compressibility of a compressible layer is at least 10% under a load of $P=2\ kg/cm^2$.

A compressible layer is fashioned of any suitable compressible material or compressible combination of materials, having mechanical and optionally thermal properties suitable for the operability of the intermediate transfer member. In some embodiments, a compressible layer comprises (or even consists of) a material selected from the group consisting of silicone rubbers (e.g., room temperature vulcanization RTV and RTV2, liquid silicone LSR, Vinyl Methyl Silicone (VMQ), Phenyl Silicone Rubber (PMQ, PVMQ), fluorosilicone rubber (FMQ, FMVQ), alkyl acrylate copolymer (ACM), ethylene propylene diene monomer (EPDM) rubber, nitrile rubber, void-comprising hydrogenated nitrile butadiene rubber, S-cured and/or peroxide cured rubbers, open-cell rubbers, saturated open-cell rubbers, closed-cell rubbers and combinations thereof. In some embodiments, the rubber is a nitrile rubber having 40-60% (by volume)

small voids. In some embodiment, the nitrile rubber is a void-comprising hydrogenated nitrile butadiene rubber (HNBR).

In some embodiments, a compressible layer comprises one or more sponge-like layers. In some embodiments, wherein a compressible layer comprises a single sponge-like layer, the thickness of the compressible layer ranges from about 50 μm to about 1250 μm, from about 100 μm to about 1000 μm, from about 200 μm to about 600 μm, and even from about 300 μm to about 400 μm. In some embodiments, a compressible layer has a thickness of not more than about 500 μm. In some embodiments, a compressible layer is a single sponge layer having a thickness of about 350 μm.

Thermally-Insulating Layer

In some embodiments, an intermediate transfer member is heated during use, inter alia, allowing quick evaporation of the carrier of an ink composition. In some such embodiments, an intermediate transfer member is heated from the outside, that is to say, there is a heat source facing the image transfer surface of the release layer. In some such embodiments, it is advantageous that the body of the intermediate transfer member be configured for preventing the transfer of heat through the release layer to dissipate in the body. Thus, in some such embodiments, a body of an intermediate transfer member according to the teachings herein comprises a thermally-insulating layer. In some such embodiments, the thermally-insulating layer has a low thermal conductivity, functioning as a thermal insulator to prevent or reduce undesired heat dissipation through the bulk of the body.

A thermally-insulating layer is fashioned of any suitable thermally-insulating material or thermally-insulating combination of materials.

In some embodiments, a thermally-insulating layer has a thickness of at least 100 micrometers.

Thermally-Conductive Layer

As noted above, in some embodiments, an intermediate transfer member is heated during use, inter alia, allowing quick evaporation of the carrier of an ink composition. In some such embodiments, an intermediate transfer member is heated from the inside or from beneath, that is to say, there is a heat source facing the body of the intermediate transfer member, and the heat is transferred through the body, through the release layer to the image transfer surface. In some such embodiments, it is advantageous that the body of the intermediate transfer member be configured for sufficient transfer of heat through the body to the release layer.

Accordingly, in some embodiments, the body of an intermediate transfer member according to the teachings herein comprises a thermally-conductive layer. Typically, such a thermally-conductive layer is configured to facilitate the transfer of heat from the inside of the body towards the image transfer surface of the release layer.

A thermally-conductive layer is fashioned of any suitable thermally-conductive material or thermally-conductive combination of materials. In some embodiments, a thermally-conductive layer has no or only a low amount of air voids. In some embodiments, a thermally-conductive layer comprises (and in some embodiments substantially consists of) low-void silicone rubber or low-void hydrogenated nitrile butadiene rubber. In some embodiments, a thermally-conductive layer includes thermally-conductive fillers such as alumina, carbon black, and aluminium nitride, typically in particulate form in a continuous matrix, especially a polymer matrix In some embodiments, a thermally-conductive layer has a thickness of not less than 100 micrometers.

In some embodiments, a thermally-conductive layer comprises or essentially consists of low-void hydrogenated nitrile butadiene rubber.

Low Friction Layer

In some embodiments, the body of an intermediate transfer member according to the teachings herein comprises a low-friction layer, typically as an innermost layer (furthest from the transfer layer) of a blanket-type intermediate transfer member. In some embodiments, the low-friction layer has a coefficient of friction of less than 3.

Such intermediate transfer members having a low-friction layer as an innermost layer are exceptionally useful for use with printing systems where the intermediate transfer member is mounted on a supporting structure that includes both rolling supports (rollers) and static supports (pins) across which the intermediate transfer member slides. A low-friction layer reduces drag and unwanted frictional heating during printing, and helps reduce wear on the printing device support structure and on the intermediate transfer member. Accordingly, in typical embodiments a low-friction layer also comprises an abrasion-resistant surface for contacting a printing system support structure.

In some embodiments, a low-friction layer is configured to allow heat conduction through the body of the intermediate transfer member, especially for use with printing systems where the intermediate transfer member is heated from the inside. In some such embodiments, the low-friction layer is configured to be sufficiently heat-resistant, allowing intermediate transfer member operating temperatures of up to about 250° C.

A low-friction layer is fashioned of any suitable material or combination of materials, in some embodiments polymers, such as thermoplastic, thermoset and elastomer polymers, including rubbers. In some embodiments, a low-friction layer comprises (or even substantially consists of) a material selected from the group consisting of silicone, polytetrafluoroethylene (e.g., Teflon®), fluorinated rubber (FKM), polyethylene terephthalate (PET), hydrogenated nitrile butadiene rubber (HNBR) and combinations thereof. In some embodiments, a suitable polymer is supplemented with additives providing a low coefficient of friction.

In some embodiments wherein the low-friction layer comprises FKM and/or HNBR, a thin layer (e.g., about 4 microns) of a hard rubber (i.e., hardness 70-80 Shore A), is applied to the image transfer surface of the low-friction layer to provide the required texture. In some embodiments, the low-friction layer has a roughness of between about 4 and about 500 microns. In some embodiments, a suitable roughness is achieved, for example, by buffing or by use of a textured mold before curing of the material making up the low-friction layer, or by inclusion in the material making up the low-friction layer with a filler such as silica or calcium carbonate, having sufficiently large particle size such that particles of the filler are apparent through the surface of the low-friction layer.

In some embodiments, the thickness of a low-friction layer is in the range of from about 1 μm to about 250 μm. In some embodiment, the thickness of a low-friction layer is not more than about 100 micrometer, not more than about 50 micrometers and even not more than about 10 micrometers. In some typical embodiments, the thickness is between about 3 and about 10 micrometers, e.g., about 4 to about 5 micrometers.

High Friction Layer

In some embodiments, the body of an intermediate transfer member according to the teachings herein comprises a high-friction layer, typically as an innermost layer (furthest from the transfer layer) of a blanket-type intermediate transfer member. In some embodiments, the high-friction layer has a coefficient of friction of greater than 3.

Such intermediate transfer members are exceptionally useful for use with printing systems where the intermediate transfer member is mounted substantially exclusively on rolling supports (rollers) and does not substantially slide past any supports (e.g., static pins). Such a high-friction layer facilitates non-slip contact of the intermediate transfer member over the support structure (rollers) of the printing system, ensuring that the rollers have sufficient friction to accurately move the intermediate transfer member.

In some embodiments, a high-friction layer is configured to allow heat conduction through the body of the intermediate transfer member, especially for use with printing systems where the intermediate transfer member is heated from the inside. In some such embodiments, the high-friction layer is configured to be sufficiently heat-resistant, allowing intermediate transfer member operating temperatures of up to about 250° C.

A high-friction layer is fashioned of any suitable material or combination of materials, in some embodiments polymers, such as silicone rubbers (e.g., as listed above). Typically, such materials, such as silicone rubbers are relatively soft, allowing high friction with sufficient mechanical strength and abrasion resistance.

In some embodiments, the thickness of a high-friction layer is in the range of from about 25 μm to about 100 μm and even from about 25 μm to about 50 μm.

Reinforcement Layer

In some embodiments, the body of an intermediate transfer member comprises a reinforcement layer, configured to provide the intermediate transfer member with mechanical strength. Any suitable reinforcement layer may be used in implementing the teachings herein.

Fibers

In some embodiments, a reinforcement layer comprises a plurality of fibers. In some embodiments, at least some of the fibers are predominantly unidirectional fibers. In some embodiments, the unidirectional fibers are oriented substantially parallel to the longitudinal (printing) direction. In some embodiments, the unidirectional fibers are oriented substantially parallel to the lateral direction, that is to say, substantially perpendicular to the longitudinal direction.

Fabric Layers

In some embodiments, the reinforcement layer comprises at least one layer of fabric fashioned from a plurality of fibers, that is to say at least some of the plurality of fibers constitute a layer of fabric. In some embodiments, at least one layer of fabric comprises one or more fabric ply.

In some embodiments, where a reinforcement layer is of a single fabric layer, the thickness of the reinforcement layer ranges from about 100 μm to about 600 μm, from about 100 μm to about 200 μm, from about 400 μm to about 600 μm, from about 200 μm to about 500 μm, and even from about 450 μm to about 550 μm. In some embodiments, a reinforcement layer with a single fabric layer has a thickness of about 350 μm.

In some embodiments, where a reinforcement layer comprises two distinct fabric layers, the thickness of each fabric layers ranges from about 100 μm to about 600 μm, from about 100 μm to about 200 μm, from about 400 μm to about 600 μm, from about 200 μm to about 500 μm, from about 450 μm to about 550 μm, and even from about 100 μm to about 400 μm.

In some embodiments, a reinforcement layer comprises two fabric layers each having a thickness of between about 50 micrometer and about 350 μm. In some embodiments, a reinforcement layer comprises two fabric layers each having a thickness of about 300 μm. In some embodiments, a reinforcement layer comprises two fabric layers, one having a thickness of about 200 μm and the other having a thickness of about 350 μm.

Fiber Types

Each layer of fabric is fashioned from any suitable fiber, twisted or non-twisted. The fibers may be in any suitable form including monofilaments, grouped filaments and yarns. In embodiments including a yarn, the yarn may be of a single type of fiber, or a blend of two or more different types of fibers. In some embodiments, at least some of the fibers (and in some embodiments, substantially all of the fibers) making up a given layer of fabric are selected from the group consisting of meta-aramide polymers (e.g., Nomex® fibers), para-aramide polymers (e.g., Kevlar® fibers), nylon-based fibers, twisted nylon based fibers, cotton-based fibers, twisted cotton-based fibers, polyester-based fibers, twisted polyester-based fibers, glass-based fibers, carbon-fiber (graphite) based fibers, and metal-based fibers, or a combination thereof. In some embodiments, all of the layers of fabric are of the same fiber or combination of fibers. In some embodiments, at least one layer of fabric is of substantially different fiber composition.

Types of Fabric

In some embodiments, at least one fabric layer of the reinforcement layer is a non-woven fabric.

In some embodiments, at least one fabric layer of the reinforcement layer is a woven fabric. In woven fabrics, there are two distinct sets of fibers interlaced at right angles. The longitudinally-oriented fibers are called the warp while the laterally-oriented fibers are called the weft (the filling). Any suitable weave may be used in implementing such embodiments, for example, in some embodiments, a woven fabric layer has a weave selected from the group consisting of plain weave, twill weave, basket weave, satin weave, leno weave and mock leno weave.

In some embodiments, the fibers of a reinforcement layer are fully or partially embedded in (or impregnated with) a solid (non fibrous) elastomer matrix as known in the art of fabrics. A fully-impregnated fabric is a fabric in which the interstices between the filaments/yarns are completely filled with the matrix. In some embodiments, such impregnation improves thermal conductivity and/or enables a better distribution of the mechanical stress between the reinforcement layer and adjacent layers and/or improves mechanical properties of the reinforcement layer, such as reducing crimp. Preferably, the elastomer matrix is compatible with (can be bonded to) adjacent layers of the intermediate transfer member. In some embodiments, the elastomer matrix is a thermally-conductive elastomer, for example an elastomer prepared by extrusion such that polymeric chains of the elastomer are oriented in the direction of extrusion. Any suitable elastomer may be used. In some embodiments, a suitable elastomer is selected from the group consisting of silicone rubber, neoprene rubber, hydrogenated nitrile butadiene rubber (HNBR), nitrile butadiene rubber (NBR), alkyl acrylate copolymer (ACM), or ethylene propylene diene monomer (EPDM), or combinations thereof.

Connective Layer

In some embodiments, the body of an intermediate transfer member according to the teachings herein comprises a connective layer. A connective layer is typically a layer placed between any two functional layers such as described above, and serves to improve adherence therebetween. Specifically, in some embodiments where two functional layers have insufficient mutual adherence, a connective layer able to adequately bond to both is interposed between the two layers. A connective layer is of any suitable thickness. That said, a connective layer is typically between about 100 micrometers and about 300 micrometers thick, more typically between about 150 micrometers and about 250 micrometers thick. In some embodiments, a connective layer is about 200 micrometer thick.

For example, in some embodiments, the body of an intermediate transfer member comprises two or more distinct reinforcement layers. In some such embodiments, there is a connective layer between the two distinct reinforcement layers.

Method of Printing

An intermediate transfer member including a release layer according to the teachings herein can be used with any suitable printing device and/or to implement any suitable printing method to transfer an ink residue film to any suitable substrate.

A typical suitable method of printing comprises: during a printing cycle when a specific image is printed on a specific substrate, to:

a. apply one or more inks (each ink comprising coloring agent in a liquid carrier) as a plurality of ink droplets to form an ink image on the image transfer surface of a release layer of an intermediate transfer member;
b. while the ink image is being transported by the intermediate transfer member, evaporating the carrier to leave an ink residue film including the coloring agents on the image transfer surface of the release layer; and
c. transferring the residue film from the image transfer surface of the release layer to the substrate, thereby printing the desired image on the substrate. In preferred embodiments, the inks are applied as droplets by ink jetting, in the usual way, although other methods of applying ink make also be used.

Typical indirect printing systems suitable to implement the above printing method are described in co-pending PCT application of the applicant Nos. PCT/IB2013/051716 (Agent's reference LIP 5/001 PCT), PCT/IB2013/051717 (Agent's reference LIP 5/003 PCT) and PCT/IB2013/051718 (Agent's reference LIP 5/006 PCT), which are included by reference as if fully set forth herein.

Ink Compositions

An intermediate transfer member including a release layer according to the teachings herein can be used with any suitable ink, especially suitable inks having a coloring agent and resin binder in an aqueous carrier. In such embodiments, the residue film that remains on the image transfer surface of the release layer after evaporation of the carrier that is subsequently transferred to the substrate to produce the desired image on the substrate includes both the coloring agent and the resin binder.

In some embodiments, such inks suitable for use in conjunction with the teachings herein contain a coloring agent (e.g., water-soluble or water-dispersible nanoparticulate pigments) and a water-dispersible or water-soluble organic-polymeric resin.

Any suitable coloring agent may be used.

Any suitable water-dispersible or water-soluble resin binder may be used. As discussed above, it is preferred that the resin binder include functional groups that are negatively charged or chargeable by proton transfer in an aqueous solution. Suitable negatively charged or chargeable groups include carboxylated acids such as having carboxylic acid groups (—COOH), acrylic acid groups (—$CH_2$=CH—COOH), methacrylic acid groups (—$CH_2$=C($CH_3$)—COOH) and sulfonates such as having sulfonic acid groups (—$SO_3H$).

Such charged or chargeable groups can be covalently bound to polymeric backbones and preferably be water soluble or dispersible. Suitable such resin binders may for example comprise acrylic-based resins such as an acrylic polymer and an acrylic-styrene copolymer having carboxylic acid functional groups. Further details on suitable ink compositions that may be used according to the teachings herein are disclosed PCT patent application No. PCT/IB2013/051755 of the Applicant identified by Agent's Reference LIP 11/001 PCT, which is included by reference as if fully set forth herein.

As noted hereinabove, in some embodiments when such chargeable aqueous inks are used together with a release layer according to the teachings herein, superior printing results are achieved. As noted above, without wishing to be held to any one theory it is currently believed that when the ink droplets are applied to the image transfer surface, the ink droplets flatten on impact with the image transfer surface as a result of momentum. Apparently, proton-transfer occurs from the proton-donating components of the ink (that becomes negatively charged) to the protonatable functional groups apparent on the image transfer surface (that become positively charged). Apparently, this charging at least partially counteracts the tendency of the ink droplets to adopt a more spherical shape, so that the ink droplets retain a more flattened and less spherical shape, that is hypothesized to lead to the observed superior printing results.

EXAMPLES

Aspects of the teachings herein were experimentally demonstrated.

Materials

The following materials were used in the experiments:

GP-657 (Genesee)

An amine/alkoxy functional silicone fluid:

$$(NH_2(CH_2)_3—Si(OCH_3)_2—[Si(CH_3)_2O]—Si(OCH_3)_2—(CH_2)_3NH_2),$$

substantially a linear polydimethylsiloxane terminated at either end with an amine/alkoxy function that includes a 3-propyl amine terminus. GP-657 has a molecular weight of 3700 g/mol and an amine number of 54. Each GP-657 molecules includes two terminal primary amine functional groups.

GP-4 (Genesee)

A pendant-amine/dimethyl copolymer silicone fluid:

$$(CH_3—[Si(CH_3)_2O]_{59}—[SiCH_3((CH_2)_3NH_2)O]_4—Si(CH_3)_3),$$

substantially a linear polydimethylsiloxane terminated at a first end with a methyl group, and at the second end with four (3-aminopropyl)methylsiloxane monomers terminated with a trimethyl silyl group. GP-4 has a molecular weight of 4922 g/mol and an amine number of 90. Each GP-4 molecule includes four side-chain primary amine functional groups.

GP-965 (Genesee)

CAS #106214-84-0, an amine end-blocked silicone fluid:

$$(NH_2(CH_2)_3—[Si(CH_3)_2O]_{11}—Si(CH_3)_2—(CH_2)_3NH_2),$$

substantially a X-long linear polydimethylsiloxane terminated at each end with a 3-amino propyl functional group. GP-965 has a molecular weight of 988 g/mole and an amine number of 200. Each GP-965 molecule includes two terminal primary amine functional groups.

GP-397 (Genesee)

An amine/alkoxy functional silicone fluid:

$$H_2N—C_2H_4—NH—C_3H_6—Si(CH_3)(OC_2H_5)O—[Si(CH_3)_2O]_{46}—[Si(CH_3)(OC_2H_5)]—C_3H_6—NH—C_2H_4—H_2N,$$

substantially a linear polydimethylsiloxane terminated at both ends with an amine/alkoxy function that includes a $C_3H_6$—NH—$C_2H_4$—$NH_2$ terminus. GP-397 has a molecular weight of 3798 g/mol and an amine number of 116. Each GP-397 molecule includes two terminal primary amine functional groups and two secondary amine functional groups.

GP-846 (Genesee)

An amine-alkoxy end-blocked branched silicone that contains both amine alkyl and hydrolyzable alkoxy groups, having an amine number of 110.

KF-862 (Shin Etsu)

Side-chain amino dual methoxy ended reactive silicone fluid:

$$CH_3O—Si(CH_3)_2—O—[Si(CH_3)_2)m]—Si(CH_2)(RNH_2)O]n\text{-}Si(CH_3)_2OCH_3$$

having a functional group equivalent molecular weight of 1900 g/mol. Applicant measured the amine number to be 53.

KF-857 (Shin Etsu)

Side-chain amino dual methoxy ended reactive silicone fluid:

$$CH_3O—Si(CH_3)_2—O—[Si(CH_3)_2)m]\text{-}Si(CH_2)(RNH_2)O]n\text{-}Si(CH_3)_2OCH_3$$

having a functional group equivalent molecular weight of 790 g/mol. Applicant measured the amine number to be 127.

SF 1706 (Momentive)

A branched silicone fluid that contains amine functional and dimethylpolysiloxane units. Applicant measured the amine number to be 47.

Rhodorsil H21654 (BlueStar)

A hindered amino silicone containing (tetramethylpiperidinyloxy)propyl methyl siloxane groups, having an amine number of 40.

DMS S27 (Gelest)

CAS 70131-67-8 is a silanol terminated polydimethylsiloxane, having a molecular weight of 18000 g/mol.

PLY 7810 (Nusil Silicone Technology, Carpinteria, Calif., USA)

A silanol terminated fluorosilicone.

PSI 021 (Gelest)

CAS 68412-37-3 a polydiethylsiloxane (tetraethoxysilane, $Si(OCH_2CH_3)_4$), having a molecular weight of 192 g/mol used as a crosslinker.

Ethylsilicate48 (Colcoat)

A decamer of tetraethoxysilane: $(H_5C_2O)$—$[Si(OC_2H_5)_2]_{10}(OC_2H_5)$ having a molecular weight of 1270 g/mol used as a crosslinker.

SIA0780 (Gelest)

CAS 96550-26-4 is 6-Azidosulfonylhexyltriethoxysilane, MW of 354 g/mol.

Tin Catalyst (TIB Chemicals AG (Mannheim, Germany)

The condensation cure catalyst, dioctyl tin bis (acetylacetonate).

Irganox 1135 (BASF)

CAS 125643-61-0 is benzenepropanoic acid, 3,5-bis (1,1-dimethyl-ethyl)-4-hydroxy-C7-C9 branched alkyl esters having a molecular weight of 390 g/mol is an antioxidant used to provide thermal stability to a polymer.

Agerite® Stalite® (Vanderbilt Chemicals LLC, Norwalk, Conn., USA)

A mixture of octylated diphenylamines that serve as an antioxidant.

Darocur 1173® (Ciba/BASF)

A photoinitiator 2-hydroxy 2-methyl 1-phenyl 1-propanol.

Dynasylan® AMEO (Evonik) 3-Aminopropyltriethoxysilane

General Framework

An intermediate transfer member body was commandited from Trelleborg including:

a) a 40 micrometer thick low-friction inner layer;
b) contacting a 250 micrometer thick reinforcement layer including a 200 micrometer thick woven 200 gram cotton fabric impregnated with ACM rubber;
c) contacting a 350 micrometer thick compressible layer of ACM rubber sponge (P=2 kg/cm$^2$);
d) contacting a 100 micrometer conductive layer of rubber having a resistivity of 500 Ohm/cm; and
e) contacting a 100 micrometer conformational layer of soft cured ACM rubber, of 30 Shore A.

The upper surface of conformational layer of cured acrylic rubber defined the surface to which embodiments of release layers according to the teachings herein were attached, with or without the use if adhesive.

Embodiments of curable polymer compositions were prepared and used to prepare release layers by attaching to the intermediate transfer member body to make an intermediate transfer member. The intermediate transfer members were tested in various ways as detailed hereinbelow.

Amino Number

The amino number of each curable polymer composition was calculated by summing the amino number of each constituent amino-functional polymer times the weight percent of that polymer.

Pot Life

The pot life of the curable polymer compositions, i.e. the period of time for which a composition remained flowable, was determined by weighing about 10 g of a composition into an aluminium plate and allowing it to cure at room temperature. Samples were withdrawn periodically with a pipette and checked for flowability. It is preferable for the pot life of the composition to be at least 10 minutes.

Release Layers

In some instances, a uniform 10 micrometer thick layer of a prepared curable polymer composition was applied directly on the outer surface of an intermediate transfer member body described above using a Meyer Rod.

In other instances, first a uniform 1-5 micrometer thick layer of adhesive composition:

48.4% mol Dynasylan® GLYMO 45 (3-glycidyl-oxypropyltrimethoxysilane);
41% mol Dynasylan® MEMO 40 (methacryloxypropyl trimethoxy-silane);
7% mol Tyzor® 10 (Tetrabutyl titanate catalyst); and
3.6% mol SIA 0780 from Gelest (6-azidosulfonylhexyl triethoxysilane)

was applied on the outer surface of an intermediate transfer member body described above using a Meyer Rod, followed by application of a uniform 10 micrometer thick layer of a prepared curable polymer composition on the applied adhesive layer using a Meyer Rod.

A reference intermediate transfer was made by making a composition of 100 parts DMS-S27 (silanol terminated polydimethylsiloxane from Gelest) were combined with 9 parts Ethylsilicate48 crosslinker (Colcoat) and 0.8 parts dioctyl tin bis (acetylacetonate) condensation cure catalyst (TIB Chemicals) that was attached with the use of adhesive as described above to a body.

The incipient blanket body portion with applied curable polymer composition and optional adhesive composition was kept for at least 1 hour at room temperature (RT) and relative humidity between 30-70%, and then cured for at least 5 minutes at about 140° C., during which time the curable polymer composition and optional adhesive composition cured to form a layer having a uniform thickness of about 12 μm of elastomer, as described herein, constituting a release layer of the intermediate transfer blanket. The thus fully-cured laminated structure was allowed to cool. The exact curing conditions of the exemplified curable compositions and release layer thereof are indicated below in the Tables.

After complete curing, the incipient reference intermediate transfer members were formed into a loop by seaming the two short ends.

Gloss and Abrasion Resistance

Gloss and abrasion resistance of the image transfer surface of release layers was tested by measuring Gloss Loss as follows:

3M Scotch® transparent tape was used to remove dust particles from the image transfer surface of the release layer of a swatch of the intermediate transfer member.

The gloss of the thus-cleaned image transfer surface was measured using a hand-held gloss meter (BYK-Gardner USA, Columbia, Md., USA) at a 75° angle of incidence. Gloss was measured at 3 different locations on the image transfer surface. "Original Gloss" was calculated as the average of the three measurements.

The swatch of intermediate transfer member was mounted on the sample stage of a "Rub-Test" abrasion tester (Test Machine Inc.) fitted with 3M 261×9 μm Lapping Film.

The abrasion tester was operated at 1000 cycles at a load of 1 kgf.

The swatch was removed and "Abraded Gloss" measured again as described above.

The Gloss Loss was calculated as:

$$\text{Gloss Loss}=100-((\text{OriginalGloss}-\text{Abraded Gloss})/\text{OriginalGloss})\times 100$$

Adhesion of a Release Layer to a Body

The bonding of a given release layer to a body was tested by rubbing with a finger. Results were given based on a scale from 1 to 4, wherein:

1=poor adhesion (elastomer easily removed from the rubber, rubber surface visible after rubbing);

2=fair adhesion (elastomer removed with difficulty, rubber surface partially to totally visible after rubbing);

3=good adhesion (elastomer removed with great effort, only small or localized areas of the rubber layer are visible); and 4=excellent adhesion (elastomer cannot be removed with rubbing).

Contact Angle

A small sample of a given intermediate transfer member was used to determine the apparent contact angle of the image release surface using a drop-size analyser (DSA1000 from Kruss GmbH, Hamburg, Germany) A drop of distilled water was deposited on the release layer using a microsyringe, and an image of the water drop at the image transfer surface was obtained with a camera. The apparent contact angle was then determined using the DSA 1000 program.

Printing

Ink Composition

A nanoparticle pigment concentrate was made by combining:

1.3% (w/w) Carbon Black Mogul L (Cabot Corp., Boston, Mass., USA) as pigment 12.5% (w/w) Joncryl HPD 296 (35.5% water solution) (BASF) as resin 15% (w/w) Glycerol (Aldrich)

0.2% (w/w) Zonyl FSO-100

1% (w/w) Diethanolamine

Water (distilled) Balance to 100%

The pigment, water, Joncryl HPD 296 and diethanolamone were mixed and milled using a homemade milling machine. The milling may be performed using any one of many commercially available milling machines deemed suitable by one of ordinary skill in the art. The progress of milling was controlled on the basis of particle size measurement (Malvern, Nanosizer). The milling was stopped when the particle size (D50) reached 70 nm. Then the rest of materials were added to the pigment concentrate and mixed. After mixing the ink was filtered through a 0.5 micron filter. The resulting ink composition had a viscosity of 9 cP and a surface tension of 24 mN/m.

Release-Layer Pretreatment Solution

Commercially-available PEI (polyethylenimine having an average molecular weight of 25,000 as Lupasol® WF from BASF Corporation, Florham Park, N.J., USA; CAS 9002-98-6) was diluted with triple-distilled water to give a 0.2% w/w PEI release layer pretreatment solution. The amine number of the solution was measured to be 1800.

Printing

An ink cartridge of a Dimatic DMP-2800 inkjet printer (Fujifilm, Akasaka, Minato, Tokyo, Japan) was charged with the ink composition.

To test printing performance, an intermediate transfer member was fashioned as a patch of approximately 200 mm×300 mm. The patch was fixed image transfer surface facing upwards to a hotplate (with clamps) that was heated to 150° C.

The patch with hotplate was place under the printer

For reference B, a 1 micrometer thick layer of the release-layer pretreatment solution was applied to completely cover the image transfer surface of the release layer. Specifically, the solution was sprayed at the image transfer surface of the release layer that then evened to the desired thickness using a chrome evening roller. After about 30 seconds, the solvent of the release-layer pretreatment solution had evaporated leaving a layer (estimated to be 1 nm thick) of PEI as a chemical agent coating the image transfer surface of the release layer. The ink droplets were subsequently applied to the PEI layer.

For reference A as well as the tested release layers, the ink was applied directly to the image transfer surface.

The printer was operated, in the usual way, to deposit a plurality of 12 or 14 picoliter ink droplets on the image transfer surface of the release layer, forming an ink image while the intermediate transfer member was maintained at 150° C.

After about 30 seconds, the aqueous carrier of the ink had evaporated, living an ink residue film on the image transfer surface of the release layer.

Serving as a substrate, an A4 (210 mm×297 mm) sheet of paper (135 gram Gloss by Condat, le Plessis Robinson, France) was wrapped around a 210 mm long-48 mm radius stainless steel cylinder. The cylinder with paper was manually rolled along the image transfer surface of the release layer so that the ink residue film was transferred to the paper.

Print quality was evaluated by measuring the dot size of the ink transferred to the paper substrate where greater dot size indicates higher print quality.

Print quality was also evaluated by measuring the optical density of the ink transferred to the paper substrate using a Model 528 SpectroDensitometer (X-Rite, Grand Rapids, Mich., USA), where optical density (OD) was measured at 50% and 100% coverage, wherein percentage coverage refers to the amount of ink used in halftoning, wherein 0% denotes white paper (no ink) and 100% denotes a solid black (full ink).

Table A: Examples 15-23

Nine different embodiments of curable polymer compositions were prepared as listed in Table A, and used to prepare embodiments of release lavers.

| | Ref A | Ref B Ref A + PEI | 15 | 16 | 17 | 18 | 19 | 20 | 21 | 22 | 23 |
|---|---|---|---|---|---|---|---|---|---|---|---|
| Adhesive | Yes | Yes | Yes | Yes | Yes | No | Yes | No | No | No | No |
| GP-657 | — | — | — | — | 20 | 100 | 100 | 100 | 100 | 100 | 100 |
| GP-4 | — | — | — | 15 | — | — | — | — | — | — | — |
| GP-965 | — | — | 20 | — | — | — | — | — | — | — | — |
| GP-397 | — | — | — | — | — | — | — | — | — | — | — |
| DMS-S27 | 100 | 100 | 100 | 100 | 100 | 10 | 10 | 10 | 12 | — | — |
| PLY 7810 | — | — | — | — | — | — | | | | 10 | 5 |
| PSI 021 | — | — | 10 | 10 | 10 | 10 | 10 | 10 | 10 | 10 | 10 |
| Ethylsilicate 48 | 10 | 10 | — | — | — | — | — | — | — | — | — |
| SIA0780 | — | — | — | — | — | — | | 1 | 1 | 1 | 1 |
| Tin Catalyst | 0.8 | 0.8 | — | — | — | — | — | — | — | — | — |
| Calculated Amine number | NA | NA | 31 | 11 | 8 | 45 | 45 | 45 | 44 | 45 | 46 |
| Curing | | | | | | | | | | | |
| curing process step 1 at RT (hours) | 1 | 1 | 1 | 1 | 1 | 1 | 1 | 12 | 1 | 72 | 72 |
| curing process step 2 140° C. | 1 h | 1 h | 1 h | 1 h | 1 h | 5 min | 5 min | 5 min | 5 min | 1 h | 1 h |
| Properties | | | | | | | | | | | |
| release layer thickness (micrometer) | 10 | 10 | 10 | 10 | 10 | 10 | 10 | 10 | 10 | 10 | 10 |
| Pot life (min) | 45 | 45 | 2 | 4 | 7 | 6 | 7 | 6 | 5 | 23 | 13 |
| adhesion | 4 | 4 | 4 | 4 | 4 | 4 | 4 | 4 | 4 | 4 | 4 |
| apparent contact angle | 110° | — | 110° | 110° | 110° | 110° | 110° | 110° | 110° | 110° | 110° |
| Gloss | 88 | NA | NA | NA | NA | NA | NA | 88 | NA | NA | 88.5 |
| printed dot size (μm) with 12pl ink droplet | 36-38 | 48 | — | 34 | 38 | 51 | 45-48 | 53-54 | 50 | 51 | 53-54 |
| OD at 50% coverage | 0.2 | 0.63 | — | — | — | 0.6 | 0.47 | 0.52 | 0.56 | 0.57 | 0.59 |
| OD at 100% coverage | 0.33 | 1.4-1.6 | — | — | — | 1.5-1.9 | | 1.96 | 1.32 | 1.97 | 1.4 |

Table B: Examples 24 and 25

Two curable polymer compositions were prepared, and used to make an intermediate transfer member including an image transfer surface, Examples 24 and 25 in Table B.

TABLE B

| | Ref A | Ref B (Ref A + PEI) | 24 | 25 |
|---|---|---|---|---|
| Composition | Table A | Table A | | |
| GP-657 | — | — | 100 | 80 |
| GP-397 | — | — | — | 20 |

TABLE B-continued

| | Ref A | Ref B (Ref A + PEI) | 24 | 25 |
|---|---|---|---|---|
| calculated amine number | NA | NA | 54 | 66.4 |
| Adhesive | yes | yes | no | no |
| Curing | | | | |
| curing process step 1 at RT | 1 h | — | 1 h | 1 h |
| curing process step 2 | 1 h 140° C. | — | 1 h 150° C. | 1 h 150° C. |
| Properties | | | | |
| release layer thickness (micrometer) | 10 | 10 | 10 | 10 |

TABLE B-continued

| | Ref A | Ref B (Ref A + PEI) | 24 | 25 |
|---|---|---|---|---|
| pot life (min) | 45 | 45 | >40 | >120 |
| adhesion | 4 | 4 | 4 | 4 |
| apparent contact angle | 110° | — | 110° | 113° |
| gloss | 89 | — | 89 | 89 |
| printed dot size (μm) with 12 pl ink droplet | 32 | 41.5 | 45 | >45 |

Table C: Example 26

A curable polymer composition was prepared, and used to make an intermediate transfer member including an image transfer surface, Example 26 in Table C. Example 26 is similar to Example 25 but included a crosslinker (that reduced pot life of the composition, but increased speed of production) and an antioxidant (which decreased oxidation of the amino functional groups during curing).

TABLE C

| | Ref A | Ref B (Ref A + PEI) | 26 |
|---|---|---|---|
| Composition | Table A | Table A | |
| GP-657 | — | — | 80 |
| GP-397 | — | — | 20 |
| PSI-021 | — | — | 2 |
| Irganox ® 1135 | — | — | 1 |
| calculated amine number | NA | NA | 65 |
| Curing | | | |
| curing process step 1 at RT | 1 h | 1 h | 1 h |
| curing process step 2 | 1 h 140° C. | 1 h 140° C. | 1 h 140° C. |
| Properties | | | |
| release layer thickness (micrometer) | 10 | 10 | 8 |
| pot life (min) | 45 | — | 60 |
| adhesion | 4 | 4 | 1-2 |
| Apparent contact angle | 110° | — | 110° |
| Gloss | 89 | — | 89 |
| printed dot size (μm) with 12 pl ink droplet | 32 | 41.5 | 45 |
| printed dot size (μm) with 14 pl ink droplet | 69 | 68 | 69 |

Table D: Examples 27a and 27b

The curable polymer composition of sample 26 was prepared, and used to make two intermediate transfer member including an image transfer surface, Examples 27a and 27b in Table D.

A heat-curable adhesive composition was prepared from 95% w/w Dynasylan® AMEO with 5% w/w SIA0780.

During curing, the composition and adhesive were irradiated for 7 minutes using a 250 W infrared bulb (from Osram GmbH, Munich, Germany).

In Example 27a, the release layer was 6 micrometer thick and attached to the body of the intermediate transfer member using a 1 micrometer thick layer of the adhesive. In Example 27a, the incipient intermediate transfer layer was applied as a fluid to a cured (by heating) layer of adhesive.

In Example 27b, the release layer was 5 micrometer thick and attached to the body of the intermediate transfer member using a 1 micrometer thick layer of the adhesive. In Example 27b, the incipient intermediate transfer layer was applied as a fluid to a still-fluid layer of adhesive composition.

TABLE D

| | Ref A | 26 | 27a | 27b |
|---|---|---|---|---|
| Adhesive | yes | no | yes | Yes |
| Curing | | | | |
| curing process step 1 at RT | 1 h | 1 h | 1 h | 1 h |
| curing process step 2 | 1 h 140° C. | 1 h 140° C. | IR 7 min | IR 7 min |
| curing process step 3 | — | — | 1 h 140° C. | 1 h 140° C. |
| Properties | | | | |
| release layer thickness (micrometer) | 10 | 8 | 6 | 5 |
| pot life (min) | 45 | 60 | 60 | 60 |
| adhesion | 4 | 1-2 | 4 | 3 |
| apparent contact angle | 110° | 110° | 110° | 110° |
| gloss | 89 | 89 | 89 | 88.5 |
| printed dot size (μm) with 12 pl ink droplet | 32 | 45 | 53.7 | 52.5 |
| optical density at 50% coverage | 0.67 | 0.64 | 0.63 | 0.55 |
| optical density at 100% coverage | 2.17 | 1.96 | 2.3 | 2.3 |

Table E: Example 28

The curable polymer composition of sample 26 was prepared, and used to make an intermediate transfer member including an image transfer surface, Example 28 in Table E.

A light-curable adhesive composition was prepared from 95% w/w Dynasylan® AMEO with 5% w/w Darocur 1173 photoinitiator.

During curing, the composition and adhesive were irradiated for 7 minutes using a 250 W infrared bulb (from Osram).

TABLE E

| | Ref A | 26 | 28 |
|---|---|---|---|
| Adhesive | yes | no | Yes |
| Curing | | | |
| curing process step 1 at RT | 1 h | 1 h | 1 h |
| curing process step 2 | 1 h 140° C. | 1 h 140° C. | IR 7 min |
| curing process step 3 | — | — | 1 h 140° C. |
| Properties | | | |
| release layer thickness (micrometer) | 10 | 8 | 10 |
| pot life (min) | 45 | 60 | — |
| adhesion | 4 | 1-2 | 4 |
| apparent contact angle | 110° | 110° | 110° |
| gloss | 89 | 89 | 89.5 |
| printed dot size (μm) with 12 pl ink droplet | 32 | 54.8 | 53 |
| OD at 50% coverage | 0.67 | 0.64 | — |
| OD at 100% coverage | 2.17 | 1.96 | — |

Table F: Examples 29-32

Four curable polymer compositions were prepared, and used to make an intermediate transfer member including an image transfer surface (Examples 29-32 in Table F). Examples 29-32 included amino-functional silicones comprising pendant amino functions. The adhesive used was as in Example 28.

TABLE F

| | Ref B | 26 | 29 | 30 | 31 | 32 |
|---|---|---|---|---|---|---|
| Composition | Table A | | | | | |
| GP-657 (RNH2 end chain) | | 80 | — | — | — | — |
| GP-397 (RNH2 end chain) | | 20 | — | — | — | — |
| KF-862 (RNH2 side chain) | | — | 100 | 80 | 60 | — |
| KF-857 (RNH2 end chain) | | — | — | 20 | 40 | 100 |
| PSI-021 (crosslinker) | | 2 | 6 | 6 | 6 | 6 |
| Agerite stalite | | — | — | 1 | — | — |
| Irganox ® 1135 | | 1 | — | — | — | — |
| Tin catalyst | | — | 2 | 1 | 2 | 2 |
| calculated amine number | — | 65 | 53 | 67 | 82.6 | 127 |
| Adhesive | yes | no | yes | yes | yes | yes |
| Curing | | | | | | |
| curing process step 1 at RT | 1 h | 1 h | 1 h | 1 h | 1 h | 1 h |
| curing process step 2 | 1 h 140° C. | 1 h 140° C. | IR 7 min | IR 7 min | IR 7 min | IR 7 min |
| curing process step 3 | — | — | 1 h 140° C. | 1 h 140° C. | 1 h 140° C. | 1 h 140° C. |
| Properties | | | | | | |
| printed dot size (μm) with 12pl ink droplet | 48.9 | 47.2 | 47.8 | 48.1 | 49.7 | 47.2 |
| OD on 80% solid | 1.12 | 0.56 | 0.95 | 1.25 | N/A | 1.32 |
| OD on 100% solid | 1.53 | 0.93 | 1.52 | 1.56 | N/A | 1.74 |

Table G: Examples 33-34

Two curable polymer compositions were prepared, and used to make an intermediate transfer member including an image transfer surface, Examples 33-34 in Table G. Examples 33-34 included amino-functional silicones comprising branched amino silicone. The adhesive used was as in Example 28.

TABLE G

| | Ref B | 26 | 33 | 34 |
|---|---|---|---|---|
| Composition | Table A | | | |
| GP-657 (RNH2 end chain) | | 80 | — | — |
| GP-397 (RNH2 end chain) | | 20 | 20 | — |
| KF-862 (RNH2 side chain) | | — | — | 20 |
| GP-846 (branched) | | — | 80 | — |
| SF 1706 (branched) | | — | — | 80 |
| PSI-021 (crosslinker) | | 2 | 5 | 6 |
| Irganox ® 1135 | | 1 | — | — |
| Tin catalyst | | — | 0.5 | 1 |
| calculated amine number | | 65 | 96 | 48.2 |
| Adhesive | yes | no | yes | yes |
| Curing | | | | |
| curing process step 1 at RT | 1 h | 1 h | 1 h | 1 h |
| curing process step 2 | 1 h 140° C. | 1 h 140° C. | IR 7 min | IR 7 min |
| curing process step 3 | — | — | 1 h 140° C. | 1 h 140° C. |
| Properties | | | | |
| printed dot size (μm) with 12 pl ink droplet | 48.9 | 47.2 | 46.4 | 45.8 |
| OD on 80% solid | 1.12 | 0.56 | 0.76 | 0.95 |
| OD on 100% solid | 1.53 | 0.93 | 1.41 | 1.61 |

Table H: Example 35

A curable polymer composition was prepared, and used to make an intermediate transfer member including an image transfer surface, Example 35 in Table H. Example 35 included amino-functional silicones comprising hindered amino-silicone. The adhesive used was as in Example 28.

TABLE H

| | Ref B | 26 | 35 |
|---|---|---|---|
| Composition | Table A | | |
| GP-657 (RNH2 end chain) | | 80 | — |
| GP-397 (RNH2 end chain) | | 20 | 20 |
| Rhodorsil H21654 (Hindered Amine) | | — | 100 |
| PSI-021 (crosslinker) | | 2 | 10 |
| Irganox ® 1135 | | 1 | — |
| Tin catalyst | | — | 1 |
| calculated amine number | | 65 | 28 |
| Adhesive | yes | no | Yes |
| Curing | | | |
| curing process step 1 at RT | 1 h | 1 h | 1 h |
| curing process step 2 | 1 h 140° C. | 1 h 140° C. | IR 7 min |
| curing process step 3 | — | — | 1 h 140° C. |
| Properties | | | |
| printed dot size (μm) with 12 pl ink droplet | 48.9 | 47.2 | 45.2 |
| OD on 80% solid | 1.12 | 0.56 | 0.38 |
| OD on 100% solid | 1.53 | 0.93 | 0.4 |

Advancing/Receding Contact Angles

The advancing contact angle and receding contact angle of some of the above examples were tested in the usual way. It was found that all the tested examples had an advancing contact angle of between 105° and 115° and a receding contact angle of between 65° and 75°.

Testing Release of Residue Film from an Image Transfer Surface

As discussed above, after ink droplets are applied to an image transfer surface of a release layer and the ink carrier evaporated, it is necessary to transfer the resulting ink residue film to a substrate to effect printing. Generally, it is preferred that an image transfer surface of a release layer have a high releasability of an ink residue film to ensure complete transfer of the residue film to the substrate. To evaluate the releasability of ink from image transfer surfaces of release layer examples, the following method was used.

An ink residue film was formed on the image transfer surface of a release layer to be tested, substantially as described above by printing with the inkjet printer as described above.

Abutting lengths of 25 mm wide standard pressure-sensitive adhesive tape (Tesa 7475) was applied by light finger pressure on top of the residue film to completely cover the release layer.

The release layer with residue film and tape was cleanly cut into 25 mm wide 175 mm long test strips using a sharp knife.

Each test strip was rolled twice in each direction using a FINAT test roller at a speed of approximately 10 mm per second.

Each thus-rolled test strip was fixed in a tensile tester, and the tensile tester activated to strip the tape from the release layer at an angle of peel of 180° at a rate of 300 mm per minute, with release force measured at 10 mm intervals. The average of 5 measurements was calculated.

It was found that all the tested examples required a release force of between 0.4 and 3.1 N.

Discussion of the Results

In Examples 15-21, amino-functional silicone polymers were added to a standard reactive silicone polymer, silanol-terminated polydimethylsiloxane DMS-S27 (see Table A).

At low concentrations of amino-functional silicone polymer (15-20 parts per hundred of the reactive silicone polymer, Examples 15-17), no difference in printed dot size was seen as compared to Reference A, indicating insufficient flattening of the ink droplets on the image release surface by the ink. Further, poor release of the ink residues to the substrate was obtained using amino silicone fluids which did not crosslink (Examples 16 and 17).

Examples 18-21 included predominantly the GP-657, which is both an amino-functional silicone polymer and a reactive silicone polymer (through the dimethoxy functions). It was believed that releasability of the ink residues to the substrate necessitated an amount of the DMS-27, and to ensure crosslinking, a crosslinker (PSI-021 from Gelest) was added. Surprisingly a dot size of greater than 50μ was obtained for all the Examples 18-21, without any substantial negative effects on the ink residue releasability, as determined by percentage transfer of the ink residue with no memory on the image transfer surface. It is noted that the dot size becomes smaller when the proportion of DMS-S27 increases (Examples 20 and 21). At levels of DMS-S27 above 12 parts per hundred, the dot size obtained is similar to that of Reference A.

In Examples 22 and 23, a silanol terminated polytrifluoropropylmethylsiloxane (fluoro-silicone PLY 7810) was used instead of silanol terminated polydimethylsiloxane (DMS-S27). The fluorosilicone cured much more slowly than the dimethylsilicone and increased the pot life to 23 min, while providing dot size of greater than 50μ.

Examples 24 and 25 showed excellent print quality, with dot size and release similar to that obtained with Reference B.

Example 26 showed excellent print quality, similar to that obtained with Reference B. The curable polymer composition of Example 26 (which included an antioxidant) was found to be less sensitive to degradation during heat curing compared to that of Example 25.

Examples 27 and 28 demonstrated significant improvement of adhesion of the release layer to the body of the blanket using an adhesive layers (heat-activated and UV-activated, respectively), without degrading the printing quality.

Examples 29-32 demonstrated that the use of side-chain amino functional silicone allow to achieve higher amine number curable polymer compositions. Better print quality (higher optical density) was obtained with higher amine number.

Examples 33-34 demonstrated the use of branched amino silicone that give better print quality than end-chain amino-silicones.

Example 35 shows that hindered aminosilicones do not allow a good print quality, possibly due to low amino number.

In conclusion, it appears that the print quality of a release layer is related to the amine number of the curable polymer composition from which it is made.

It appears that side-chain or branched aminosilicones give higher print quality than terminal aminosilicones.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

Citation or identification of any reference in this application shall not be construed as an admission that such reference is available as prior art to the invention.

Section headings are used herein to ease understanding of the specification and should not be construed as necessarily limiting.

The invention claimed is:

1. An intermediate transfer member (ITM) for an indirect printing system having a support structure that includes rollers about which the transfer member is mounted during use, the ITM comprising a continuous loop having (i) a defined circumference along a longitudinal direction of the continuous loop and (ii) a defined width in a lateral direction that is perpendicular to the longitudinal direction, wherein:

i. the image transfer member comprises a release layer disposed thereon, the release layer having an image transfer surface;

ii. the defined circumference of the continuous loop is at least 9 meters along the longitudinal thereof;

iii. a ratio between the defined circumference of the continuous loop along the longitudinal direction thereof and the defined width in the lateral direction of the continuous loop is at least 6:1;

iv. the image transfer member comprises a plurality of markers affixed to the ITM, each of the markers being detectable by a detector so as to facilitate registration of relative positioning of the intermediate transfer member; and v. the release layer has at least one of the following properties:

A. the image transfer surface of the release layer is hydrophobic;

B. the release layer comprises at least one crosslinked silicone polymer; and

C. the release layer is of a cured elastomer comprising a crosslinked silanol-terminated polymer and/or silane-terminated polymers.

2. The intermediate transfer member of claim 1 wherein the continuous loop is formed by the securing of ends of an elongated flat strip to each other to convert the elongated flat strip into the continuous loop, and wherein a plurality of lateral projections laterally project from sides of the elongated flat strip.

3. The intermediate transfer member of claim 1 wherein the image transfer surface of the release layer is hydrophobic.

4. A method of printing comprising:

a. providing the intermediate transfer member of claim 1;

b. depositing droplets of an aqueous ink onto the image transfer surface of the release layer of the intermediate transfer member to form an ink-image on the image transfer surface; and c. after the ink-image is at least partly dried, transferring the ink-image or a residue film produced therefrom from the image transfer surface to substrate.

5. An intermediate transfer member (ITM) for an indirect printing system having a support structure that includes rollers about which the transfer member is mounted during use, the transfer member comprising an elongated flat strip of which the ends are secured to one another when the transfer member is installed in the printing system, wherein:

i. the image transfer member comprises a release layer disposed thereon, the release layer having an image transfer surface;

ii. a length of the elongated flap strip is at least 9 meters and a ratio between a length and a width of the elongated flat strip is at least 6:1;

iii. the securing of the ends of the elongated flat strip to each other converts the elongated flat strip into a continuous loop;

iv. the release layer has at least one of the following properties:

A. the image transfer surface of the release layer is hydrophobic;

B. the release layer comprises at least one crosslinked silicone polymer; and

C. the release layer is of a cured elastomer comprising a crosslinked silanol-terminated polymer and/or silane-terminated polymers.

6. The intermediate transfer member of claim 5 wherein the ends of the elongated flat strip are adhesively secured to one another to form the seam and to convert the elongated flat strip into the continuous loop.

7. The intermediate transfer member of claim 6 wherein the ends of the elongated flat strip are taped to one another to form the seam and to convert the elongated flat strip into the continuous loop.

8. The intermediate transfer member of claim 5 further comprising a plurality of markers affixed to the ITM, each of the markers being each detectable by a detector so as to facilitate registration of relative positioning of the intermediate transfer member.

9. The intermediate transfer member of claim 5 wherein a plurality of lateral projections laterally project from sides of the elongated flat strip.

10. The intermediate transfer member of claim 5 wherein the image transfer surface of the release layer is hydrophobic.

11. A method of printing comprising:

a. providing the intermediate transfer member of claim 5;

b. depositing droplets of an aqueous ink onto the image transfer surface of the release layer of the intermediate transfer member to form an ink-image on the image transfer surface; and c. after the ink-image is at least partly dried, transferring the ink-image or a residue film produced therefrom from the image transfer surface to substrate.

12. The method of claim 11 wherein a plurality of markers are affixed to the ITM, and wherein the method further comprises detecting the markers by a detector so as to facilitate registration of relative positioning of the intermediate transfer member.

13. An indirect printing system comprising:

a. a support structure including rollers;

b. an intermediate transfer member (ITM) comprising a continuous loop mounted about the rollers, the continuous loop having (i) a defined circumference along a longitudinal direction of the loop and (ii) a defined width in a lateral direction that is perpendicular to the longitudinal direction, wherein:

i. the defined circumference of the continuous loop is at least 9 meters along the longitudinal thereof;

ii. a ratio between the defined circumference of the continuous loop along the longitudinal direction thereof and the defined width in the lateral direction of the continuous loop is at least 6:1;

iii. the image transfer member comprises a release layer disposed thereon, the release layer having an image transfer surface;

iv. the release layer has at least one of the following properties:

A. the image transfer surface of the release layer is hydrophobic;

B. the release layer comprises at least one crosslinked silicone polymer; and

C. the release layer is of a cured elastomer comprising a crosslinked silanol-terminated polymer and/or silane-terminated polymers.

14. The system of claim 13 further comprising an image forming station where an ink image is formed on the image transfer surface of the release layer by droplet deposition on the image transfer surface.

15. The system of claim 13 further comprising an impression station where the ink image or a residue film produced therefrom is transferred to substrate from the image transfer surface of the release layer of the intermediate transfer member.

16. The system of claim 13, wherein:

i. the intermediate transfer member further comprising a plurality of markers affixed to the ITM; and ii. the system further comprises a marker-detector for detecting the markers to determine relative positioning of the image transfer member.

17. The system of claim 13 further comprising wherein a plurality of lateral projections laterally project from sides of the elongated flat strip.

18. A method of printing comprising:

a. providing the printing system of claim 13;

b. at an image forming station of the printing system, depositing droplets of an aqueous ink onto the image transfer surface of the release layer of the intermediate transfer member to form an ink-image on the image transfer surface; and c. after the ink-image is at least partly dried and at an impression station of the printing system, transferring the ink-image or a residue film produced therefrom from the image transfer surface to substrate.

* * * * *